US005278034A

United States Patent [19]

Ohki et al.

[11] Patent Number: 5,278,034

[45] Date of Patent: Jan. 11, 1994

[54] PROCESS FOR FORMING COLOR IMAGE

[75] Inventors: Nobutaka Ohki; Koichi Nakamura; Masato Taniguchi, all of Minami-Ashigara, Japan

[73] Assignee: Fuji Photo Film Co., Ltd., Minami-Ashigara, Japan

[21] Appl. No.: 989,556

[22] Filed: Dec. 11, 1992

Related U.S. Application Data

[63] Continuation-in-part of Ser. No. 691,437, Apr. 25, 1991, abandoned.

[30] Foreign Application Priority Data

Apr. 27, 1990 [JP] Japan ..... 2-114603
Jan. 13, 1992 [JP] Japan ..... 4-004088

[51] Int. Cl.[5] ..... G03C 7/407

[52] U.S. Cl. ..... 430/440; 430/435; 430/442; 430/480; 430/483; 430/484; 548/531; 548/537; 548/577

[58] Field of Search ..... 430/435, 440, 442, 480, 430/483, 484; 548/531, 537, 577

[56] References Cited

U.S. PATENT DOCUMENTS 2,350,843 6/1944 Vanselou et al. ..... 548/577
3,210,373 10/1965 Cook et al. ..... 548/531
3,639,421 2/1972 Islam et al. ..... 548/577
4,129,573 12/1978 Bellus et al. ..... 548/531
4,294,606 10/1981 Tobler et al. ..... 548/577

*Primary Examiner*—Hoa Van Le
*Attorney, Agent, or Firm*—Burns, Doane, Swecker & Mathis

[57] ABSTRACT

A process for forming a color image comprises the step of developing an image-wise exposed silver halide color photographic material with a color developing composition containing an N-(4-aminophenyl)pyrrolidine derivative such as which produces an excellent hue in a rapid process.

16 Claims, No Drawings

PROCESS FOR FORMING COLOR IMAGE

CROSS-REFERENCE TO RELATED APPLICATION

The present application is a continuation-in-part of U.S. application Ser. No. 691,437 filed Apr. 25, 1991, now abandoned.

BACKGROUND OF THE INVENTION

The present invention relates to a process for forming a color image with a processing liquid comprising the developing composition containing a new developing agent for a silver halide color photographic material. In particular, the present invention relates to a process for forming a color image with a processing liquid composition containing the developing agent which is suitable for rapid processing to yield a dye having an excellent hue. In more particular, the present invention relates to a process for forming a color image with the processing liquid containing a developing agent for silver halide color photographic material which is an N-(4-aminophenyl)pyrrolidine derivative.

Various p-phenylenediamine compounds, particularly N,N-dialkyl-substituted p-phenylenediamine compounds, were proposed as color developing agent to be contained in a color developer. For example, alkyl groups at N-position proposed heretofore include N-hydroxyalkyl groups described in U.S. Pat. No. 2,108,243, N-sulfonamidoalkyl groups described in U.S Pat. Nos. 2,193,015, 2,552,240 and 2,566,271, N-acylaminoalkyl groups described in U.S. Pat. Nos. 2,552,242 and 2,592,363, N-acyllalkyl groups described in U.S. Pat. No. 2,374,337, N-alkoxyalkyl groups described in U.S. Pat. No. 2,603,656, Japanese Patent Unexamined Published Application (hereinafter referred to as 'J.P. KOKAI') Nos. 47-11534 and 47-11535, Japanese Patent Publication for Opposition Purpose (hereinafter referred to as 'J.P. KOKOKU') No. 54-16860, 58-14670 and 58-23618, N-sulfoalkyl groups described in British Patent No. 811,679 and N-aralkyl groups described in U.S. Pat. No. 2,716,132. The substituents of the benzene nucleus include, for example, nuclear alkoxyl groups described in U.S. Pat. Nos. 2,304,953, 2,548,574, 2,552,240 and 2,592,364, nuclear acylaminosulfonamido groups described in U.S. Pat. Nos. 2,350,109 and 2,449,919, nuclear acylaminoalkylsulfonamidoalkyl groups described in U.S. Pat. Nos. 2,552,241, 2,556,271 and 2,592,364, nuclear amino group described in U.S. Pat. Nos. 2,570,116, 2,575,027 and 2,652,331, and nuclear thiosulfonic acid groups described in British Patent No. 872,683.

As for the use of compounds analogous to p-phenylenediamine as the color developing agents, tetrahydroquinolines and dihydroindoles are described in U.S. Pat. Nos. 2,196,739 and 2,556,259, N-(p-aminophenyl)hexamethyleneimines are described in U S. Pat. No. 2,612,500 and 9-aminodurolidines are described in U.S. Pat. No. 2,707,681.

Recently in the processing of color photosensitive materials, a rapid process wherein the development time is reduced is desired from the economical viewpoint. It is described in J.P. KOKAI No. 60-118,838 that 4-amino-N-ethyl-N-β-methanesulfonamidoethyl-3-methylaniline (D-1) is unsuitable for use in the rapid process. Further various processes were proposed for reducing the time required for processing color photosensitive materials. Among them, a process described in J.P. KOKAI Nos. 60-118,348 and 61-261,740 wherein 4-amino-N-ethyl-N-β-hydroxyethyl-3-methylaniline (D-2) is used is known to be effective.

However, the properties and effect of D-2 are yet unsatisfactory, since the obtained hue is not preferred or the rapidness is often insufficient.

SUMMARY OF THE INVENTION

A primary object of the present invention is to provide a rapid process for forming a color image of excellent hue.

Another object of the present invention is to provide a rapid process for forming a color image of high fastness to darkness and heat.

These and other objects of the present invention will be apparent from the following description and Examples.

The first aspect of the invention relates to a process for forming a color image comprising the step of developing a color-exposed silver halide color photosensitive material with a processing liquid containing a color developing agent of the following general formula[I]:

general formula [I]:

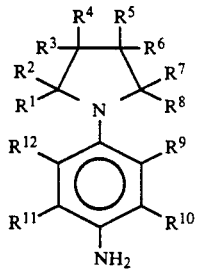

wherein $R^1$ to $R^8$ may be the same or different from one another and each represent a hydrogen atom, halogen atom, amino group, hydroxyl group, cyano group, alkyl group, alkoxyl group, amido group, sulfonamido group, carbamoyl group, alkoxycarbonylamino group, ureido group, sulfamoylamino group, sulfonyl group, carboxyl group or sulfo group, $R^9$ to $R^{12}$ may be the same or different and each represent a hydrogen atom, halogen atom, amino group, hydroxyl group, alkyl group, alkoxyl group, amido group, sulfonamido group, alkoxycarbonylamino group, ureido group or sulfamoylamino group, with the proviso that at least one of $R^1$ to $R^{12}$ is not hydrogen atom.

The second aspect of the invention relates to a process for forming a color image comprising the step of developing a color exposed silver halide color photographic material with a processing liquid containing a developing agent represented by the following general formula [II]:

formula [II]:

general formula [II]:

-continued

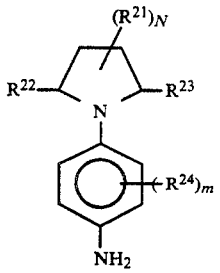

wherein $R^{21}$, $R^{22}$, $R^{23}$ and n are as defined in the general formula (I), $R^{24}$ represents a substituent, m represents an integer of 0 to 4 and when m represents a number of 2 or above, $R^{24}$'s may be the same or different from each other and may form a ring, and $R^{22}$ and $R^{23}$ each represent a substituted or unsubstituted alkyl group.

The above general formula represent not only specific stereoisomers but they include all the possible stereoisomers.

DESCRIPTION OF THE PREFERRED EMBODIMENTS

Detailed description will be made on the general formula [I]. $R^1$ to $R^8$ each represent a hydrogen atom, halogen atom (such as F, Cl or Br), amino group having 0 to 6 carbon atoms (such as amino, N,N-dimethylamino or N-butylamino group), hydroxyl group, cyano group, alkyl group having 1 to 6 carbon atoms (such as methyl, ethyl, hydroxymethyl, methoxyethyl, methanesulfonamidoethyl or hydroxybutyl group), alkoxyl group having 1 to 6 carbon atoms (such as methoxy, methoxyethoxy, hydroxyethoxy or hydroxybutoxy group), amido group having 2 to 6 carbon atoms (such as acetamido or pentanoylamino group), sulfonamido group having 1 to 6 carbon atoms (such as methansulfonamido or benzenesulfonamido group), carbamoyl group having 1 to 6 carbon atoms (such as carbamoyl, N,N-dimethylcarbamoyl or N butylcarbamoyl), alkoxycarbonylamino group having 2 to 6 carbon atoms (such as methoxycarbonylamino or butoxycarbonylamino group), ureido group having 0 to 6 carbon atoms (such as ureido, N-methylureido or N,N-diethylureido group), sulfamoylamino group having 0 to 6 carbon atoms (such as sulfamoylamino or N,N-dipropylsulfamoylamino group), sulfonyl group having 1 to 6 carbon atoms (such as methanesulfonyl group), carboxyl group or sulfo group. $R^9$ to $R^{12}$ each represent a hydrogen atom, halogen atom, amino group, hydroxyl group, alkyl group, aloxyl group, amido group, sulfonamido group, alkoxycarbonylamino group, ureido group or sulfamoylamino group. Examples of these substituents are the same as those of $R^1$ to $R^8$. At least one of $R^1$ to $R^{12}$ is not hydrogen atom.

Preferred examples of the compounds of the general formula [I] are those of the general formula [I-a]:

general formula [I-a]:

-continued

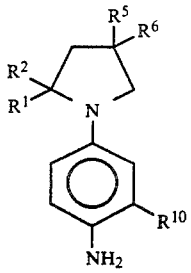

wherein $R^1$, $R^2$, $R^5$, $R^6$ and $R^{10}$ are as defined in the general formula [I]. $R^1$, $R^2$, $R^5$ and $R^6$ are each preferably a hydrogen atom, amino group, hydroxyl group, alkyl group, alkoxyl group, amido group, sulfonamido group, carbamoyl group or ureido group, and preferably, at least one of them is not hydrogen atom. $R^{10}$ is preferably a hydrogen atom, alkyl group, alkoxyl group, amido group, sulfonamido group, alkoxycarbonylamino group or ureido group, and is particularly preferably a hydrogen atom or an alkyl group (such as a lower alkyl group, e.g. methyl or ethyl group).

Most preferably in the general formula [I-a], $R^1$ and $R^2$ are each a hydrogen atom, at least one of $R^5$ and $R^6$ is not hydrogen atom and $R^{10}$ is a hydrogen atom or alkyl group.

Since the compound of the general formula [I] is quite unstable when it is stored in the free amine form, it is preferably produced and stored in the form of its salt with an inorganic acid or organic acid and is converted into the free amine when it is to be added to the processing liquid. Examples of the inorganic or organic acids for forming the salt of the compound of the general formula [I] include hydrochloric acid, sulfuric acid, phosphoric acid, p-toluenesulfonic acid, methanesulfonic acid and naphthalene-1,5-disulfonic acid.

Typical examples of the developing agents of the present invention will be given below, which by no means limit the developing agents of the invention:

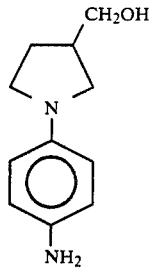

(1)

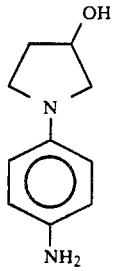

(2)

-continued
(3)
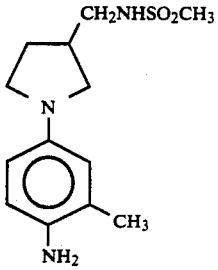
(4)
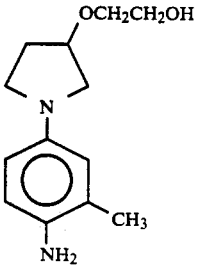
(5)
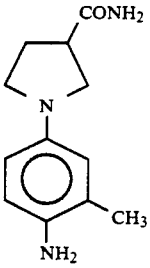
(6)
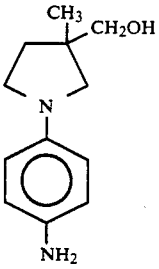
(7)
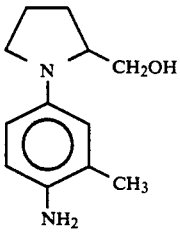
(8)
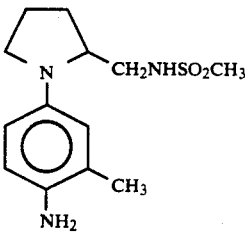
-continued
(9)
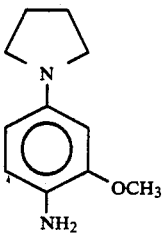
(10)
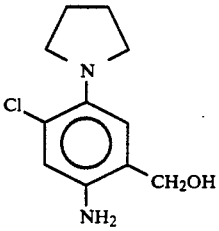
(11)
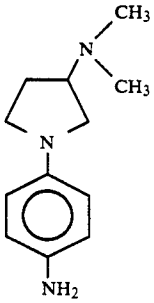
(12)
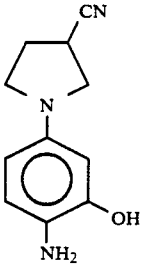
(13)
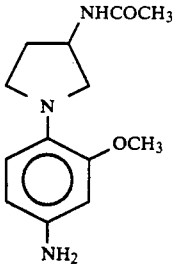
(14)
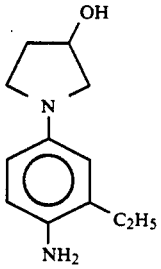

-continued
(15)
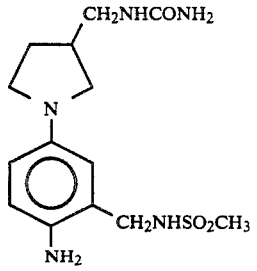
(16)
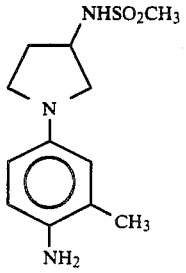
(17)
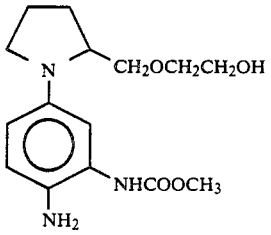
(18)
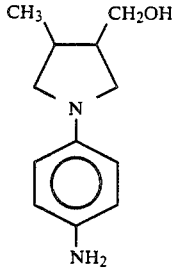
(19)
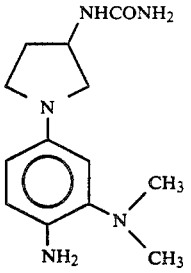
(20)
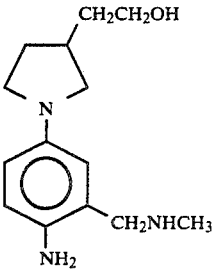
-continued
(21)
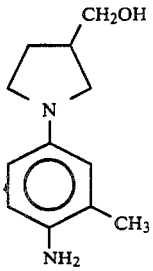
(22)
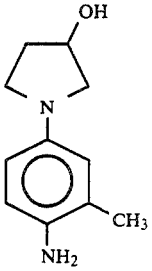
(23)
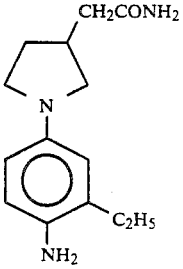
(24)
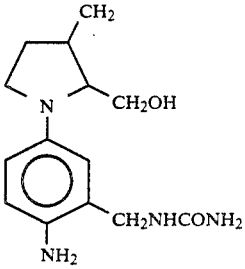
(25)
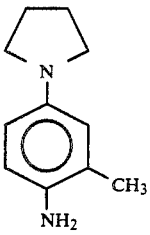
(26)
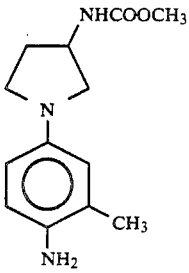

-continued (27)

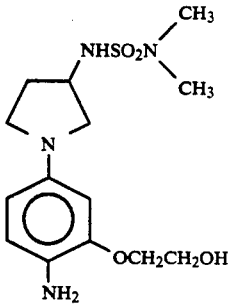

(28)

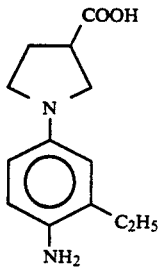

(29)

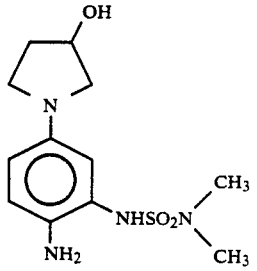

(30)

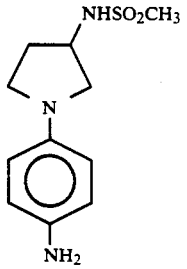

The detailed description will be given on $R^{21}$, $R^{22}$, $R^{23}$, $R^{24}$, n and m of the above general formula [II] of the present invention.

$R^{21}$ is a substituent. In particular, $R^{21}$ is a halogen atom alkyl group, aryl group, heterocyclic group, cyano group, nitro group, hydroxyl group, carboxyl group, alkoxyl group, aryloxy group, acylamino group, amino group, alkylamino group, anilino group, ureido group, sulfamoylamino group, alkylthio group, arylthio group, alkoxycarbonylamino group, sulfonamido group, carbamoyl group, sulfamoyl group, sulfonyl group, alkoxycarbonyl group, heterocyclic oxy group, azo group, acyloxy group, carbamoyloxy group, silyl group, silyloxy group, aryloxycarbonylamino group, imido group, heterocyclic thio group, sulfinyl group, phosphonyl group, aryloxycarbonyl group or acyl group. They can be substituted with an alkyl group, alkenyl group, alkynyl group, aryl group, hydroxyl group, nitro group, cyano group, halogen atom or a substituent containing an oxygen atom, nitrogen atom, sulfur atom or carbon atom.

Examples of the substituents of $R^{21}$ are as follows: the halogen atoms include, for example, fluorine atom and chlorine atom. The alkyl groups are straight, branched or cyclic alkyl groups having 1 to 16 carbon atoms, preferably 1 to 6 carbon atoms, such as methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetamidoethyl, 2-carboxyethyl, 2-carbamoylethyl, 3-carbamoylpropyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2 -carbamoyl-1-methylethyl and 4-nitrobutyl groups.

The aryl groups are those having 6 to 24 carbon atoms such as phenyl, naphthyl and p-methoxyphenyl groups. The heterocyclic groups are 5-membered or 6-membered, saturated or unsaturated heterocyclic rings having 1 to 5 carbon atoms and one or more oxygen, nitrogen or sulfur atoms. The number of the hetero atoms and kind of the element may be one or more. They include, for example, 2-furyl, 2-thienyl, 2-pyrimidinyl, 2-benzotriazolyl, imidazolyl and pyrazolyl groups.

The alkoxy groups are those having 1 to 16 carbon atoms, preferably 1 to 6 carbon atoms such as methoxy, ethoxy, 2-methoxyethoxy and 2-methanesulfonylethoxy groups. The aryloxy groups are those having 6 to 24 carbon atoms such as phenoxy, p-methoxyphenoxy and m-(3-hydroxypropionamido)phenoxy groups. The acylamino groups are those having 1 to 16 carbon atoms, preferably 1 to 6 carbon atoms such as acetamido, 2-methoxypropionamido and p-nitrobenzoylamido groups.

The alkylamino groups are those having 1 to 16 carbon atoms, preferably 1 to 6 carbon atoms such as dimethylamino, diethylamino and 2-hydroxyethylamino groups. The anilino groups are those having 6 to 24 carbon atoms such as anilino, m-nitroanilino and N-methylanilino groups. The ureido groups are those having 1 to 16 carbon atoms, preferably 1 to 6 carbon atoms such as ureido, methylureido, N,N-diethylureido and 2-methanesulfonamidoethylureido groups.

The sulfamoylamino groups are those having 0 to 16 carbon atoms, preferably 0 to 6 carbon atoms, such as dimethylsulfamoylamino, methylsulfamoylamino and 2-methoxyethylsulfamoylamino groups. The alkylthio groups are those having 1 to 16 carbon atoms, preferably 1 to 6 carbon atoms such as methylthio, ethylthio and 2-phenoxyethylthio groups. The arylthio groups are those having 6 to 24 carbon atoms such as phenylthio, 2-carboxyphenylthio and 4-cyanophenylthio groups. The alkoxycarbonylamino groups are those having 2 to 16 carbon atoms, preferably 2 to 6 carbon atoms such as methoxycarbonylamino, ethoxycarbonylamino and 3-methanesulfonylpropoxycarbonylamino groups.

The sulfonamido groups are those having 1 to 16 carbon atoms, Preferably 1 to 6 carbon atoms, such as methanesulfonamido, p-toluenesulfonamido and 2-methoxyethanesulfonamido groups. The carbamoyl groups are those having 1 to 16 carbon atoms, preferably 1 to 6 carbon atoms such as carbamoyl, N,N-dimethylcarbamoyl and N-ethylcarbamoyl groups. The sulfamoyl groups are those having 0 to 16 carbon atoms, preferably 0 to 6 carbon atoms, such as sulfamoyl, dimethylsulfamoyl and ethylsulfamoyl groups.

The sulfonyl groups are aliphatic or aromatic sulfonyl groups having 1 to 16 carbon atoms, preferably 1 to 6 carbon atoms, such as methanesulfonyl, ethanesulfonyl and 2-chloroethanesulfonyl groups. The alkoxycarbonyl groups are those having 1 to 16 carbon atoms, preferably 1 to 6 carbon atoms such as methoxycarbonyl, ethoxycarbonyl and t-butoxycarbonyl groups. The heterocyclic oxy groups are 5-membered or 6-membered, saturated or unsaturated heterocyclic oxy groups having 1 to 5 carbon atoms and one or more oxygen, nitrogen or sulfur atoms. The number of the hetero atoms and kind of the element constituting the ring may be one or more. They include, for example, 1-phenyltetrazolyl-5-oxy, 2-tetrahydropyranyloxy and 2-pyridyloxy groups.

The azo groups are those having 1 to 16 carbon atoms, preferably 1 to 6 carbon atoms, such as phenylazo, 2-hydroxy-4-propanoylphenylazo and 4-sulfophenylazo groups. The acyloxy groups are those having 1 to 16 carbon atoms, preferably 1 to 6 carbon atoms, such as acetoxy, benzoyloxy and 4-hydroxybutanoyloxy groups. The carbamoyloxy groups are those having 1 to 16 carbon atoms, preferably 1 to 6 carbon atoms, such as N,N-dimethylcarbamoyloxy, N-methylcarbamoyloxy and N-phenylcarbamoyloxy groups.

The silyl groups are those having 3 to 16 carbon atoms, preferably 3 to 6 carbon atoms, such as trimethylsilyl, isopropyldiethylsily and t-butyldimethylsilyl groups. The silyloxy groups are those having 3 to 16 carbon atoms, preferably 3 to 6 carbon atoms such as trimethylsilyloxy, triethylsilyloxy and diisopropylethylsilyloxy groups. The aryloxycarbonylamino groups are those having 7 to 24 carbon atoms such as phenoxycarbonylamino, 4-cyanophenoxycarbonylamino and 2,6-dimethoxyphenoxycarbonylamino groups.

The imido groups are those having 4 to 16 carbon atoms such as N-succinimido and N-phthalimido groups. The heterocyclic thio groups are 5-membered or 6-membered, saturated or unsaturated heterocyclic thio groups having 1 to 5 carbon atoms and one or more oxygen, nitrogen or sulfur atoms. The number of the hetero atoms and kind of the element constituting the ring may be one or more. They include, for example, 2-benzothiazolylthio and 2-pyridylthio groups.

The sulfinyl groups are those having 1 to 16 carbon atoms, preferably 1 to 6 carbon atoms, such as methanesulfinyl, benzenesulfinyl and ethanesulfinyl groups. The phosphonyl groups are those having 2 to 16 carbon atoms, preferably 2 to 6 carbon atoms, such as methoxyphosphonyl, ethoxyphosphonyl and phenoxyphosphonyl groups. The aryloxycarbonyl groups are those having 7 to 24 carbon atoms such as phenoxycarbonyl, 2-methylphenoxycarbonyl and 4-acetamidophenoxycarbonyl groups. The acyl groups are those having 1 to 16 carbon atoms, preferably 1 to 6 carbon atoms, such as acetyl, benzoyl and 4-chlorobenzoyl groups.

Among these substituents, $R^{21}$ is preferably an alkyl group, cyano group, hydroxyl group, carboxyl group, alkoxy group, amino group, acylamino group, alkylamino group, ureido group, sulfamoylamino group, alkylthio group, alkoxycarbonylamino group, sulfonamido group, carbamoyl group, sulfamoyl group, sulfonyl group or carbamoyloxy group. $R^{21}$ is still preferably an alkyl group, hydroxyl group, alkoxy group, ureido group, sulfamoylamino group, alkoxycarbonylamino group, sulfonamido group, carbamoyl group or sulfamoyl group. $R_1$ is particularly preferably an alkyl group, hydroxyl group, alkoxy group, sulfamoylamino group, sulfonamido group or sulfamoyl group. The alkyl group is preferably methyl, ethyl, hydroxymethyl, 2-hydroxyethyl, 3-hydroxypropyl, methanesulfonamidomethyl, 2-methanesulfonamidoethyl or 3-hydroxypropyl group.

n represents an integer of 0 to 6 and when n represents a number of 2 or above, $R^{21}$'s may be the same or different from each other. n is preferably an integer of 0 to 4, still preferably 0 to 2 and particularly 0 or 1.

$R^{22}$ and $R^{23}$ each represent a substituted or unsubstituted alkyl group. The substituted or unsubstituted alkyl groups indicate straight, branched or cyclic alkyl groups having 1 to 16 carbon atoms, preferably 1 to 6 carbon atoms, which may be substituted with an alkenyl group, alkynyl group, aryl group, hydroxyl group, nitro group, cyano group, halogen atom or a substituent containing an oxygen atom, nitrogen atom, sulfur atom or carbon atom. Examples of the substituted or unsubstituted alkyl groups include methyl, ethyl, propyl, isopropyl, t-butyl, hydroxymethyl, methanesulfonamidomethyl, methoxymethyl, 2-hydroxyethyl, 3-hydroxypropyl, benzyl, 2-methanesulfonamidoethyl, 2,3-dihydroxymethyl, 3-methanesulfonamidopropyl, 2-methanesulfonylethyl, 2-methoxyethyl, cyclopentyl, sulfamoylmethyl, 2-acetamidoethyl, 2-carboxyethyl, 2-carbamoylethyl, 3 carbamoylpropyl, n-hexyl, 2-hydroxyproyl, methylaminosulfamoylaminomethyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl and 4-nitrobutyl groups. In these $R^{22}$ and $R^{23}$, preferred are unsubstituted alkyl groups, hydroxyalkyl groups, alkoxyalkyl groups, sulfonamidoalkyl groups, sulfamoylalkyl groups and sulfamoylaminoalkyl groups such as methyl, ethyl, hydroxymethyl, methanesulfonamidomethyl, 2-hydroxyethyl, 3-hydroxypropyl, 2,3-dihydroxypropyl, 2-sulfamoylethyl, 2-methoxyethyl and methylaminosulfamoylmethyl groups. The most preferred are unsubstituted alkyl groups, hydroxyalkyl groups, alkoxyalkyl groups and sulfonamidoalkyl groups.

$R^{24}$ represents a substituent which is the same as that described above with reference to $R^{21}$.

$R^{24}$ is preferably an alkyl group, alkoxy group, alkoxycarbonylamino group or ureido group. $R^{24}$ is still preferably an alkyl group or alkoxy group. $R^{24}$ is particularly preferably an alkyl group such as methyl, ethyl, propyl, isopropyl, t-butyl, 2-hydroxyethyl, 3-hydroxypropyl, 2-methanesulfonamidoethyl, 3-methanesulfonamidopropyl, 2-methanesulfonylethyl, 2-methoxyethyl, 2-carbamoylethyl, 3-carbamoylpropyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl or 4-nitrobutyl group. Methyl or ethyl group is particularly preferred.

m represents an integer of 0 to 4 and when m represents a number of 2 or above, $R^{24}$'s may be the same or different from each other and may form a ring. When $R^{24}$'s form a ring, the number of the members of the ring is not particularly limited. However, preferred is a five-membered, six-membered or seven-membered ring.

m is preferably 0 or 1. Still preferably, m is 0 or $R^{24}$ is bonded to the o-position of the primary amino group and m is 1. Among these cases, the most desirable is a case wherein $R^{24}$ is positioned at the o-position of the primary amino group and m is 1.

In the compounds of the general formula [II], particularly preferred are the compounds of the following general formula [II-a]:

general formula [II-a]

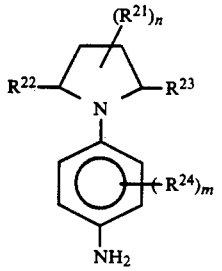

wherein $R^{21}$, $R^{22}$, $R^{23}$, $R^{24}$ and n are as defined above and m represent 0 or 1.

Examples of typical developing agents of the general formula [II] used in the present invention will be given below, which by no means limit the invention.

1-1

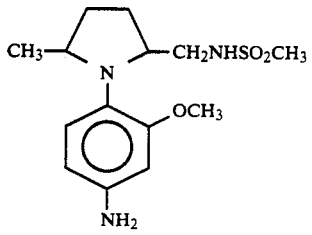

1-2

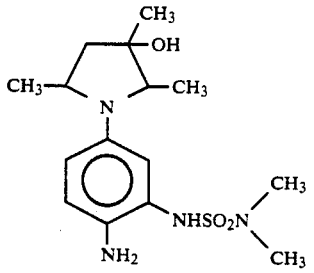

1-3

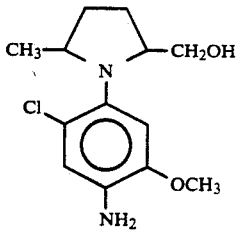

1-4

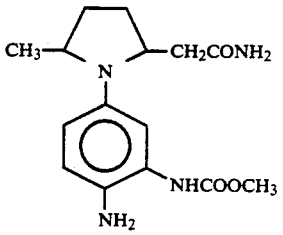

-continued 1-5

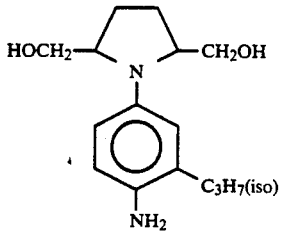

1-6

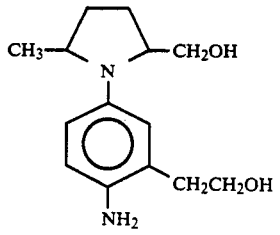

1-7

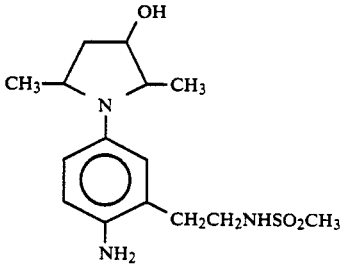

1-8

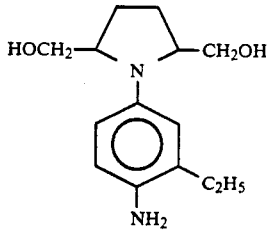

1-9

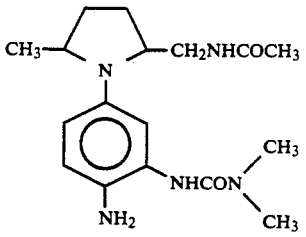

1-10

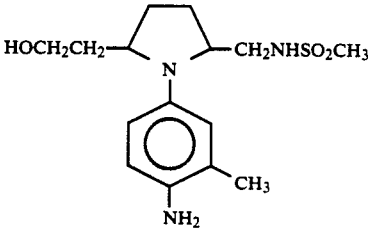

-continued
1-11
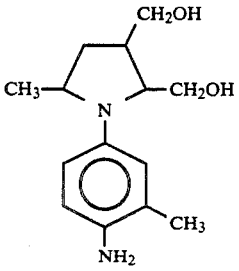
1-12
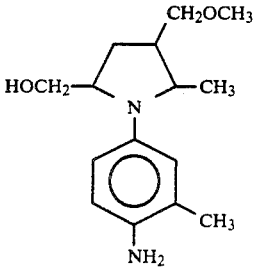
1-13
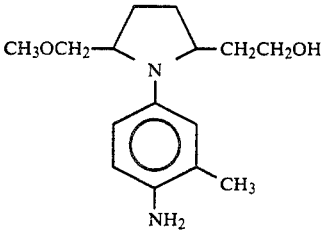
1-14
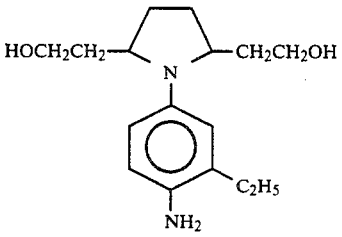
1-15
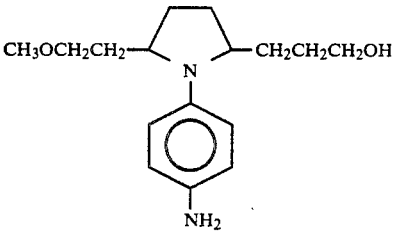
1-16
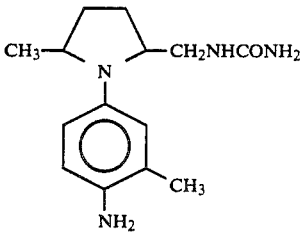
-continued
1-17
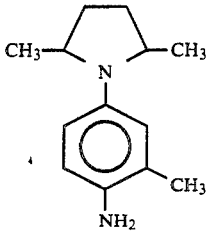
1-18
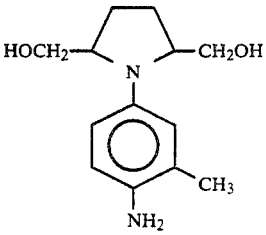
1-19
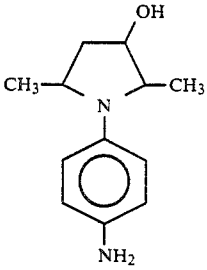
1-20
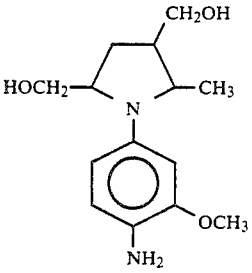
1-21
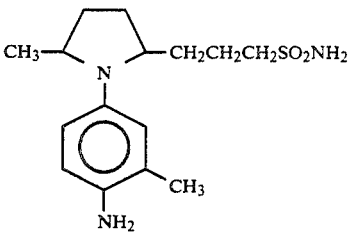
1-22
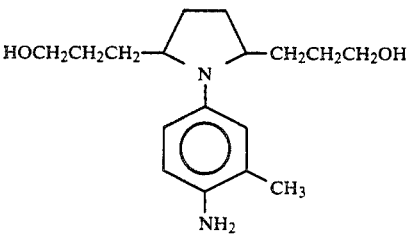

-continued 1-23

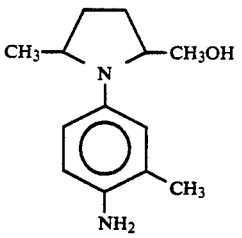

Since the compounds of the above general formula [II] are quite unstable when they are stored in the form of the free amines, they are stored in the form of their salts with an inorganic or organic acid so that they will be converted into the free amines when they are to be added to the processing liquid. Examples of the inorganic and organic acids used for forming the salts of the compounds of the general formula [II] include hydrochloric acid, sulfuric acid, phosphoric acid, p-toluenesulfonic acid, methanesulfonic acid and naphthalene-1,5-disulfonic acid. Among them, the salts of sulfuric acid or p-toluenesulfonic acid are preferred. The most desirable is the sulfates.

The compounds of the general formulae [I] and [II] of the present invention can be usually produced by a process described in Journal of the American Chemical Society, Vol. 73, p. 3100 or processes shown in the following Synthesis Examples and the like:

Synthesis Example 1

[Synthesis of Compound (5)]

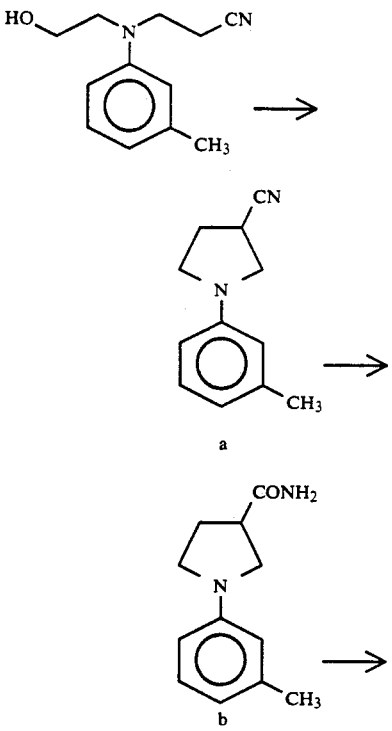

-continued

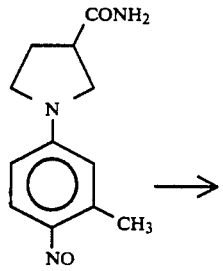

c

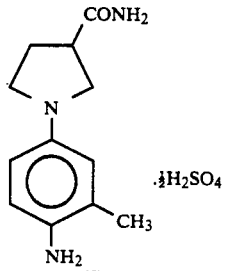

(5)

(1-1) Synthesis of compound a 95.1 g of N-cyanoethyl-N-hydroxyethyl-m-toluidine and 70 ml of triethylamine were added to 500 ml of toluene. 39 ml of methanesulfonyl chloride was added dropwise thereto under stirring and under cooling with ice for 30 min. The stirring was continued at room temperature for additional 30 min. An insoluble matter was filtered off. 58 g of potassium (t)-butoxide was slowly added to the filtrate under stirring. They were stirred at room temperature for a whole day and night. Water was added thereto and a toluene layer thus formed was taken, washed with water, concentrated and distilled under reduced pressure to obtain 45 g of N-(3-methylphenyl)-3-pyrrolidinecarbonitrile (a) as a fraction of 142° to 155° C./2 mmHg in the form of a colorless liquid, which solidified upon leaving to stand.

(1-2) Synthesis of compound b 19.5 g of the solid obtained in the above-described step (1-1) was slowly added to 30 ml of concentrated hydrochloric acid under stirring and under cooling with ice. 1.0 ml of water was added thereto and they were stirred at 50° C. for 1 h and then left to cool. The reaction mixture was poured into ice/water under stirring. An aqueous solution of 35 g of sodium hydroxide was further added thereto and crystals thus formed were taken by filtration, washed with water and recrystallized from methanol to obtain 16 g of N-(3-methylphenyl)-3-pyrrolidinecarboxamide (b) as colorless crystals.

(1-3) Synthesis of compound c 16 ml of concentrated hydrochloric acid and 13.7 g of the crystals obtained in the above-described step (1-2) were dissolved in 60 ml of water. An aqueous solution of 4.6 g of sodium nitrite was added dropwise thereto under stirring and under cooling with ice for about 30 min. After completion of the addition followed by stirring for additional 30 min, an aqueous solution of 8.5 g of sodium hydroxide was added thereto to form crystals. The crystals were taken by filtration, washed with water and recrystallized from methanol/water to obtain 12 g of N-(3-methyl-4-nitrosophenyl)-3-pyrrolidinecarboxamide (c) as green crystals.

(1-4) Synthesis of compound (5)

9.5 g of the crystals Obtained in the above-described step (1-3) and 0.5 g Of 10% palladium carbon were added to 70 ml of ethanol. The mixture was stirred in an autoclave at an inner temperature of 70° C. under hydrogen pressure of 50 kg/cm$^2$ for 3 h. The catalyst was removed by filtration. 1.1 ml of concentrated sulfuric acid was added to the filtrate under stirring. Crystals thus formed were taken by filtration to obtain 8 g of intended compound (5) in the form of its ½ sulfate.

Elementary analysis for $C_{12}H_{18}N_3O_3S_{\frac{1}{2}}$ (%):

| | C | H | N | S |
|---|---|---|---|---|
| Calculated: | 53.72 | 6.76 | 15.66 | 5.97 |
| Found: | 53.45 | 6.50 | 15.56 | 5.81 |

Synthesis Example 2

[Synthesis of compound (7)]

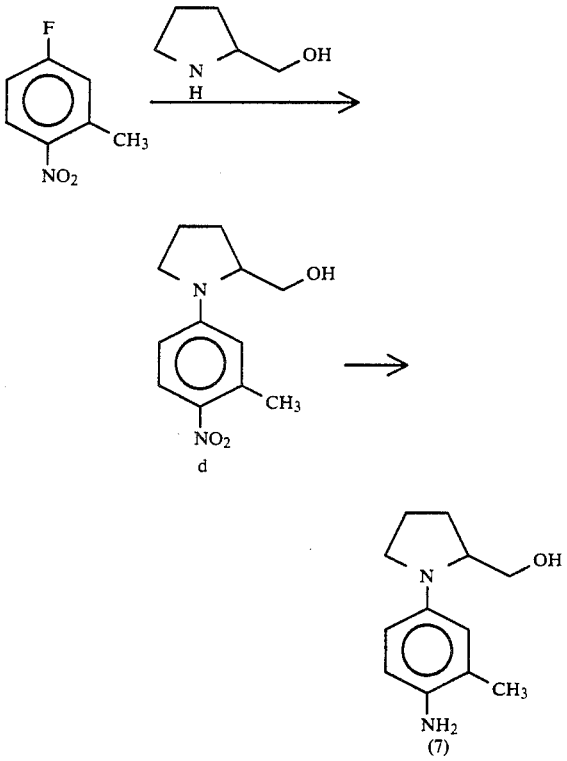

(2-1) Synthesis of compound d 20 g of 5-fluoro-2-nitrotoluene, 14.3 g of 2-pyrrolidine methanol and 20 g of potassium carbonate were added to 100 ml of dimethylformamide. They were stirred at 100° C. for 2 h. After leaving to cool, the reaction mixture was poured into water. After extraction with ethyl acetate, the extract was washed with water, concentrated and recrystallized from acetonitrile to obtain 26 g of 2-hydroxymethyl-N-(3-methyl-4-nitrophenyl)pyrrolidine (d) as yellow crystals.

(2-2) Synthesis of compound (7)

17.7 g of the crystals obtained in the above-described step (2 -1) and 0.9 g of 10% palladium carbon were added to 80 ml of ethanol. The mixture was stirred in an autoclave at an inner temperature of 50° C. under hydrogen pressure of 50 kg/cm$^2$ for 2 h. The catalyst was removed by filtration while it was hot and the filtrate was left to cool to precipitate crystals, which were taken by filtration. Thus 12 g of the intended compound (7) was obtained as light brown crystals.

Elementary analysis for $C_{12}H_{18}N_2O$(%):

| | C | H | N |
|---|---|---|---|
| Calculated: | 69.87 | 8.79 | 13.58 |
| Found: | 69.63 | 8.96 | 13.56 |

A compound (I-17) of the present invention was synthesized according to the following sequence:

[Chemical formula 10]

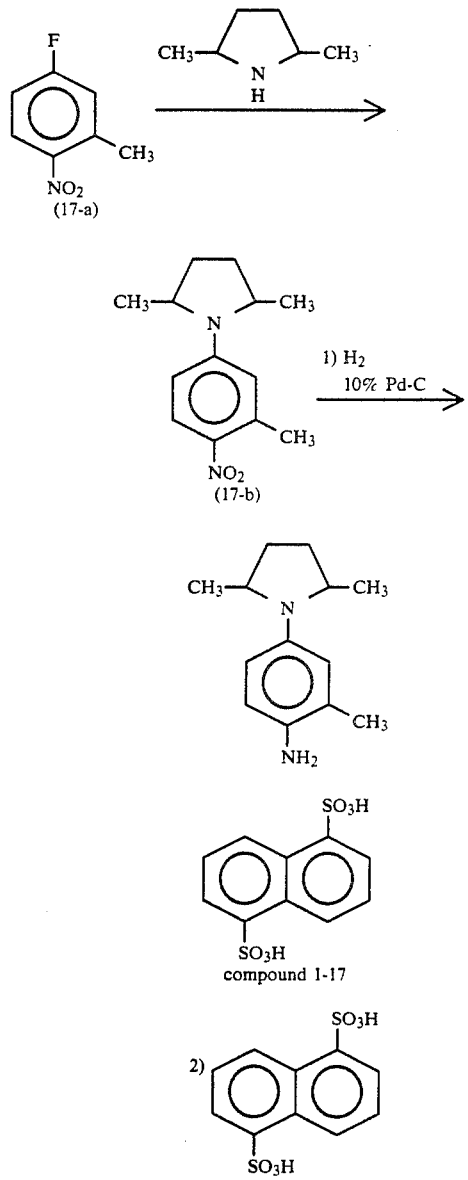

Synthesis of (17-b)

0.80 g of (17-a), 0.51 g of 2,5-dimethylpyrrolidine and 0.78 g of potassium carbonate were added to 3.2 ml of dimethylformamide and they were stirred at 100° for 6 h. Then they were left to cool and poured into water. After extraction with ethyl acetate followed by washing with water, concentration and purification by silica gel column chromatography, 0.70 g of (17-b) was obtained in the form of a yellow oil.

Synthesis of compound (I-17)

0.70 g of (12-b) and 0.01 g of 10% palladium carbon were added to 10 ml of ethanol and they were stirred in an autoclave at an inner temperature of 50° C. under hydrogen pressure of 50 kg/cm$^2$ for 2 h. The catalyst was taken out by filtration and the filtrate was added dropwise to a solution of 1.08 g of 1,5-naphthalenedisulfonic acid tetrahydrate in ethanol. Crystals thus formed were taken by filtration to obtain 1.36 g of 1,5-naphthalenedisulfonate of the intended compound (I-17) in the form of colorless crystals.

Elementary analysis for $C_{23}H_{28}N_2O_6S_2$ (%):

| | C | H | N | S |
|---|---|---|---|---|
| Calculated: | 56.08 | 5.73 | 5.69 | 13.02 |
| Found: | 55.83 | 5.70 | 5.45 | 12.98 |

The processing liquid used in the present invention contains at least one developing agent for silver halide color photographic material according to the present invention. It is preferably an alkaline aqueous solution containing the developing agent as the main ingredient. The developing agent of the present invention can be used solely or in combination with a known black-and-white developing agent such as an aromatic primary amine color developing agent (e.g. CD-3 or CD-4), dihydroxybenzene (e.g. hydroquinone), 3-pyrazolidone (e.g. 1-phenyl-3-pyrazolidone) or aminophenol (e.g. N-methyl-p-aminophenol). The developing agent of the present invention is used in an amount of $2\times10^{31\ 4}$ to $1\times10^{-1}$ mol, preferably $1\times10^{-3}$ mol to $5\times10^{-2}$ mol, per liter of the processing liquid. Alternatively, the amount of the color developing agent of the present invention is preferably 0.1 to 20 g, still preferably 1 to 5 g, per liter of the developer.

The color developer usually contains a pH buffering agent such as an alkali metal carbonate, borate or phosphate; a development restrainer such as a bromide, iodide, benzimidazole, benzothiazole or mercapto compound; a fog inhibitor or the like. If necessary, the color developer may further contain preservatives such as hydroxylamine, diethylhydroxylamine, sulfites, hydrazines, phenylsemicarbazides, triethanolamine, catecholsulfonic acids and triethylenediamine(1,4-diazabicyclo[2,2,2]octane) compounds; organic solvents such as ethylene glycol and diethylene glycol; development accelerators such as benzyl alcohol, polyethylene glycol, quaternary ammonium salts and amines; dye-forming couplers; competing couplers; fogging agents such as sodium boron hydride; assistant developing agents such as 1-phenyl-3-pyrazolidone; thickening agents; chelating agents such as aminopolycarboxylic acids, aminopolyphosphonic acids, alkylphosphonic acids and phosphonocarboxylic acids, e.g. ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di-(o-hydroxyphenylacetic acid) and salts of them.

When a reversal process is employed, usually black-and-white development is conducted and then color development is conducted. The black-and-white developer comprises one or a combination of two or more known black-and-white developing agents such as dihydroxybenzenes (e.g. hydroquinone), 3-pyrazolidones (e.g. 1-phenyl-3-pyrazolidone) and aminophenols (e.g. N-methyl-p-aminophenol).

pH of these color developers or black-and-white developers is usually 9 to 12. The amount of the developer to be replenished varies depending on the color photosensitive material to be processed. It is usually not larger than 3 l per m$^2$ of the photosensitive material. When bromide ion concentration in the replenisher is reduced, the amount of the replenisher can be reduced to 500 ml or less. When the amount of the replenisher is reduced, the evaporation of the liquid and oxidation thereof with air are preferably inhibited by reducing the contact area of the processing vessel with air. The amount of the replenished can be reduced also by inhibiting accumulation of bromide ion in the developer. It is preferable that the development be conducted at a temperature of 35° to 50° C. for 10 sec to 2 minutes.

After completion of the color development, the photographic emulsion layer is usually bleached. The bleaching process can be conducted simultaneously with the fixing process (bleach-fixing process) or separately from it. For acceleration, the bleach-fixing process may be conducted after the bleaching process. Depending on the purpose, two bleach fixing baths connected with each other can be employed; the fixing process can be conducted prior to the bleach-fixing process; or the bleaching process can be conducted after the bleach-fixing process. Examples of the bleaching agents include compounds of polyvalent metals such as iron (III), cobalt (III), chromium (IV) and copper (II); peracids, quinones and nitro compounds. Typical examples of the bleaching agents include ferricyanides; bichromates; organic complex salts of iron (III) or cobalt (III) such as aminopolycarboxylates, e.g. ethylenediaminetetraacetate, diethylenetriaminepentaacetate, cyclohexanediaminetetraacetate, methyliminodiacetate, 1,3-diaminopropanetetraacetate and glycol ether diaminetetraacetate and complex salts thereof with citric acid, tartaric acid or malic acids; persulfates; bromates; permanganates; and nitrobenzenes. Among them, iron (III) complex salts of aminopolycarboxylic acids such as iron (III) salt of ethylenediaminetetraacetic acid and persulfates are preferred from the viewpoints of the rapid process and prevention of environmental Pollution. The iron (III) complex salts of aminopolycarboxylic acids are particularly effective in both bleaching solution and bleach-fixing solution. The pH of the bleaching solution or bleach-fixing solution containing such an iron (III) complex salt of aminopolycarboxylic acid is usually 5.5 to 8. For acceleration of the process, a lower pH can also be employed.

The bleaching solution, bleach-fixing solution, pre-bleaching bath and pre-bleach-fixing bath may contain a bleaching accelerator, if necessary. Examples of the bleaching accelerators include compounds having a mercapto group or disulfide bond described in U.S. Pat. No. 3,893,858, West German Patent No. 1,290,812 and Research Disclosure No. 17,129 (July, 1978); thiazolidine derivatives described in J.P. KOKAI No. 50-140,129; thiourea derivatives described in U.S. Pat. No. 3,706,561; chloroiodides described in J.P. KOKAI No. 58-16,235; polyoxyethylene compounds described in west German Patent No. 2,748,430; polyamine compounds described in J.P. KOKOKUNo. 45-8836; and bromide ions. Among them, the compounds having a mercapto group or disulfido group are preferred, since they have a remarkable acceleration effect. In this respect, compounds described in U.S. Pat. No. 3,893,858, West German Patent No. 1,290,812 and J.P. KOKAI No. 53-95,630 are particularly preferred. Further compounds described in U.S. Pat. No. 4,552,834 are also preferred. These bleach-accelerators may be added to the photosensitive material. When a color photosensitive material for taking pictures is to be bleach-fixed, these bleaching accelerators are particularly effective.

The fixing agents include, for example, thiosulfates, thiocyanates, thioether compounds, thioureas and a large amount of iodides. Among them, the thiosulfates are commonly used and ammonium thiosulfate is most widely usable. Preferred examples of the preservatives for the bleach-fixing solutions include sulfites, hydrogensulfites, sulfinates and carbonylhydrogensulfite adducts.

The color photosensitive(photographic) silver halide material used in the present invention is usually subjected to washing with water and/or stabilization step after desilverization. The amount of water used in the washing step varies in a wide range depending on the properties of the photosensitive material (such as couplers used), temperature of water used for washing, number of the tanks used for washing with water (number of stages), replenishing method such as counter flow or parallel flow system and various other conditions. Among them, the relationship between the number of the tanks for washing with water and the amount of water can be determined by a method described in 'Journal of the Society of Motion Picture and Television Engineers', Vol. 64, pages 248 to 253 (May, 1955).

Although the amount of water necessitated for washing can be remarkably reduced by the multi stage counter flow system described in the above-described journal, another problem is posed in this method that bacteria propagate themselves while the photosensitive material is kept for a longer time in the tanks and, as a result, a suspended matter thus formed is fixed on the sensitive material. For solving this problem in the processing of the color photosensitive material of the present invention, a quite effective method for reducing in amount of calcium ion and magnesium ion described in J.P. KOKAI No. 62-288838(U.S. Ser. No. 057,254 filed on Jun. 3, 1987) can be employed. Further this problem can be solved also by using isothiazolone compounds described in J.P. KOKAI No. 57-8,542, thiabendazoles, chlorine-containing germicides such as sodium chlorinated isocyanurates, benzotriazoles and germicides described in Hiroshi Horiguchi 'Bokin Bobai-zai no Kagaku', 'Biseibutsu no Mekkin, Sakkin, Bobai Gijutsu' edited by Eisei Gijutsu-kai and 'Bokinbobai-zai Jiten' edited by Nippon Bokinbobai Gakkai.

The pH of water used for washing the photosensitive material of the present invention is 4 to 9, preferably 5 to 8. The temperature of water to be used for washing and the washing time which may vary depending on the properties and use of the photosensitive material are usually 14° to 45° C. and 20 sec to 10 min, respectively, and preferably 25° to 40° C. and 30 sec to 5 min. The photosensitive material usable in the present invention can be processed directly with a stabilizing solution in place of washing with water. The stabilization can be conducted by any of known processes described in J.P. KOKAI Nos. 57-8,543, 58-14,834 and 60-220,345.

The washing process with water may be followed by a stabilization process. In the stabilization, there can be used a stabilizing bath containing formalin and a surfactant which is usually used as the final bath for a color photographing photosensitive material for taking pictures. The stabilizing bath may also contain chelating agents and mold-proofing agents.

An overflow obtained by washing with water or replenishing the stabilizing solution can be used again in another step such as desilverization step.

The color photosensitive silver halide material used in the present invention may contain a color developing agent for the purpose of simplifying and accelerating the process. The color developing agents are preferably used in the form of precursors thereof. Examples of them include indoaniline compounds described in U.S. Pat. No. 3,342,597, Schiff base compounds disclosed in U.S. Pat. No. 3,342,599, Research Disclosure Nos. 14,850 and 15,159, aldol compounds described in Research Disclosure No. 13,924, metal salt complexes described in U.S. Pat. No. 3,719,492 and urethane compounds described in J.P. KOKAI No. 53-135,628.

The silver halide color photosensitive material usable in the present invention may contain a 1-phenyl-3-pyrazolidone compound, if necessary, for the purpose of accelerating the color development. Typical examples of the compounds are described in J.P. KOKAI Nos. 56-64,339, 57-14,4547 and 58-115,438.

The temperature of the processing solutions used in the present invention are controlled at 10° to 50° C. The standard temperature is 33° to 68° C., but a higher temperature can be employed to accelerate the process and thereby to reduce the process time or, on the contrary, a lower temperature can also be employed to improve the quality of the image and stability of the processing liquid. In the second aspect of the present invention, the temperature of the developer in the process is 20° to 50° C., preferably 30° to 45° C. To save silver in the photosensitive material, intensification with cobalt or hydrogen peroxide as described in West German Patent No. 2,226,770 and U.S. Pat. No. 3,674,499 can be employed.

The present invention can be applied to any method wherein a color developer is used such as methods for processing a color paper, reversal color paper, positive color film, negative color film, reversal color film and direct positive color photosensitive material.

The silver halide emulsion for forming the photosensitive material used in the present invention may comprise any halogen composition such as silver bromoiodide, silver bromide, silver chlorobromide or silver chloride.

In the rapid process or when the amount of the replenisher is to be reduced, a silver chlorobromide emulsion or silver chloride emulsion containing at least 60 molar % of silver chloride is preferably used. The emulsion containing 80 to 100 molar % of silver chloride is more preferred and that containing 90 to 99.9 molar % is most preferred. When a high sensitivity is necessitated or when the fogging should be strictly inhibited in the course of the production, storage and/or process, a silver chlorobromide emulsion or silver bromide emulsion containing at least 50 molar % of silver bromide is preferably used and that containing at least 70 molar % thereof is more preferably used. Although the rapid process becomes difficult when silver bromide content is increased to 90 molar % or above, the development can be accelerated to some extent irrespective of the silver bromide content by using a development accelerator such as a silver halide solution, fogging agent or developing agent in the process. This technique is sometimes preferred. In both cases, use of silver iodide in a large amount is undesirable. The amount of silver iodide should be not more than 3 molar %. Such a silver halide emulsion is preferably used mainly for photosensitive materials for printing such as color papers.

The silver halides to be contained in the color photographic photosensitive materials for taking pictures(negative films and reversal films) are preferably silver bromoiodide and silver chlorobromoiodide. In this respect, silver iodide content is preferably 3 to 15 molar %.

The silver halide grains used in the present invention may comprise a core and a surface layer (core/shell grains) or a homogeneous phase or it may have a polyphase structure (conjugated structure) or, alternatively, the grains may comprise a combination of them.

The average size of the silver halide grains (in terms of grain diameter when the grains are spherical or nearly spherical, or edge length when the grains are cubic, and they are given in terms of average based on the projection area) (the average size of tabular grains is given in terms of that of the spherical grains) used in the present invention is preferably 0.1 to 2 μm, particularly preferably 0.15 to 0.5 μm. The grain size distribution is either narrow or wide. The coefficient of variation calculated by dividing the standard deviation in the grain size distribution curve of the silver halide emulsion by the average grain size is preferably not higher than 20%, more preferably not higher than 15% and particularly preferably not higher than 10% (so-called monodisperse silver halide emulsion in the present invention). To satisfy an intended gradation, a layer may comprise a mixture of two or more monodisperse silver halide emulsions (preferably having the above-described coefficient of variation) having different grain sizes or the emulsions may be used for forming respective laminated layers having substantially the same color sensitivity. Further a combination of two or more polydisperse silver halide emulsions or a combination of a monodisperse emulsion with a polydisperse emulsion can be used in the form of a mixture or by forming a laminated layers thereof.

The silver halide grains used in the present invention may be in a regular crystal form such as cubic, octahedral, rhombo-dodecahedral or tetradecahedral form or a mixture of them; or an irregular crystal form such as spherical form; or a complex crystal form thereof. They may also be tabular grains. Particularly an emulsion wherein at least 50% of the total projection area of the grains comprise tabular grains having a length/thickness ratio of at least 5, particularly at least 8 is usable. The emulsion may comprise a mixture of grains having various crystal forms. The emulsion may be of a surface-latent-image type for forming a latent image mainly on the surfaces thereof or of an internal latent-image type for forming a latent image in the grains.

The photographic emulsions usable in the present invention can be produced by a method disclosed in Research Disclosure (RD), Vol. 76, Item No. 17643, (Paragraphs I,II and III) (December, 1978).

The silver halide emulsion to be used in the present invention is usually physically and chemically ripened and spectrally sensitized. The additives to be used in these steps are shown in Research Disclosure Nos. 17643f and 18716. The portions in which the additives are mentioned in these two Research Disclosure's are summarized in the following table.

Known photographic additives are also mentioned in the two Research Disclosures and the corresponding portions are also shown in the following Table.

| Additive | RD 17643 | RD 18716 |
|---|---|---|
| 1 Chemical sensitizer | p. 23 | right column, p. 648 |
| 2 Sensitivity improver | " | right column, p. 648 |
| 3 Spectral sensitizer | pp. 23 to 24 | right column, p. 648 to left column, p. 649 |
| 4 Supersensitizer | " | |
| 5 Brightening agent | p. 24 | |
| 6 Antifoggant and stabilizer | pp. 24 to 25 | right column, p. 649 |
| 7 Coupler | p. 25 | " |
| 8 Organic solvent | p. 25 | " |
| 9 Light absorber and filter dye | pp. 25 to 26 | right column, p. 649 to left column, p. 650 |
| 10 U.V. absorber | " | right column, p. 649 to left column, p. 650 |
| 11 Antistaining agent | right column, p. 25 | left and right columns, p. 650 |
| 12 Dye image stabilizer | p. 25 | left and right columns, p. 650 |
| 13 Hardener | p. 26 | left column, p. 651 |
| 14 Binder | p. 26 | left column, p. 651 |
| 15 Plasticizer and lubricant | p. 27 | right column, p. 650 |
| 16 Coating aid and surfactant | pp. 26-27 | right column, p. 650 |
| 17 Antistatic agent | p. 27 | right column, p. 650 |

Various color couplers can be used in the present invention. The color couplers herein indicate compounds capable of coupling with an oxidation product of an aromatic primary amine developing agent to form a dye. Typical examples of the useful color couplers include naphthol or phenol compounds, pyrazolone or pyrazoloazole compounds and open chain or heterocyclic ketomethylene compounds. Examples of these cyan, magenta and yellow couplers usable in the present invention are described in patents cited in Research Disclosure (RD) 17643 (December, 1978) VII D and 18717 (November, 1979).

The color couplers contained in the photosensitive material preferably has a ballast group or they are made nondiffusible by polymerization. When a divalent color couplers wherein the active coupling portions are substituted with a coupling-off group are used, the amount of silver to be coated is smaller than that required when a tetravalent color coupler having hydrogen atoms at the active coupling portions is used. Couplers capable of forming a colored compound having suitable diffusing properties, colorless compound-forming couplers, DIR couplers capable of releasing a development inhibitor by coupling reaction or couplers capable of releasing a development accelerator are also usable.

Typical examples of the yellow couplers usable in the present invention include oil protection type acylacetamide couplers such as those described in U.S. Pat. Nos. 2,407,210, 2,875,057 and 3,265,506. Divalent yellow couplers are preferably used in the present invention. Typical examples of them include yellow couplers of oxygen-linked coupling-off type such as those disclosed in U.S. Pat. Nos. 3,408,194, 3,447,928, 3,933,501 and 4,022,620, and yellow couplers of nitrogen-linked coupling-off type such as those disclosed in J.P. KOKOKU No. 55-10739, U.S. Pat. Nos. 4,401,752, and 4,326,024, RD 18053 (April, 1979), British Patent No. 1,425,020, and West German Public Disclosure Nos. 2,219,917, 2,261,361, 2,329,587 and 2,433,812. α-Pivaloylacetanilide couplers provide excellent fastness, particularly light fastness, of the developed dye and, on the other hand, α-benzoylacetaniline couplers provide a high developed color density.

The magenta couplers usable in the present invention include oil-protection type indazolone or cyanoacetyl couplers, preferably 5-pyrazolone and pyrazoloazole couplers such as pyrazolotriazoles. Among the 5-pyrazolone couplers, those having an arylamino group or an acylamino group at 3-position are preferred in view of the hue of the developed color and the developed color density. Typical examples of them are mentioned in U.S. Pat. Nos. 2,311,082, 2,343,703, 2,600,788, 2,908,573, 3,062,653, 3,152,896 and 3,936,015. Nitrogen-linked coupling off groups described in U.S. Pat. No. 4,310,619, and arylthio groups mentioned in U.S. Pat. No. 4,351,897 are particularly preferred as the releasing group of the 2-equivalent 5-pyrazolone couplers. 5-Pyrazolone couplers having a ballast group mentioned in European Patent No. 73,636 provide a high developed color density.

Examples of the pyrazoloazole couplers include pyrazolobenzimidazoles described in U.S. Pat. No. 3,369,879, preferably pyrazolo [5,1-c][1,2,4]triazoles described in U.S. Pat. No. 3,725,067, pyurazolotetrazoles described in Research Disclosure 24220 (June, 1984) and pyrazolopyrazoles described in Research Disclosure 24230 (June, 1984). Imidazo[1,2-b]pyrazoles described in European Patent No. 119,741 are preferred because of low yellow subabsorption and light fastness of the developed dye, and pyrazolo[1,5-b][1,2,4]triazole described in European Patent No. 119,860 is particularly preferred.

The cyan couplers usable in the present invention include oil-protection-type naphthol and phenol couplers. Examples of them include naphthol couplers described in U.S. Pat. No. 2,474,293, preferably oxygen-linked coupling-off type 2-equivalent naphthol couplers described in U.S. Pat. Nos. 4,052,212, 4,146,396, 4,228,233 and 4,296,200. Examples of the phenol couplers are described in U.S. Pat. Nos. 2,369,929, 2,801,171, 2,772,162 and 2,895,826. The cyan couplers stable to moisture and temperature are preferably used in the present invention. Typical examples of them include phenolic cyan couplers having an alkyl group not lower than ethyl group inclusive at m-position of the phenol nucleus as described in U.S. Pat. No. 3,772,002; 2,5-diacylamino substituted phenol couplers as described in U.S. Pat. Nos. 2,772,162, 3,758,308, 4,126,396, 4,334,011 and 4,327,173, West German Patent Public Disclosure No. 3,329,729 and J.P. KOKAI No. 59-166956; and phenol couplers having a phenylureido group at 2-position and an acylamino group at 5-position as described in U.S. Pat. Nos. 3,446,622, 4,333,999, 4,451,559 and 4,427,767.

The graininess can be improved by using an additional coupler to provide colored dye which is suitably diffusible. Examples of such couplers include magenta couplers described in U.S. Pat. No. 4,366,237 and British Patent No. 2,125,570; and yellow, magenta and cyan couplers described in European Patent No. 96,570 and West German Public Disclosure No. 3,234,533.

The dye-forming couplers and the above-mentioned special couplers may form a dimer or a higher polymer. Typical examples of the polymerized dye-forming couplers are described in U.S. Pat. Nos. 3,451,820 and 4,080,211. Examples of the polymerized magenta couplers are described in British Patent No. 2,102,173 and U.S. Pat. No. 4,367,282.

Two or more kinds of the couplers usable in the present invention can be contained in the same photosensitive layer or the same compound can be contained in two or more layers in order to obtain the necessary properties of the photosensitive material.

The couplers usable in the present invention can be introduced into the photosensitive material by various known dispersion methods. Examples of high-boiling organic solvents usable in an oil-in-water dispersion method are described in, for example, U.S. Pat. No. 2,322,027. The steps and effects of latex dispersion method (a polymer dispersion method) and examples of the latices usable for the impregnation are described in U.S. Pat. No. 4,199,363, and West German Patent Application (OLS) Nos. 2,541,274 and 2,541,230. A dispersion method wherein an organic solvent-soluble polymer is used is described in PCT Application No. JP 87/00492.

Examples of the organic solvents usable in the oil-in-water dispersion method include alkyl phthalates (such as dibutyl phthalate and dioctyl phthalate), phosphoric esters (such as diphenyl phosphate, triphenyl phosphate, tricresyl phosphate and dioctylbutyl phosphate), citric esters (such as tributyl acetylcitrate), benzoic esters (such as octyl benzoate), alkylamides (such as diethyllaurylamide), fatty acid esters (such as dibutoxyethyl succinate and diethyl azelate), trimesic esters (such as tributyl trimesate); those having a boiling point of about 30° to 150° C. such as lower alkyl acetates (e.g. ethyl acetate and butyl acetate), ethyl propionate, sec-butyl alcohol, methyl isobutyl ketone, β-ethoxyethyl acetate and methyl cellosolve acetate.

The standard amount of the color coupler ranges from 0.001 to 1 mol per mol of the photosensitive silver halide. Preferably the yellow coupler is used in an amount of 0.01 to 0.5 mol, magenta coupler is used in an amount of 0.003 to 0.3 mol and cyan coupler is used in an amount of 0.002 to 0.3 mol.

The photographic photosensitive material used in the present invention is applied to an ordinary flexible support such as a plastic film (e.g. cellulose nitrate, cellulose acetate or polyethylene terephthalate film) or paper; or a rigid support such as a glass support. The details of the supports and coating methods are described in Research Disclosure No. 176, Item 17643XV (p. 27) and XVII (p. 28) (December, 1978).

The use of a reflecting support is preferred in the present invention. The term "reflecting support" herein indicates a support having an improved reflectivity so as to form a clear dye image in the silver halide emulsion layer. The reflecting supports are produced by coating the support with a dispersion of a light-reflecting substance such as titanium oxide, zinc oxide, calcium carbonate or calcium sulfate in a hydrophobic resin. Further supports made of a hydrophobic resin containing such a light-reflecting substance dispersed therein are also usable. (Examples)

The following Examples will further illustrate the present invention, which by no means limit the invention.

EXAMPLE 1

A multi-layered color photographic paper having the following layer construction formed on a paper support the both surfaces of which had been laminated with polyethylene was prepared. The coating solutions were prepared as follows:

Preparation of coating solution for forming the first layer 27.2 ml of ethyl acetate and 8.2 g of a solvent (Solv-1) were added to a mixture of I9.1 g of yellow coupler (ExY), 4.4 g of a color image stabilizer (cpd-1) and 0.7 g of another color image stabilizer (Cpd-7) to prepare a solution, which was emulsion-dispersed in 185 ml of 10% aqueous gelatin solution containing 8 ml of 10% sodium dodecylbenzenesulfonate. On the other hand, $2.0\times10^{-4}$ mol (large size emulsion) or $2.5\times10^{-4}$ mol (small size emulsion), per mol of silver, of a blue sensitive sensitizing dye which will be described below was added to a silver chlorobromide emulsion [mixture of cubic grains having an average grain size of 0.88 μm and those of 0.70 μm in a molar ratio of 3:7 (in terms of silver); coefficient of variation of grain size distribution: 0.08 and 0.10, respectively; and each containing 0.2 molar % of silver halide in the grain surface layer). They were sensitized with sulfur. This emulsion was mixed with the emulsion dispersion prepared as described above to form a solution in such that the first coating solution having a composition which will be given below was prepared.

Coating solutions for forming the second layer through the seventh layer were prepared in the same manner as that for forming the first coating solution. Sodium salt of 1-oxy-3,5-dichloro-s-triazine was used as the gelatin hardener in each layer.

The following spectral sensitizing dyes were used in the respective layers:

Blue-sensitive emulsion layer:

-continued

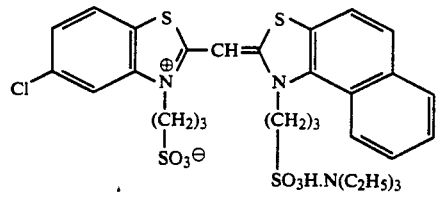

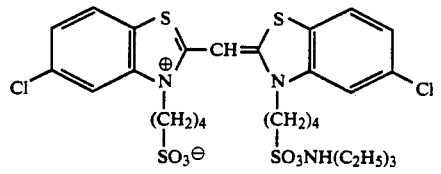

($2.0\times10^{-4}$ mol, per mol of the silver halide, for the large-size grain emulsion and $2.5\times10^{-4}$ mol for the small-sized grain emulsion)

Green-sensitive emulsion layer:

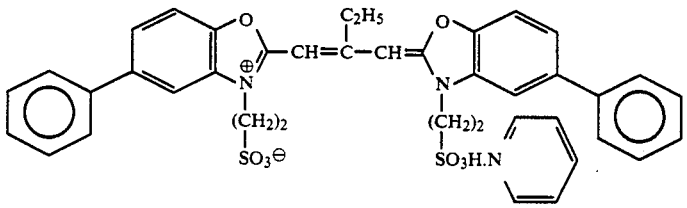

($4.0\times10^{-4}$ mol, per mol of the silver halide, for the large-size grain emulsion and $5.6\times10^{-4}$ mol for the small-size grain emulsion) and

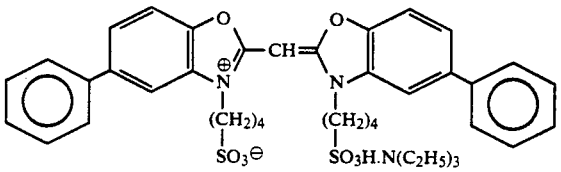

($7.0\times10^{-5}$ mol, per mol of the silver halide, for the large-size grain emulsion and $1.0\times10^{-5}$ mol for the small-size grain emulsion)

Red-sensitive emulsion layer:

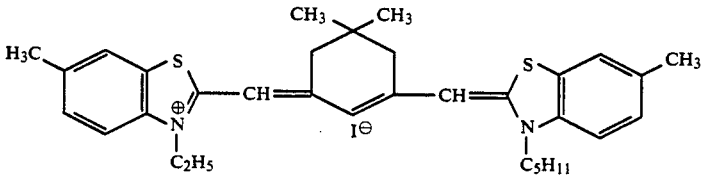

($0.9\times10^{-4}$ mol, per mol of the silver halide, for the large-size grain emulsion and $1.1\times10^{-4}$ mol for the small-size grain emulsion)

$2.6\times10^{-3}$ mol, per mol of the silver halide, of the following compound was incorporated into the red-sensitive emulsion layer:

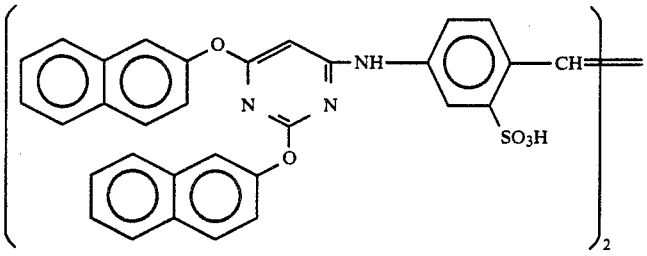

$8.5\times10^{-5}$ mol, $7.7\times10^{-4}$ mol and $2.5\times10^{-4}$ mol, per mol of the silver halide, of 1-(5-methylureidophenyl)-5-mercaptotetrazole was incorporated into the blue-sensitive emulsion layer, green-sensitive emulsion layer and red-sensitive emulsion layer, respectively.

$1\times10^{-4}$ mol and $2\times10^{-4}$ mol, per mol of the silver halide, of 4-hydroxy-6-methyl-1,3,3a,7-tetrazaindene was incorporated into the blue-sensitive emulsion layer and green-sensitive emulsion layer, respectively.

The following dyes were incorporated into the emulsion layers in order to prevent irradiation:

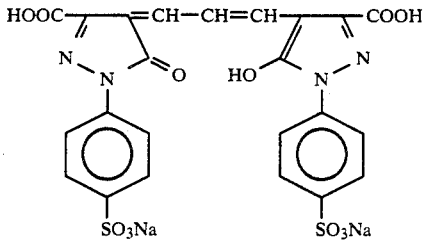

and

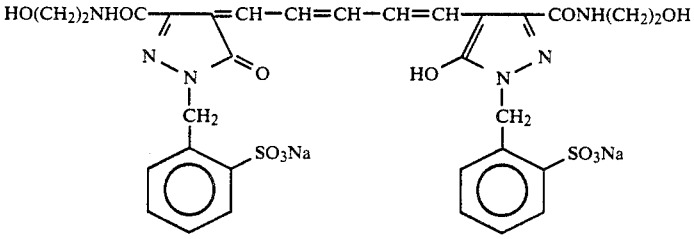

(Layer construction)

The compositions of the respective layers will be shown below. The numerals represent the amounts ($g/m^2$) of the components used for forming the layers. The amount of the silver halide emulsion is given in terms of silver used for forming the layer.

| | |
|---|---|
| Support: | |
| Polyethylene-laminated paper [containing a white dye ($TiO_2$) and a blue dye (ultramarine) in the polyethylene layer on the first layer side] | |
| The first layer (blue-sensitive layer): | |
| Above-described silver bromide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| The second layer (color mixing-inhibition layer) | |
| Gelatin | 0.99 |
| Color mixing inhibitor (Cpd-5) | 0.08 |
| Solvent (Solv-1) | 0.16 |
| Solvent (Solv-4) | 0.08 |

-continued

| | |
|---|---|
| The third layer (green-sensitive layer) | |
| Silver chlorobromide emulsion [mixture of cubic grains having average grain size of 0.55 μm and those of 0.39 μm in a molar ratio of 1:3 (in terms of Ag); Coefficient of variation of grain size distribution being 0.10 and 0.08; 0.8 molar % of AgBr being contained in the surface layer of the grains in each emulsion] | 0.12 |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| The fourth layer (ultraviolet ray-absorbing layer) | |
| Gelatin | 1.58 |
| Ultraviolet ray-absorbing agent (UV-1) | 0.47 |
| Color mixing-inhibiting agent (Cpd-5) | 0.05 |
| Solvent (Solv-5) | 0.24 |
| The fifth layer (red-sensitive layer) | |
| Silver chlorobromide emulsion [mixture of cubic grains having average grain size of 0.58 μm and those of 0.45 μm in a molar ratio of 1:4 (in terms of Ag); Coefficient of variation of grain size distribution being 0.09 and 0.11; 0.6 molar % of AgBr being contained in a part of the surface layer of the grains in each emulsion] | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| The sixth layer (ultraviolet ray-absorbing layer) | |
| Gelatin | 0.53 |
| Ultraviolet ray-absorbing agent (UV-1) | 0.16 |

-continued

| | |
|---|---|
| Color mixing-inhibitor (Cpd-5) | 0.02 |
| Solvent (Solv-5) | 0.08 |
| The seventh layer (protecting layer) | |
| Gelatin | 1.33 |
| Acryl-modified copolymer of polyvinyl alcohol (degree of modification; 17%) | 0.17 |
| Liquid paraffin | 0.03 |

(ExY) Yellow coupler

Mixture of compounds of the following formula:

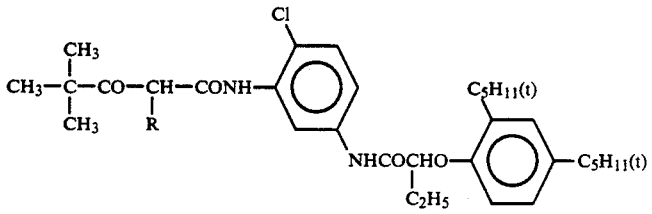

wherein R represents

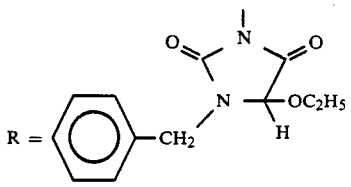

and

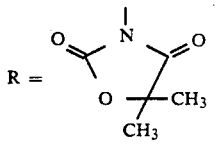

in the molar ratio of 1:1

(ExM) Magenta coupler

Mixture of compounds of the following formula:

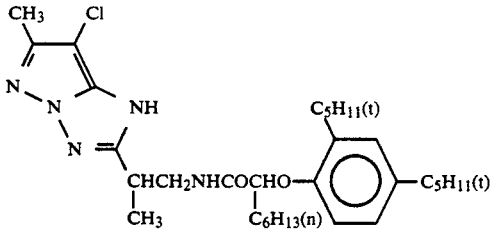

-continued and

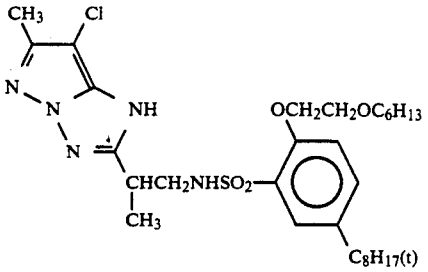

in a molar ratio of 1:1.

(ExC) Cyan coupler

Mixture of compounds of the following formulae:

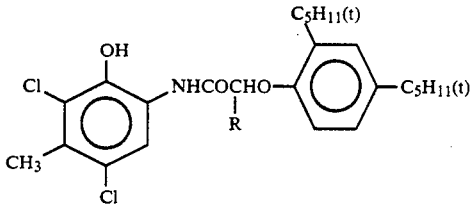

wherein R is $C_2H_5$ and $C_4H_9$ and

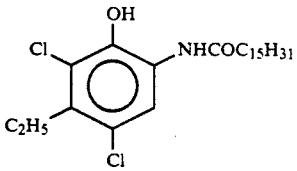

in a weight ratio of 2:4:4.

(Cpd-1) Color image stabilizer:

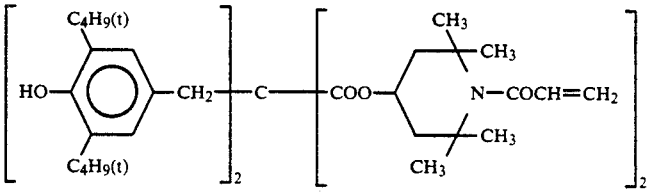

(Cpd-2) Color image stabilizer:

-continued
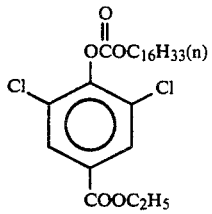
(Cpd-3) Color image stabilizer:
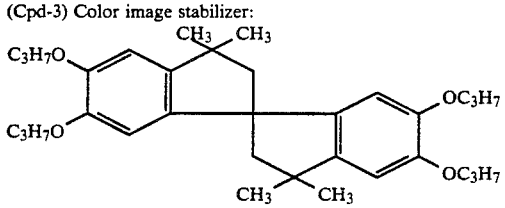
(Cpd-4) Color image stabilizer:
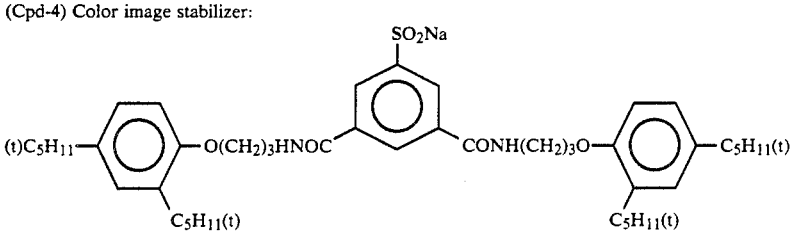
(Cpd-5) Color-mixing inhibitor:
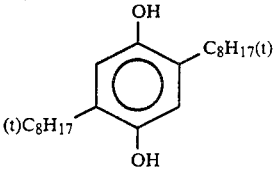
(Cpd-6) Color-mixing stabilizer:
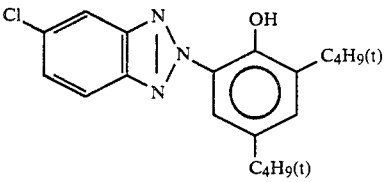
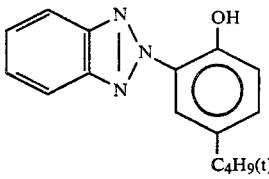
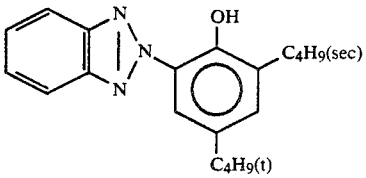
in a weight ratio of 2:4:4.
(Cpd-7) Color image stabilizer:
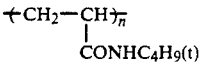
average molecular weight: 60,000

-continued
(Cpd-8) Color image stabilizer:
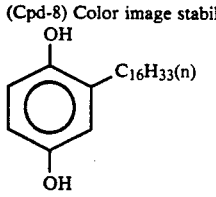
(Cpd-9) Color image stabilizer:
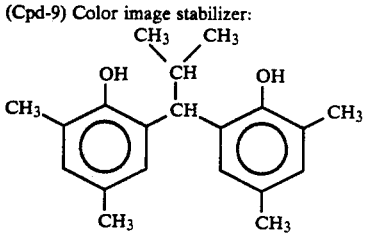
(UV-1) Ultraviolet ray-absorbing agent:
Mixture of compounds of the following formulae:
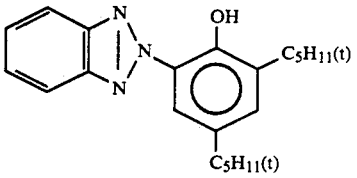
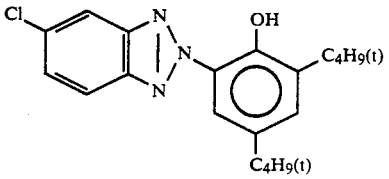
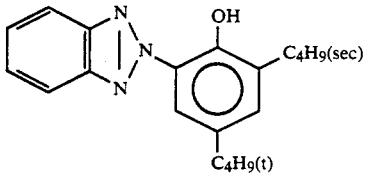
in a weight ratio of 4:2:4.
(Solv-1) Solvent:
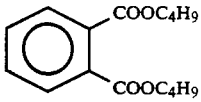
(Solv-2) Solvent:
Mixture of compounds of the following formulae:
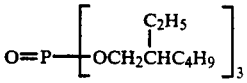
and
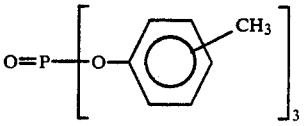
in a volume ratio of 2:1.
(Solv-3) Solvent:
$O{=}P{+}O{-}C_9H_{19}(iso)]_3$ -continued (Solv-4) Solvent:

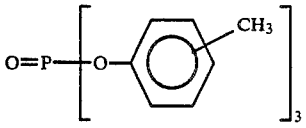

(Solv-5) Solvent:

$COOC_8H_{17}$
|
$(CH_2)_8$
|
$COOC_8H_{17}$ (Solv-6) Solvent:

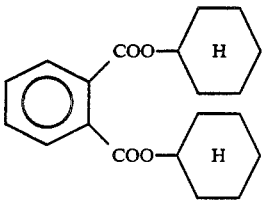

The multi-layer color photographic paper prepared as described above was subjected to trichromatic separation exposure through a sensitometric wedge and B, G and R filters with a sensitometer (FWH of Fuji Photo Film Co., Ltd.; color temperature of the light source 3200° K.) The exposure conditions comprised 250 CMS and 0.1 sec.

The photosensitive material prepared as described above was subjected to a continuous processing (running test) with processing solutions described below by a process comprising the following steps until a color developer had been replenished in an amount of twice as much as the tank capacity.

| Step | Temp. | Processing steps: Time (sec) | Tank capacity | Amount of replenisher (per $m^2$ of color photographic paper) |
|---|---|---|---|---|
| Color development | 35° C. | 15 | 2 l | 60 ml |
| Bleach-fixing | 38° C. | 15 | 2 l | 60 ml |
| Washing with water (1) | 38° C. | 7 | 1 l | 3-stage counter-current washing 120 ml |
| Washing with water (2) | 38° C. | 7 | 1 l | |
| Washing with water (3) | 38° C. | 7 | 1 l | |
| Drying | 75° C. | 15 | | |

The compositions of the processing solutions were as follows:

| | Mother* liquor | Replenisher |
|---|---|---|
| Color developer | | |
| Water | 800 ml | 800 ml |
| 1-Hydroxyethylidene-1,1-diphosphonic acid | 0.5 g | 0.7 g |
| Diethylenetriaminepentaacetic acid | 1.0 g | 1.4 g |
| N,N,N-Trismethylenephosphonic acid | 1.5 g | 2.0 g |
| Potassium bromide | 0.015 g | — |
| Potassium chloride | 4.9 g | — |
| Fluorescent brightener (4,4'-diamino-stilbene compound) | 2.0 g | 2.5 g |
| Potassium carbonate | 30 g | 37 g |

-continued

| | | | |
|---|---|---|---|
| Triethanolamine | | 10 g | 11 g |
| N,N-Bis(2-sullfoethyl)hydroxylamine | | 8.5 g | 11 g |
| N-Ethyl-N-(β-methanesulfonamidoethyl)-3-methyl-4-aminoaniline sulfate (D-1) | | 10.1 g | 15.0 g |
| Water | ad | 1000 ml | 1000 ml |
| pH (25° C.) | | 10.05 | 10.45 |

| | Mother liquor | Replenisher |
|---|---|---|
| Bleach-fixing solution: | | |
| Water | 700 ml | 700 ml |
| Ammonium thiosulfate solution (700 g/l) | 100 ml | 150 ml |
| Ammonium sulfite | 18 g | 30 g |
| Ferric ammonium ethylenediamine-tetraacetate dihydrate | 77 g | 100 g |
| Disodium ethylenediaminetetraacetate dihydrate | 3 g | 5 g |
| Ammonium bromide | 40 g | 60 g |
| Glacial acetic acid | 8 g | 16 g |
| Water | ad 1000 ml | 1000 ml |
| pH (25° C.) | 5.5 | 4.3 |

*Tank solution

Water for washing (both mother liquor and replenisher):

City water (containing 23 mg/l of calcium and 3 mg/l of magnesium and having electric conductivity of 170 μs/cm)

Exposed multi-layered color photographic papers were processed in the same manner as that described above except that the developing agent D-1 in the color developer was replaced with an equimolar amount of the comparative compound D-2 or D-3 or compound (1), (4), (5), (7), (14), (16) or (29) of the present invention. The maximum density ($D_{max}$) of each of the yellow, magenta and cyan images was determined by using B, G or R filter. The maximum absorption wave length of the resultant cyan image was determined with a reflection-type spectrophotometer. The results are given in Table 1.

D-1

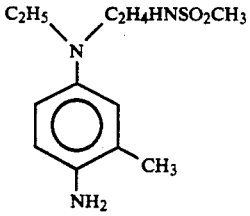

D-2

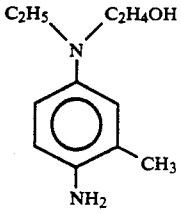

D-3

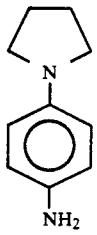

Compound No. 46 on page 3,100 of Journal of the American Chemical Society, Vol 73.

TABLE 1

| Color developing agent | $D_{max}^B$ | $D_{max}^C$ | $D_{max}^R$ | Maximum absorption wave length of cyan color image (nm) | Remarks |
|---|---|---|---|---|---|
| D-1 | 1.53 | 1.95 | 2.43 | 646 | Com. Ex. |
| D-2 | 2.03 | 2.17 | 2.45 | 655 | Com. Ex. |
| D-3 | 0.95 | 1.82 | 2.39 | 631 | Com. Ex. |
| (1) | 2.02 | 2.14 | 2.38 | 627 | Present invention |
| (4) | 2.18 | 2.31 | 2.45 | 631 | Present invention |
| (5) | 2.12 | 2.36 | 2.46 | 633 | Present invention |
| (7) | 2.26 | 2.32 | 2.42 | 641 | Present invention |
| (14) | 2.34 | 2.43 | 2.47 | 648 | Present invention |
| (16) | 2.07 | 2.38 | 2.42 | 630 | Present invention |
| (29) | 1.91 | 2.35 | 2.39 | 632 | Present invention |

It is apparent from Table 1 that the developing agents of the present invention are superior to D-1 or D-3 in that the former is capable of yielding a high image density, particularly yellow density, in a short time. As for the maximum absorption wave length of the cyan dye, D-1 and the developing agents of the present invention exhibited an absorption desirable for the color reproduction at a shorter wave length, while D-2 exhibited an undesirable absorption at a longer wave length. It will be understood that by using the developing agent of the present invention, both of the rapid process and production of excellent hue are quite possible.

EXAMPLE 2

There was prepared multi-layered color photosensitive material(sample 101) composed of layers of the following compositions formed on a primed cellulose triacetate film support.

(Compositions of photosensitive layers)

The amounts of the silver halides and colloidal silver are given in terms of silver applied (g/m²). The amounts of the coupler, additives and gelatin are given in terms of g/m². The amount of the sensitizing dye is given in terms of molar number thereof per mol of the silver halide contained in the same layer.

| | | |
|---|---|---|
| The first layer (antihalation layer): | | |
| Black colloidal silver | | 0.15 |
| Gelatin | | 1.5 |
| ExM-8 | | 0.08 |
| UV-1 | | 0.03 |
| UV-2 | | 0.06 |
| Solv-2 | | 0.08 |
| UV-3 | | 0.07 |
| Cpd-5 | | $6 \times 10^{-4}$ |
| The second layer (intermediate layer) | | |
| Gelatin | | 1.5 |
| UV-1 | | 0.03 |
| UV-2 | | 0.06 |
| UV-3 | | 0.07 |
| ExF-1 | | 0.004 |
| Solv-2 | | 0.07 |
| Cpd-5 | | $6 \times 10^{-4}$ |
| The third layer (the first red-sensitive emulsion layer): | | |
| Silver bromoiodide emulsion (AgI 2 molar %, internal high AgI type, equivalent diameter of grain: 0.3 μm, coefficient of variation of the equivalent diameter of grain: 29%, mixture of normal and twin crystals, diameter/thickness ratio: 2.5) | silver | 0.5 |
| Gelatin | | 0.8 |
| ExS-1 | | $1.0 \times 10^{-4}$ |
| ExS-2 | | $3.0 \times 10^{-4}$ |
| ExS-3 | | $1 \times 10^{-5}$ |
| ExC-3 | | 0.22 |
| ExC-4 | | 0.02 |
| Cpd-5 | | $3 \times 10^{-4}$ |
| The fourth layer (the second red-sensitive emulsion layer) | | |
| Silver bromoiodide emulsion (AgI 4 molar %, internal high AgI type, equivalent diameter of grain: 0.55 μm, coefficient of variation of the equivalent diameter of grain: 20%, mixture of normal and twin crystals, diameter/thickness ratio: 1) | silver | 0.7 |
| Gelatin | | 1.26 |
| ExS-1 | | $1 \times 10^{-4}$ |
| ExS-2 | | $3 \times 10^{-4}$ |
| ExS-3 | | $1 \times 10^{-5}$ |
| ExC-3 | | 0.33 |
| ExC-4 | | 0.01 |
| ExY-16 | | 0.01 |
| ExC-7 | | 0.04 |
| ExC-2 | | 0.08 |
| Solv-1 | | 0.03 |
| Cpd-5 | | $5 \times 10^{-4}$ |
| The fifth layer (the third red-sensitive emulsion layer) | | |
| Silver bromoiodide emulsion (AgI 10 molar %, internal high AgI type, equivalent diameter of grain: 0.7 μm, coefficient of variation of the equivalent diameter of grain: 30%, mixture of twin crystals, diameter/thickness ratio: 2 | silver | 0.7 |
| Gelatin | | 0.8 |
| ExS-1 | | $1 \times 10^{-4}$ |
| ExS-2 | | $3 \times 10^{-4}$ |
| ExS-3 | | $1 \times 10^{-5}$ |

-continued

| | | |
|---|---|---|
| ExC-5 | | 0.05 |
| ExC-6 | | 0.06 |
| Solv-1 | | 0.15 |
| Solv-2 | | 0.08 |
| Cpd-5 | | $3 \times 10^{-5}$ |
| The sixth layer (intermediate layer) | | |
| Gelatin | | 1.0 |
| Cpd-5 | | $4 \times 10^{-4}$ |
| Cpd-1 | | 0.10 |
| Cpd-4 | | 1.23 |
| Solv-1 | | 0.05 |
| Cpd-3 | | 0.25 |
| The seventh layer (the first green-sensitive emulsion layer) | | |
| Silver bromoiodide emulsion (AgI 2 molar %, internal high AgI type, equivalent diameter of grain: 0.3 μm, coefficient of variation of the equivalent diameter of grain: 28%, mixture of normal and twin crystals, diameter/thickness ratio: 2.5) | silver | 0.30 |
| Gelatin | | 0.4 |
| ExS-4 | | $5 \times 10^{-4}$ |
| ExS-6 | | $0.3 \times 10^{-4}$ |
| ExS-5 | | $2 \times 10^{-4}$ |
| ExM-9 | | 0.2 |
| ExY-14 | | 0.03 |
| ExM-8 | | 0.03 |
| Solv-1 | | 0.2 |
| Cpd-5 | | $2 \times 10^{-4}$ |
| The eighth layer (the second green-sensitive emulsion layer) | | |
| Silver bromoiodide emulsion (AgI 4 molar %, internal high AgI type, equivalent diameter of grain: 0.55 μm, coefficient of variation of the equivalent diameter of grain: 20%, mixture of normal and twin crystals, diameter/thickness ratio: 4) | silver | 0.6 |
| Gelatin | | 0.8 |
| ExS-4 | | $5 \times 10^{-4}$ |
| ExS-5 | | $2 \times 10^{-4}$ |
| ExS-6 | | $0.3 \times 10^{-4}$ |
| ExM-9 | | 0.25 |
| ExM-8 | | 0.03 |
| ExM-10 | | 0.015 |
| ExY-14 | | 0.04 |
| Solv-1 | | 0.2 |
| Cpd-5 | | $3 \times 10^{-4}$ |
| The ninth layer (the third green-sensitive emulsion layer) | | |
| Silver bromoiodide emulsion (AgI 10 molar %, internal high AgI type, equivalent diameter of grain: 0.7 μm, coefficient of variation of the equivalent diameter of grain: 30%, mixture of normal and twin crystals, diameter/thickness ratio: 2.0) | silver | 0.85 |
| Gelatin | | 1.0 |
| ExS-4 | | $2.0 \times 10^{-4}$ |
| ExS-5 | | $2.0 \times 10^{-4}$ |
| ExS-6 | | $0.2 \times 10^{-4}$ |
| ExS-7 | | $3.0 \times 10^{-4}$ |
| Exm-12 | | 0.06 |
| ExM-13 | | 0.02 |
| ExM-8 | | 0.02 |

-continued

| | | |
|---|---|---|
| Solv-1 | | 0.20 |
| Solv-2 | | 0.05 |
| Cpd-5 | | $4 \times 10^{-4}$ |
| The tenth layer (yellow filter layer) | | |
| Gelatin | | 0.9 |
| Yellow colloidal silver | | 0.05 |
| Cpd-1 | | 0.2 |
| Solv-1 | | 0.15 |
| Cpd-5 | | $4 \times 10^{-4}$ |
| The eleventh layer (the first blue-sensitive emulsion layer) | | |
| Silver bromoiodide emulsion (AgI 4 molar %, internal high AgI type, equivalent diameter of grain: 0.5 μm, coefficient of variation of the equivalent diameter of grain: 15%, octahedral grains) | silver | 0.4 |
| Gelatin | | 1.0 |
| ExS-8 | | $2 \times 10^{-4}$ |
| ExY-16 | | 0.9 |
| ExY-14 | | 0.09 |
| Solv-1 | | 0.3 |
| Cpd-5 | | $4 \times 10^{-4}$ |
| The twelfth layer (the second blue-sensitive emulsion layer) | | |
| Silver bromoiodide emulsion (AgI 10 molar %, internal high AgI type, equivalent diameter of grain: 1.3 μm, coefficient of variation of the equivalent diameter of grain: 25%, mixture of normal and twin crystals, diameter/thickness ratio: 4.5) | silver | 0.5 |
| Gelatin | | 0.6 |
| ExS-8 | | $1 \times 10^{-4}$ |
| ExY-16 | | 0.12 |
| Solv-1 | | 0.04 |
| Cpd-5 | | $2 \times 10^{-4}$ |
| The thirteenth layer (the first protecting layer) | | |
| Fine silver bromoiodide grains (average grain diameter: 0.07 μm, AgI 1 molar %) | | 0.2 |
| Gelatin | | 0.8 |
| UV-3 | | 0.1 |
| UV-4 | | 0.1 |
| UV-5 | | 0.2 |
| Solv-3 | | 0.04 |
| Cpd-5 | | $3 \times 10^{-4}$ |
| The fourteenth layer (the second protecting layer) | | |
| Gelatin | | 0.9 |
| Polymethyl methacrylate grains (diameter: 1.5 μm) | | 0.2 |
| Cpd-5 | | $4 \times 10^{-4}$ |
| H-1 | | 0.4 |

A surfactant was incorporated as a coating aid into each layer in addition to the above-described components. The sample prepared as above will be referred to as "Sample 101". The photographic layers of the sample had a thickness of 17.6 μm (on dyr basis).

The chemical formulae or chemical names of the compounds used in the present invention are as follows:

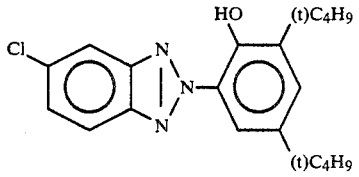

UV-1

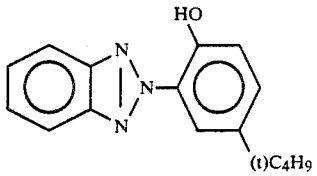

UV-2

-continued
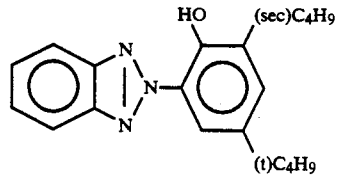
UV-3
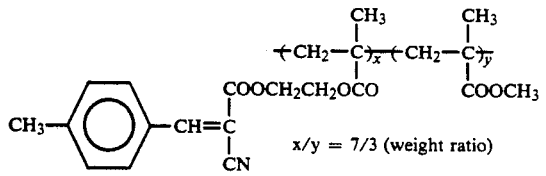
UV-4
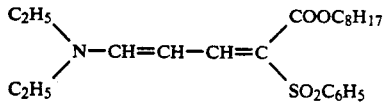
UV-5
Tricresyl phosphate — Solv-1
Dibutyl phthalate — Solv-2
Bis(2-ethylhexyl)phthalate — Solv-3
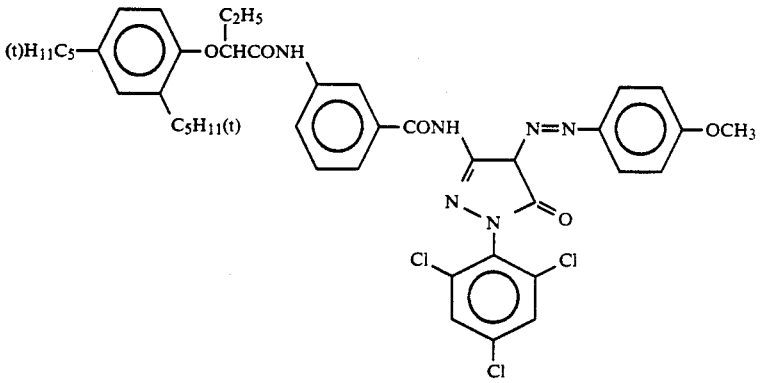
ExM-8
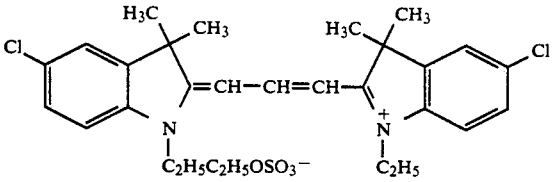
ExF-1
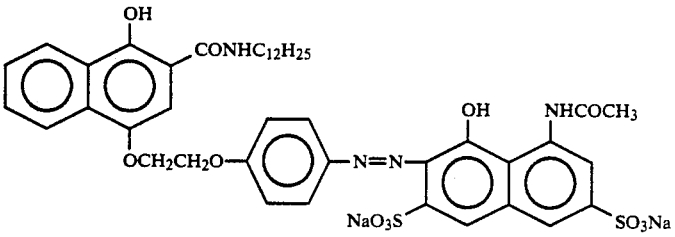
ExC-2
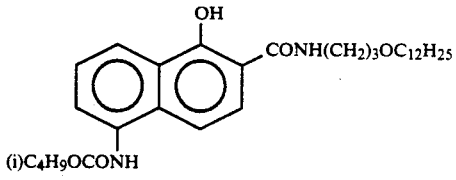
ExC-3

-continued
ExY-14
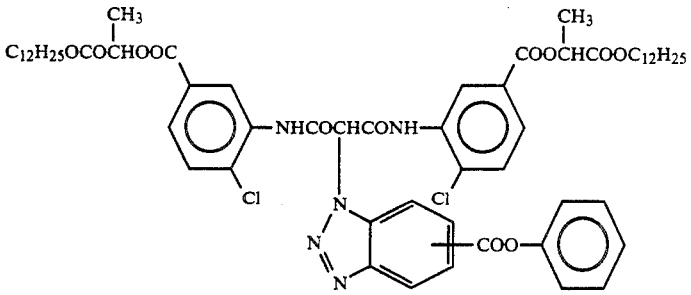
ExC-4
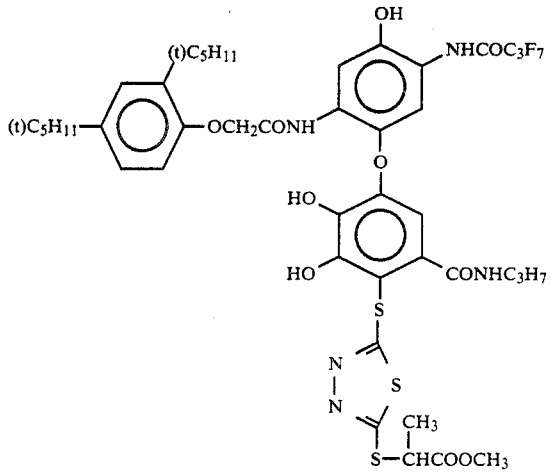
ExY-15
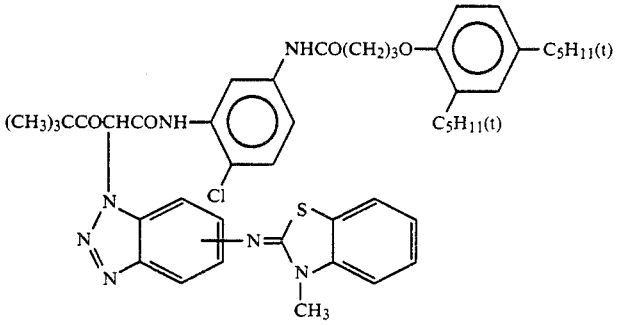
ExC-5
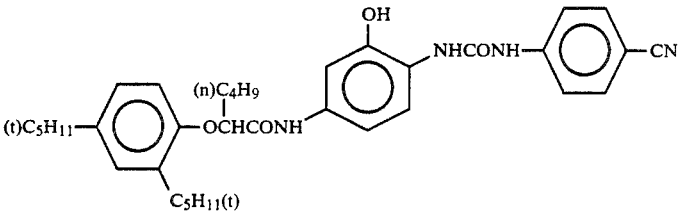
ExC-6
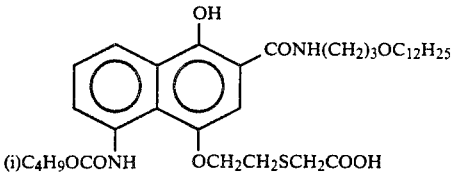

-continued
ExC-7
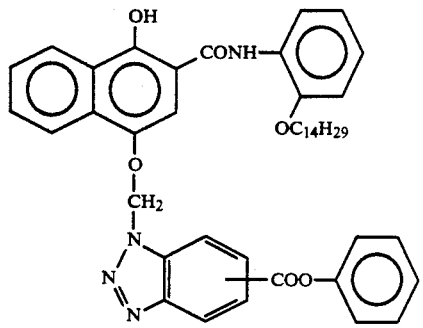
ExM-9
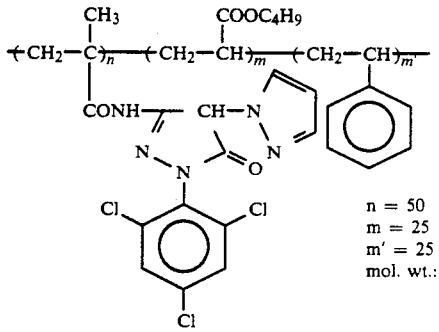
n = 50
m = 25
m' = 25
mol. wt.: about 20,000
ExM-10
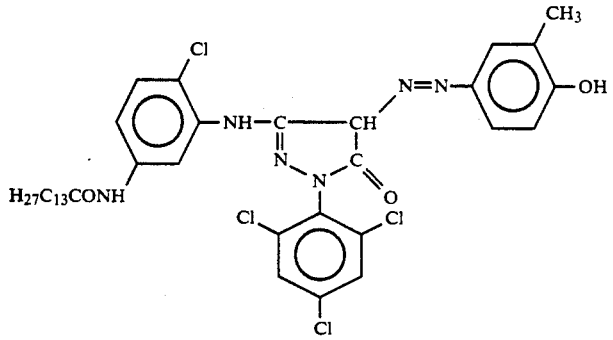
ExM-12
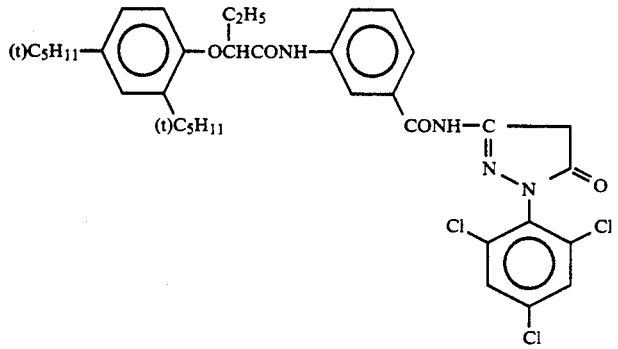

-continued
ExM-13
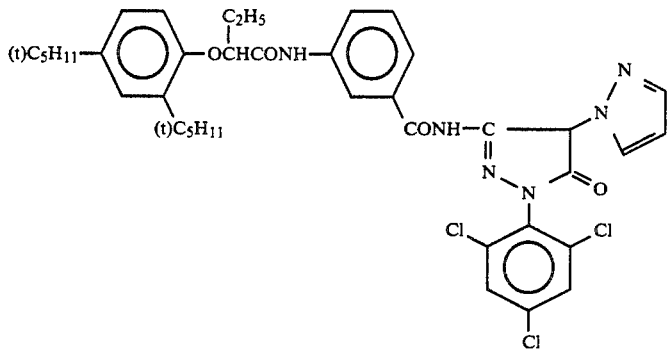
ExY-16
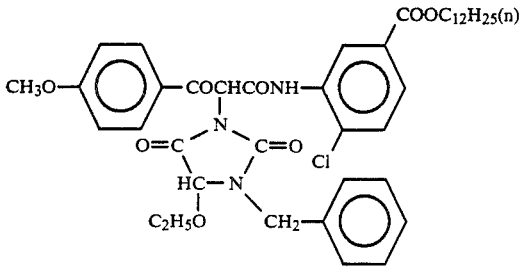
Cpd-1
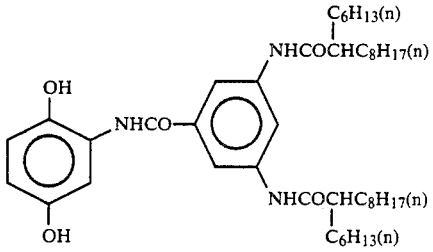
Cpd-2
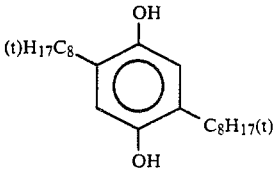
ExS-1
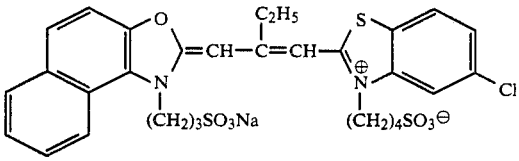
ExS-2
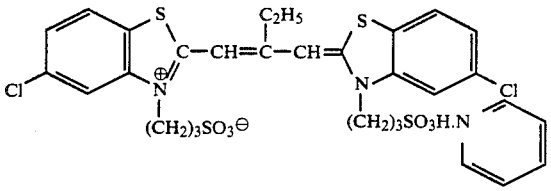
ExS-3
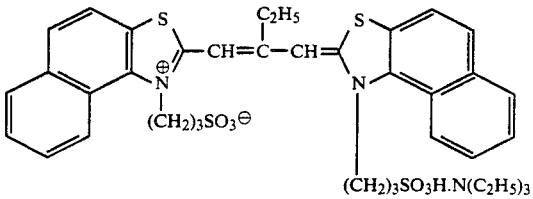

-continued

ExS-4

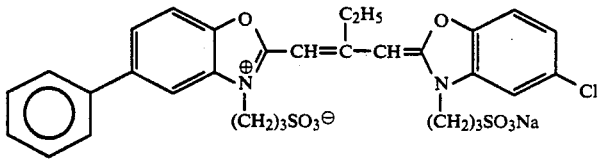

ExS-5

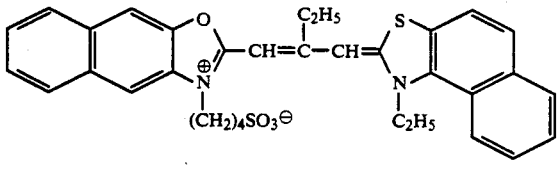

ExS-6

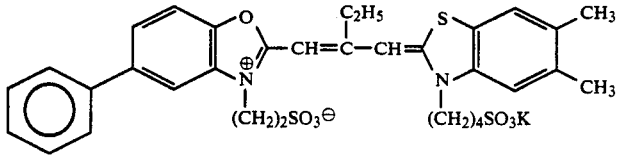

ExS-7

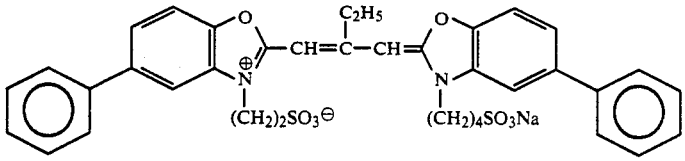

ExS-8

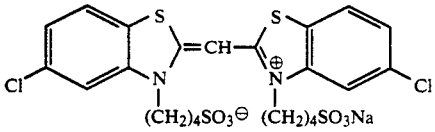

H-1

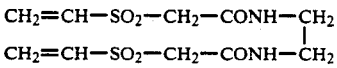

Cpd-3

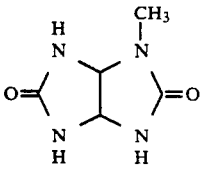

Cpd-4

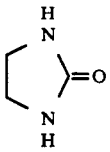

Cpd-5

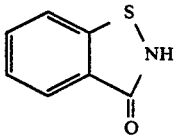

and color developers containing various developing agents given in Table 2 were used as described below.

In each test, the photosensitive material sample was processed until the amount of the color developer replenished had reached twice as much as the capacity of the color developing tank. After wedge exposure through R-filter, the photosensitive material sample was processed.

| Step | Time | Temp. | Amount of replenisher | Capacity of tank |
|---|---|---|---|---|
| Color development | 2 min | 38.0° C. | 600 ml | 1 l |
| Bleaching | 45 min | 38.0° C. | 130 ml | 1 l |
| Fixing | 1 min 30 sec | 38.0° C. | 800 ml | 1 l |
| Washing with | 20 sec | 38.0° C. | counter- | 0.5 l |

-continued

| Step | Time | Temp. | Amount of replenisher | Capacity of tank |
|---|---|---|---|---|
| water (1) | | | current from (2) to (1) | |
| Washing with water (2) | 20 sec | 38.0° C. | 500 ml | 0.5 l |
| Stabilization | 20 sec | 38.0° C. | 500 ml | 0.5 l |
| Drying | 1 min 00 sec | 55.0° C. | | |

In the above table, the amount of the replenisher is given per $m^2$ of the photosensitive material.

The compositions of the processing solutions used were as follows:

| | Mother liquor (g) | Replenisher (g) |
|---|---|---|
| (Color developer) | | |
| Diethylenetriaminepentaacetic acid | 1.0 | 1.0 |
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | 0.3 |
| Potassium iodide | 1.5 mg | — |
| Hydroxylamine sulfate | 2.4 | 3.6 |
| Color developing agent (see Table 2) | 16 mmol | 16 mmol |
| Water | ad 1.0 l | 1.0 l |
| pH | 10.05 | 10.10 |
| (Bleaching solution) | | |
| Ferric ammonium ethylenediaminetetraacetate | 100.0 | 180.0 |
| Ammonium bromide | 140.0 | 180.0 |
| Ammonium nitrate | 30.0 | 40.0 |
| Acetic acid (98%) | 25.0 ml | 30.0 ml |
| Glycolic acid | 70.0 | 100.0 |
| Water | ad 1.0 l | 1.0 l |
| pH | 3.3 | 2.8 |
| (Fixing solution) | | |
| 1-Hydroxyethylidene-1,1-diphosphonic acid | 1.0 | 1.5 |
| Ammonium sulfite | 12.0 | 20.0 |
| Ammonium thiosulfate | 1.5 mol/l | 1.7 mol/l |
| Water | ad 1.0 l | 1.0 l |
| pH | 6.7 | 6.4 |

(Washing water) [Both mother liquor and replenisher (g)]

City water was passed through a column of a mixed-bed system filled with H-type strong acidic cation exchange resin (Amberlite IR-120B; product of Rohm & Haas Co.) and OH-type anion exchange resin (Amberlite IR-400; product of Rohm & Haas Co.) to reduce calcium and magnesium ion concentration to 3 mg/l or less. Then 20 mg/l of sodium dichloroisocyanurate and sodium sulfate were added thereto.

The pH of the liquid was in the range of 6.5 to 7.5.

| | Mother liquor (g) | Replenisher (g) |
|---|---|---|
| Stabilizer | | |
| Triethanolamine | 2.0 | 3.0 |
| Formalin (37%) | 2.0 ml | 3.0 ml |
| Polyoxyethylene-p-monononylphenyl ether (average degree of polymerization: 10) | 0.3 | 0.45 |
| Disodium ethylenediaminetetraacetate | 0.05 | 0.08 |
| Water | ad 1.0 l | 1.0 l |
| pH | 5.0–8.0 | 5.0–8.0 |

The processed samples were subjected to the density determination by using R filter and the maximum color density ($D_{max}$) of cyan color image was determined. The results are shown in Table 2.

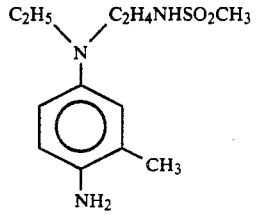

D-1

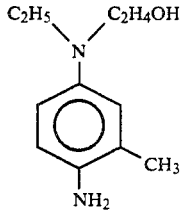

D-2

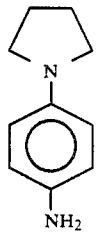

D-3

(Compound No. 46 on page 3,100 of Journal of the American Chemical Society, Vol. 73)

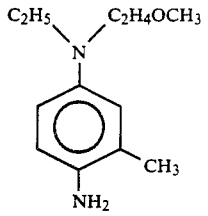

D-4

TABLE 2

| Test No. | Developing agent | $D^R$ max | Remarks |
|---|---|---|---|
| 1 | D-1 | 0.95 | Comparative Example |
| 2 | D-2 | 1.37 | " |
| 3 | D-3 | 0.78 | " |
| 4 | D-4 | 1.42 | " |
| 5 | (3) | 1.48 | Present invention |
| 6 | (9) | 2.11 | " |
| 7 | (14) | 1.80 | " |
| 8 | (16) | 1.63 | " |
| 9 | (20) | 1.89 | " |
| 10 | (21) | 1.84 | " |
| 11 | (23) | 1.76 | " |

It is apparent that the developing agent of the present invention provides the maximum color density higher than that of the comparative color developing agent after the color development process which was completed in a far shorter time (2 min) than that of ordinary color developing process (3min 15 sec) for color negative films. Thus the developing agent of the present invention is quite suitable for the rapid process. Further the developing agent of the present invention provided an excellent hue, while rapid developing agents usually forms a dye having a hue of a long wave practically unfavorably.

EXAMPLE 3

The first to the fourteenth layers were formed on the surface of a paper support (thickness: 100μ) the both surfaces of which had been laminated with polyethylene, and the thirteenth to the sixteenth layers were formed on another surface thereof to form a color photographic photosensitive material. The polyethylene layer on the first layer-side contained 4 g/m$^2$ of titanium oxide as a white pigment and 0.003 g/m$^2$ of ultramarine as a blueing dye (the chromaticities cn the support surface were 88.0, −0.20 and −0.75 for $L^x$, $a^x$ and $b^x$, respectively).

(Composition of photosensitive layers)

The components and amounts thereof (g/m$^2$) are shown below. The amount of the silver halide is given in terms of silver. The emulsions used for forming the layers were prepared in the same manner as the preparation of emulsion EM1 except that the emulsion used for forming the fourteenth layer was a Lippmann emulsion which was inert to the surface chemical sensitization.

| | |
|---|---|
| The first layer (antihalation layer) | |
| Black colloidal silver | 0.10 |
| Gelatin | 0.35 |
| The second layer (intermediate layer) | |
| Gelatin | 0.40 |
| The third layer (red-sensitive layer having a low sensitivity) | |
| Silver bromide spectrally sensitized with red-sensitizing dye (ExS-1,2,3)(average grain size: 0.25μ, size distribution [coefficient of variation]: 8%, octahedral) | 0.04 |
| Silver chlorobromide spectrally sensitized with red-sensitizing dye (ExS-1,2,3)(silver chloride content: 5 molar %, average grain size: 0.40μ, size distribution 10%, octahedral) | 0.08 |
| Gelatin | 0.80 |
| Cyan coupler (ExC-1 and 2 in a ratio of 1:1) | 0.30 |
| Fading inhibitor (Cpd-1, 2, 3 and 4 in equal amounts) | 0.18 |
| Antistaining agent (Cpd-5) | 0.003 |
| Coupler dispersant (Cpd-6) | 0.03 |
| Coupler solvent (Solv-1, 2 and 3 in equal amounts) | 0.12 |
| The fourth layer (red-sensitive layer of high sensitivity) | |
| Silver bromide spectrally sensitized with red-sensitizing dye (ExS-1,2,3)(average grain size: 0.60μ, size distribution 15%, octahedral) | 0.14 |
| Gelatin | 0.80 |
| Cyan coupler (ExC-1 and 2 in a ratio of 1:1) | 0.30 |
| Fading inhibitor (Cpd-1, 2, 3 and 4 in equal amounts) | 0.18 |
| Coupler dispersant (Cpd-6) | 0.03 |
| Coupler solvent (Solv-1, 2 and 3 in equal amounts) | 0.12 |
| The fifth layer (intermediate layer) | |
| Gelatin | 0.70 |
| Fading inhibitor (Cpd-7) | 0.08 |
| Solvent for color-mixing inhibitor (Solv-4 and 5 in equal amounts | 0.16 |
| Polymer latex (Cpd-8) | 0.10 |
| The sixth layer (green-sensitive layer of low sensitivity) | |
| Silver bromide spectrally sensitized with green-sensitizing dye (ExS-4)(average grain size: 0.25μ, size distribution 8%, octahedral) | 0.04 |
| Silver chlorobromide spectrally sensitized with green-sensitizing dye (ExS-4)(silver chloride content: 5 molar %, average grain size: 0.40μ, size distribution 10%, octahedral) | 0.06 |
| Gelatin | 0.70 |
| Magenta coupler (ExM-1, 2 and 3 in equal amounts) | 0.11 |
| Fading inhibitor (Cpd-9 and 26 in equal amounts) | 0.15 |
| Antistaining agent (Cpd-10, 11, 12 and 13 in a ratio of 10:7:7:1) | 0.025 |
| Coupler dispersant (Cpd-6) | 0.05 |
| Solvent for coupler (Solv-4 and 6 in equal amounts) | 0.15 |
| The seventh layer (green-sensitive layer of high sensitivity) | |
| Silver bromide spectrally sensitized with green-sensitizing dye (ExS-4)(average grain size: 0.65μ, size distribution 16%, octahedral) | 0.10 |
| Gelatin | 0.70 |
| Magenta coupler (ExM-1, 2 and 3 in equal amounts) | 0.11 |
| Fading inhibitor (Cpd-9 and 26 in equal amounts) | 0.15 |
| Antistaining agent (Cpd-10, 11, 12 and 13 in a ratio of 10:7:7:1) | 0.025 |
| Coupler dispersant (Cpd-6) | 0.05 |
| Solvent for coupler (Solv-4 and 6 in equal amounts) | 0.15 |
| The eighth layer (intermediate layer) | |
| (the same as the fifth layer) | |
| The ninth layer (yellow filter layer) | |
| Yellow colloidal silver (grain size: 100 A) | 0.12 |
| Gelatin | 0.60 |
| Color-mixing inhibitor (Cpd-7) | 0.03 |
| Solvent for color-mixing inhibitor (Solv-4 and 5 in equal amounts) | 0.10 |
| Polymer latex (Cpd-8) | 0.07 |
| The tenth layer (intermediate layer) | |
| (the same as the fifth layer) | |
| The eleventh layer (blue-sensitive layer of low sensitivity) | |
| Silver bromide spectrally sensitized with blue-sensitizing dye (ExS-5 and 6)(average grain size: 0.40μ, size distribution 8%, octahedral) | 0.07 |
| Silver chlorobromide spectrally sensitized with blue-sensitizing dye (ExS-5 and 6)(silver chloride content: 8 molar %, average grain size: 0.60μ, size distribution 11%, octahedral) | 0.14 |
| Gelatin | 0.70 |
| Yellow coupler (ExY 1 and 2 in equal amounts) | 0.35 |
| Color-mixing inhibitor (Cpd-14) | 0.10 |
| Antistaining agent (Cpd-5 and 15 in ratio of 1:5) | 0.007 |
| Coupler dispersant (Cpd-6) | 0.05 |
| Solvent for coupler (Solv-2) | 0.10 |
| The twelfth layer (blue-sensitive layer of high sensitivity) | |
| Silver bromide spectrally sensitized with blue-sensitizing dye (ExS-5 and 6) (average grain size: 0.85μ, size distribution 18%, octahedral) | 0.15 |
| Gelatin | 0.55 |
| Yellow coupler (ExY 1 and 2 in equal amounts) | 0.30 |
| Fading inhibitor (Cpd-14) | 0.10 |
| Antistaining agent (Cpd-5 and 15 in ratio of 1:5) | 0.007 |
| Coupler dispersant (Cpd-6) | 0.05 |
| Solvent for coupler (Solv-2) | 0.10 |
| The thirteenth layer (ultraviolet ray-absorbing layer) | |
| Gelatin | 0.80 |
| Ultraviolet ray absorber (Cpd-2, 4 and 16 in equal amounts) | 0.50 |
| Color-mixing inhibitor (Cpd-7 and 17 in equal amounts) | 0.03 |
| Dispersant (Cpd-6) | 0.02 |
| Solvent for U.V. absorber (Solv-2 and 7 in equal amounts) | 0.08 |
| Anti-irradiation dye (Cpd-18, 19, 20, 21 and 27 in ratio of 10:10:13:15:20) | 0.05 |
| The fourteenth layer (protecting layer) | |
| Fine grain silver chlorobromide (silver chloride content: 97 molar %, average size: 0.1μ) | 0.03 |

-continued

| | |
|---|---|
| Acryl-modified copolymer of polyvinyl alcohol (average molecular weight: 50,000) | 0.01 |
| Mixture of polymethyl methacrylate grains (average grain size: 2.4μ) and silicon oxide grains (average grain size: 5μ) in equal amounts | 0.05 |
| Gelatin | 1.50 |
| Gelatin hardener (H-1 and H-2 in equal amounts) | 0.18 |
| The fifteenth layer (back layer) | |
| Gelatin | 2.25 |
| Ultraviolet ray absorber (Cpd-2, 4 and 16 in equal amounts) | 0.50 |
| Dye (Cpd-18, 19, 20, 21 and 27 in equal amounts) | 0.06 |
| The sixteenth layer (back surface-protecting layer) | |
| Mixture of polymethyl methacrylate grains (average grain size: 2.4μ) and silicon oxide (average grain size: 5μ) | 0.05 |
| Gelatin | 1.75 |
| Gelatin hardener (H-1 and H-2 in equal amounts) | 0.14 |

Method of preparation of emulsion EM-1

Potassium bromide and an aqueous silver nitrate solution were simultaneously added to an aqueous gelatin solution under vigorous stirring at 75° C. for 15 min to product octahedral silver bromide grains having an average grain diameter of 0.35μ. Then 3,4-dimethyl 1,3-thiazoline-2-thion was added thereto in an amount of 0.3 g per mol of silver. 6 mg (per mol of silver) of sodium thiosulfate and 7 mg (per mol of silver) of chloroauric acid (tetrahydrate) were successively added to the emulsion and the mixture was heated at 75° C. for 80 min to conduct the chemical sensitization. The grains thus obtained were used as the cores and they were grown under the same precipitation conditions as described above to finally obtain a silver bromide emulsion of monodisperse core/shell type (octahedral) (average grain diameter: 0.7μ). The coefficient of variation of the grain size was about 10%. 1.5 mg (per mol of silver) of sodium thiosulfate and 1.5 mg (per mol of silver) of chloroauric acid (hetrahydrate) were added to the emulsion and the mixture was heated at 60° C. for 60 min to conduct the chemical sensitization so as to obtain an internal latent-image type silver halide emulsion.

$10^{-3}$% by weight and $10^{-3}$% by weight (based on the silver halide) of ExZK-1 and ExZK-2, respectively, were added as nucleating agents to each photosensitive layer and $10^{-3}$% by weight of Cpd-22 was also added as nucleating accelerator thereto. Further, each layer contained Alkanol XC (Dupont) and a sodium alkylbenzenesulfonate as emulsification/dispersion assistants and a succinic ester and Magefac F-120 (Dainippon Ink & Chemicals, Inc.) as coating aids. Silver halide-containing layers and colloidal silver-containing layers contained a mixture of Cpd-23, 24 and 25 as the stabilizer.

The compounds used in the Examples were as follows:

ExS-1

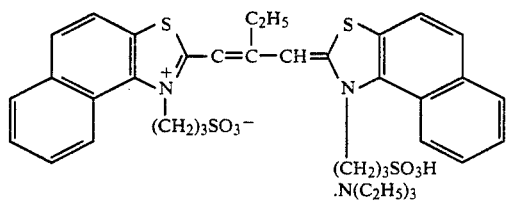

ExS-2

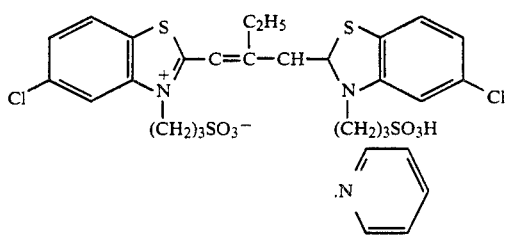

ExS-3

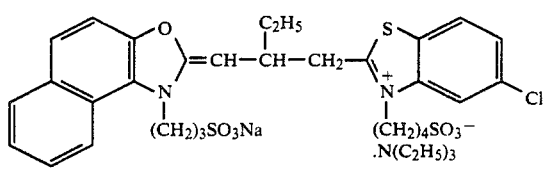

ExS-4

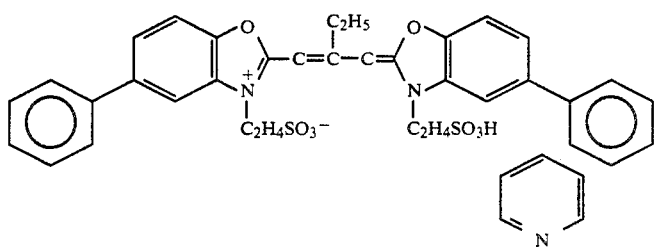

-continued
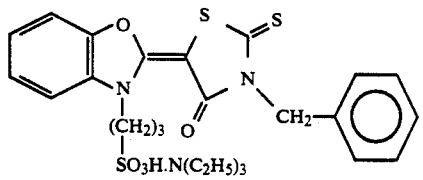
ExS-5
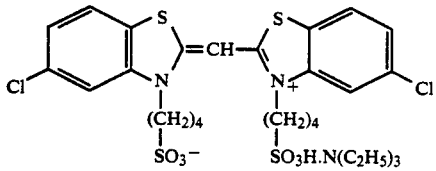
ExS-6
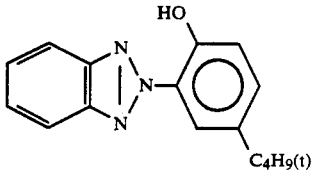
(Cpd-1)
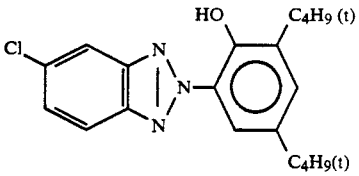
Cpd-2
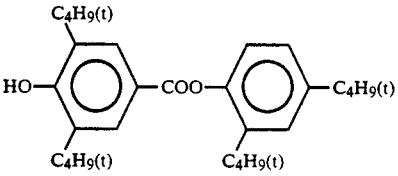
Cpd-3
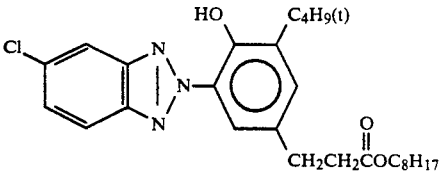
Cpd-4
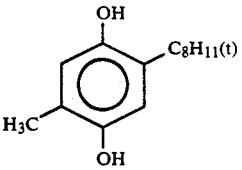
Cpd-5
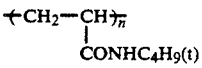
(n = 100 ~ 1000)
Cpd-6
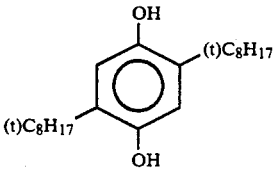
Cpd-7
Polyethyl acrylate
(MW = 10,000 to 100,000)
Cpd-8

-continued
Cpd-9
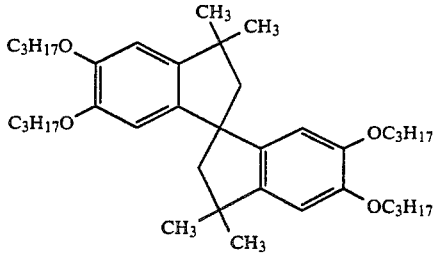
Cpd-10
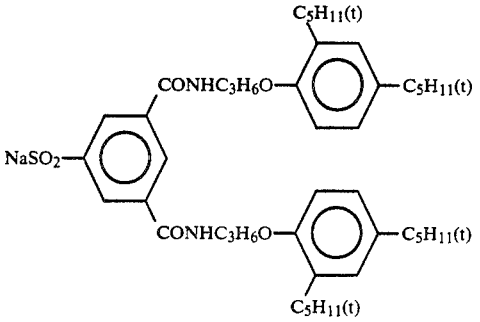
Cpd-11
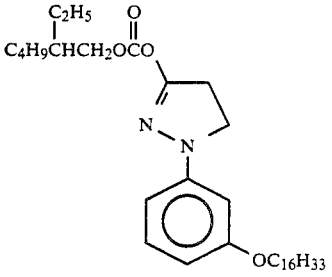
Cpd-12
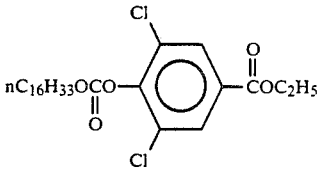
Cpd-13
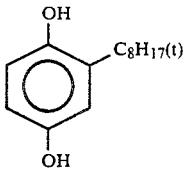
Cpd-14
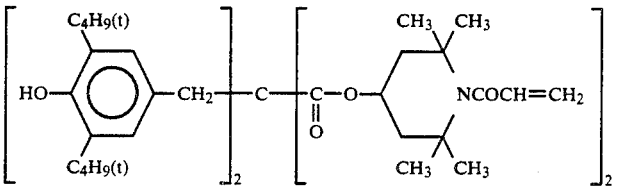
Cpd-15
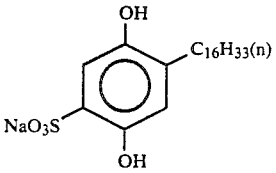

-continued
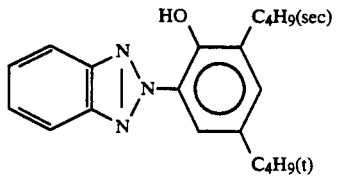
Cpd-16
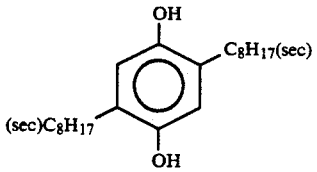
Cpd-17
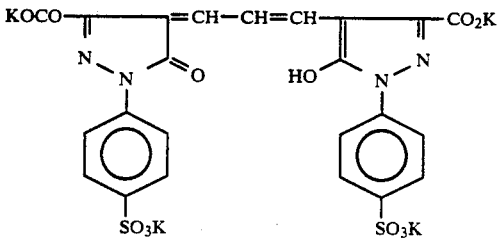
Cpd-18
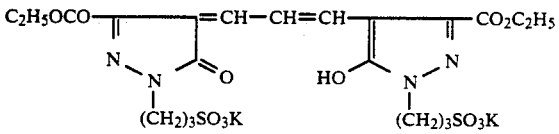
Cpd-19
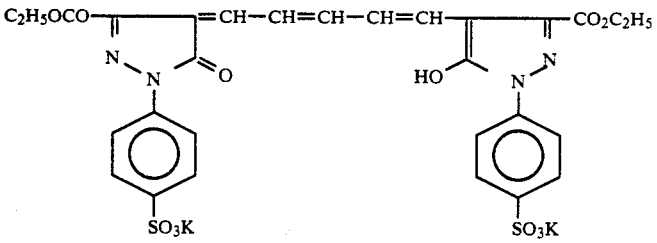
Cpd-20
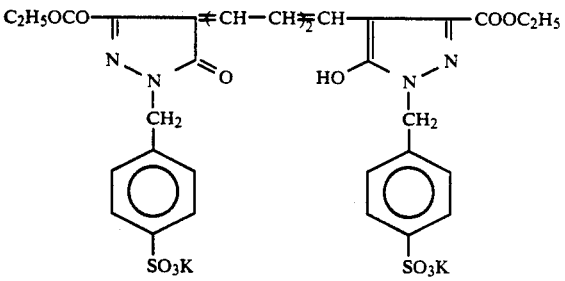
Cpd-21
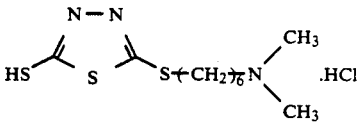
Cpd-22
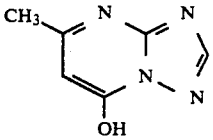
Cpd-23

-continued
Cpd-24
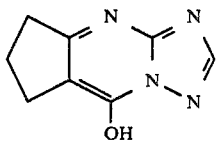
Cpd-25
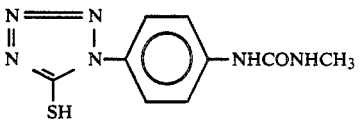
Cpd-26
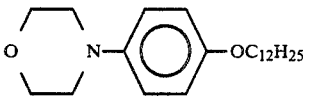
Cpd-27
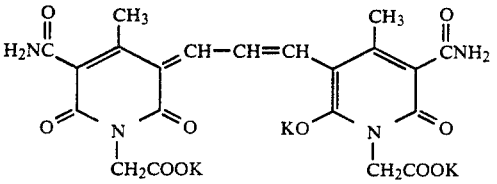
ExC-1
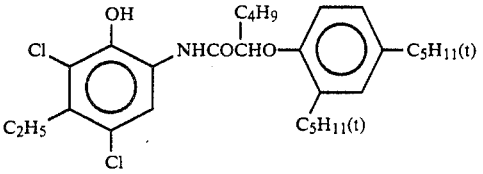
ExC-2
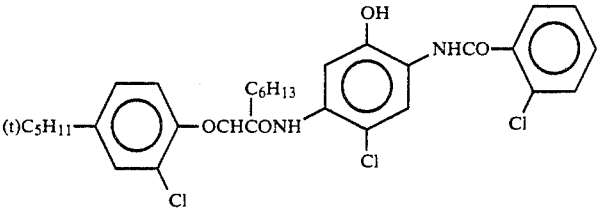
ExM-1
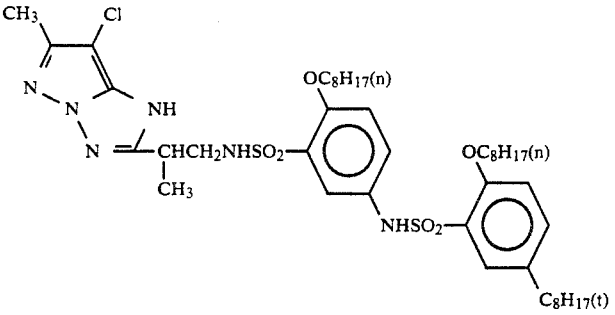
ExM-2
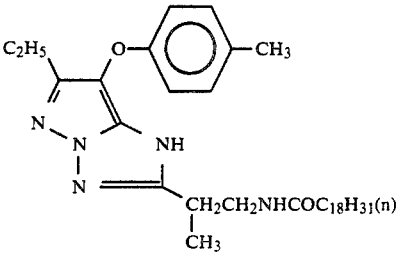

-continued

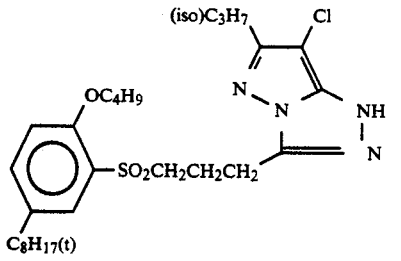

ExM-3

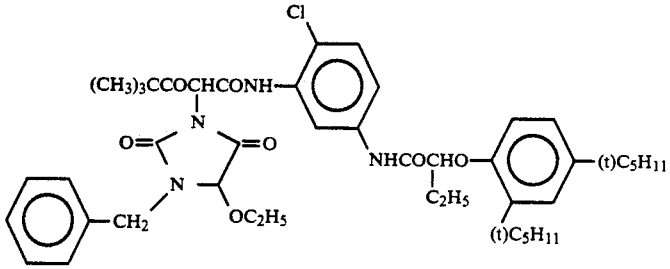

ExY-1

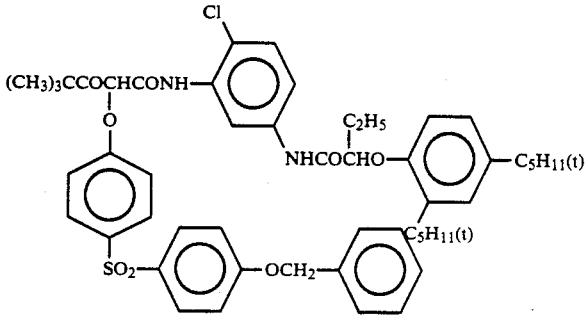

ExY-2

| | |
|---|---|
| di(2-ethylhexyl)sebacate | Solv-1 |
| trinonyl phosphate | Solv-2 |
| di(3-methylhexyl)phthalate | Solv-3 |
| tricresyl phosphate | Solv-4 |
| dibutyl phthalate | Solv-5 |
| trioctyl phosphate | Solv-6 |
| di(2-ethylhexyl)phthalate | Solv-7 |
| 1,2-bis(vinylsulfonylacetamido)ethane | H-1 |
| sodium salt of 4,6-dichloro-2-hydroxy-1,3,5-triazine | H-2 |
| 7-[3-(5-mercaptotetrazol-1-yl)benzamido]-10-propargyl-1,2,3,4-tetrahydroacridinium perchlorate | ExZK-1 |
| 1-formyl-2-{4-[3-{3-[3-(5-mercaptotetrazol-1-yl)-phenyl]ureido}benzensulfonamido]phenyl}hydrazine | ExZK-2 |

The silver halide color photosensitive material prepared as described above was exposed to form an image in the same manner as that of Example 1 and then continuously processed with an automatic developing machine by the following process until the total amount of the replenisher had been increased to 3 times as much as the capacity of the tank.

| Step | Temp. | Time (sec) | Tank capacity | Amount of replenisher |
|---|---|---|---|---|
| Color development | 38° C. | 100 | 11 l | 300 ml/m$^2$ |
| Bleach-fixing | 33° C. | 40 | 3 l | 300 ml/m$^2$ |
| Washing with water (1) | 33° C. | 40 | 3 l | — |
| Washing with water (2) | 33° C. | 40 | 3 l | 320 ml/m$^2$ |
| Drying | 80° C. | 30 | | |

Water for washing was supplied by counter current method wherein water was fed into the washing bath (2) and an overflow from the bath (2) was introduced into the washing bath (1). The amount of the bleach-fixing solution brought from the bleach-fixing bath into the washing bath (1) by the photosensitive material was 35 ml/m$^2$ and the ratio of the replenished water to the brought bleach-fixing solution was 9.1:1.

The compositions of the processing solutions were as follows:

| | Mother liquor | Replenisher |
|---|---|---|
| Color developer | | |
| D-Solbitol | 0.15 g | 0.20 g |
| Sodium naphthalenesulfonate/formalin condensate | 0.15 g | 0.20 g |
| Ethylenediaminetetrakismethylene-phosphonic acid | 1.5 g | 1.5 g |
| Diethylene glycol | 12.0 ml | 16.0 ml |
| Benzyl alcohol | 13.5 ml | 18.0 ml |
| Potassium bromide | 0.70 g | — |
| Benzotriazole | 0.003 g | 0.004 g |
| Sodium sulfite | 2.4 g | 3.2 g |
| N,N-bis(carboxymethyl)hydrazine | 4.0 g | 5.3 g |
| D-Glucose | 2.0 g | 2.4 g |
| Triethanolamine | 6.0 g | 8.0 g |

-continued

| | Mother liquor | Replenisher |
|---|---|---|
| N-Ethyl-N-(β-methanesulfonamidoethyl)-3-methyl-4-aminoaniline sulfate (D-1) | 6.4 g | 8.5 g |
| Potassium carbonate | 30.0 g | 25.0 g |
| Fluorescent brightener (diaminostilbene compound) | 1.0 g | 1.2 g |
| Water | ad 1000 ml | 1000 ml |
| pH (25° C.) | 10.25 | 11.00 |
| Bleach-fixing solution: | | |
| Disodium ethylenediaminetetraacetate dihydrate | 2.0 g | (the same as the mother liquor) |
| Fe (III) ammonium ethylenediaminetetraacetate dihydrate | 70.0 g | |
| Ammonium thiosulfate (700 g/l) | 180 ml | |
| Sodium p-toluenesulfinate | 45.0 g | |
| Sodium bisulfite | 35.0 g | |
| 5-Mercapto-1,3,4-triazole | 0.5 g | |
| Ammonium nitrate | 10.0 g | |
| Water | ad 1000 ml | |
| pH (25° C.) | 6.10 | |

Water for washing (both mother liquor and replenisher)

City water was passed through a column of a mixed-bed system filled with H-type strong acidic cation exchange resin (Amberlite IR-120B; product of Rohm & Haas Co.) and OH-type anion exchange resin (Amberlite IR-400; product of Rohm & Haas Co.) to reduce calcium and magnesium ion concentration to 3 mg/l or less. Then 20 mg/l of sodium dichloroisocyanurate and 0.15 g/l of sodium sulfate were added thereto. The pH of the liquid was in the range of 6.5 to 7.5.

Then the same procedure as that of Example 1 was repeated except that the developing agent D-1 in the color developer was replaced with an equimolar amount of the comparative compound D-2 or D-3 or the compound (1), (4), (7), (16), (21) or (22) of the present invention. It was thus confirmed that when the developing agent of the present invention was used, a high image density was obtained in a short time and a preferred hue was also obtained.

EXAMPLE 4

A multi-layered color photosensitive material composed of layers of the following compositions formed on a primed cellulose triacetate film support having a thickness of 127μ was prepared.

The numerals refer to the amount per $m^2$. The effects of the compounds added are not limited to those listed below.

| | | |
|---|---|---|
| The first layer (antihalation layer): | | |
| Black colloidal silver | | 0.25 g |
| Gelatin | | 1.9 g |
| U.V. absorber U-1 | | 0.04 g |
| U.V. absorber U-2 | | 0.1 g |
| U.V. absorber U-3 | | 0.1 9 |
| U.V. absorber U-4 | | 0.1 g |
| U.V. absorber U-6 | | 0.1 g |
| High-boiling organic solvent Oil-1 | | 0.1 g |
| The second layer (intermediate layer) | | |
| Gelatin | | 0.40 g |
| Dye E-4 | | 0.4 mg |
| The third layer (intermediate layer) | | |
| Fine grain silver bromoiodide emulsion (the shell and core being fogged)(average grain diameter: 0.06 μm, coefficient of variation: 18%, AgI content: 1 molar %) | silver | 0.05 g |
| Gelatin | | 0.4 g |

-continued

| | | |
|---|---|---|
| The fourth layer (red-sensitive emulsion layer of low sensitivity) | | |
| Emulsion A | silver | 0.2 g |
| Emulsion B | silver | 0.3 g |
| Gelatin | | 0.8 g |
| Coupler C-1 | | 0.15 g |
| Coupler C-2 | | 0.05 g |
| Coupler C-9 | | 0.05 g |
| Compound Cpd-D | | 10 mg |
| High-boiling organic solvent Oil-2 | | 0.1 g |
| The fifth layer (red-sensitive emulsion layer of medium sensitivity): | | |
| Emulsion B | silver | 0.2 g |
| Emulsion C | silver | 0.3 g |
| Gelatin | | 0.8 g |
| Coupler C-1 | | 0.2 g |
| Coupler C-2 | | 0.05 g |
| Coupler C-3 | | 0.2 g |
| High-boiling organic solvent Oil-2 | | 0.1 g |
| The sixth layer (red-sensitive emulsion layer of high sensitivity): | | |
| Emulsion D | silver | 0.4 g |
| Gelatin | | 1.1 g |
| Coupler C-3 | | 0.7 g |
| Coupler C-1 | | 0.3 g |
| Additive P-1 | | 0.1 g |
| The seventh layer (intermediate layer) | | |
| Gelatin | | 0.6 g |
| Additive M-1 | | 0.3 g |
| Color-mixing inhibitor Cpd-K | | 2.6 mg |
| U.V. absorber U-1 | | 0.1 g |
| U.V. absorber U-6 | | 0.1 g |
| Dye E-1 | | 0.02 g |
| The eighth layer (intermediate layer) | | |
| Silver bromoiodide emulsion (the shell and core being fogged)(average grain diameter: 0.06 μm, coefficient of variation: 16%, AgI content: 0.3 molar %) | silver | 0.02 g |
| Gelatin | | 1.0 g |
| Additive P-1 | | 0.2 g |
| Color-mixing inhibitor Cpd-J | | 0.1 g |
| Color-mixing inhibitor Cpd-A | | 0.1 g |
| The ninth layer (green-sensitive emulsion layer of low sensitivity): | | |
| Emulsion E | silver | 0.3 g |
| Emulsion F | silver | 0.1 g |
| Emulsion G | silver | 0.1 g |
| Gelatin | | 0.5 g |
| Coupler C-7 | | 0.35 g |
| Compound Cpd-B | | 0.03 g |
| Compound Cpd-E | | 0.02 g |
| Compound Cpd-F | | 0.02 g |
| Compound cpd-G | | 0.02 g |
| Compound Cpd-H | | 0.02 g |
| Compound Cpd-D | | 10 mg |
| high-boiling organic solvent Oil-1 | | 0.1 g |
| High-boiling organic solvent Oil-2 | | 0.1 g |
| The tenth layer (green-sensitive emulsion layer of medium sensitivity): | | |
| Emulsion G | silver | 0.3 g |
| Emulsion H | silver | 0.1 g |
| Gelatin | | 0.6 g |
| Coupler C-7 | | 0.3 g |
| Compound Cpd-B | | 0.03 g |
| Compound Cpd-E | | 0.02 g |
| Compound Cpd-F | | 0.02 g |
| Compound cpd-G | | 0.05 g |
| Compound Cpd-H | | 0.05 g |
| High-boiling organic solvent Oil-2 | | 0.01 g |
| The eleventh layer (green-sensitive emulsion layer of high sensitivity): | | |
| Emulsion I | silver | 0.5 g |
| Gelatin | | 1.0 g |
| Coupler C-4 | | 0.4 g |
| Compound Cpd-B | | 0.08 g |
| Compound Cpd-E | | 0.02 g |
| Compound Cpd-F | | 0.02 g |
| Compound Cpd-G | | 0.02 g |
| Compound Cpd-H | | 0.02 g |
| high-boiling organic solvent Oil-1 | | 0.02 g |
| High-boiling organic solvent Oil-2 | | 0.02 g |
| The twelfth layer (intermediate layer): | | |
| Gelatin | | 0.6 g |

-continued

| | | |
|---|---|---|
| Dye E-2 | | 0.05 g |
| Dye E-1 | | 0.1 g |
| Dye E-3 | | 0.07 g |
| The thirteenth layer (yellow filter layer) | | |
| Yellow colloidal silver | silver | 0.1 g |
| Gelatin | | 1.1 g |
| Color-mixing inhibitor Cpd-A | | 0.01 g |
| High-boiling organic solvent Oil-1 | | 0.01 g |
| The fourteenth layer (intermediate layer) | | |
| Gelatin | | 0.6 g |
| The fifteenth layer (blue-sensitive emulsion layer of low sensitivity) | | |
| Emulsion J | silver | 0.4 g |
| Emulsion K | silver | 0.1 g |
| Emulsion L | silver | 0.1 g |
| Gelatin | | 0.8 g |
| Coupler C-5 | | 0.6 g |
| The sixteenth layer (blue-sensitive emulsion layer of medium sensitivity): | | |
| Emulsion L | silver | 0.1 g |
| Emulsion M | silver | 0.4 g |
| Gelatin | | 0.9 g |
| Coupler C-5 | | 0.3 g |
| Coupler C-6 | | 0.3 g |
| The seventeenth layer (blue-sensitive emulsion layer of high sensitivity): | | |
| Emulsion N | silver | 0.4 g |
| Gelatin | | 1.2 g |
| Coupler C-6 | | 0.7 g |
| The eighteenth layer (the first protecting layer) | | |
| Gelatin | | 0.7 g |
| U.V. absorber U-1 | | 0.04 g |
| U.V. absorber U-2 | | 0.01 g |
| U.V. absorber U-3 | | 0.03 g |
| U.V. absorber U-4 | | 0.03 g |
| U.V. absorber U-5 | | 0.05 g |
| U.V. absorber U-6 | | 0.05 g |
| High-boiling organic solvent Oil-1 | | 0.02 g |
| Formalin scavenger | | |
| Cpd-C | | 0.2 g |
| Cpd-I | | 0.4 g |
| Dye E-3 | | 0.05 g |
| The nineteenth layer (the second protecting layer) | | |
| Colloidal silver | silver | 0.1 mg |
| Fine grain silver bromoiodide emulsion (average grain diameter: 0.06 μm, AgI content: 1 molar %) | silver | 0.1 g |
| Gelatin | | 0.4 g |
| The twentieth layer (the third protecting layer) | | |
| Gelatin | | 0.4 g |
| Polymethyl methacrylate (average grain diameter: 1.5 μ) | | 0.1 g |
| Methyl methacrylate/acrylic acid copolymer (4:6)(average grain diameter: 1.5μ) | | 0.1 g |
| Silicone oil | | 0.03 g |
| Surfactant W-1 | | 3.0 mg |
| Surfactant W-2 | | 0.03 g |

Additives F-1 to F-8 were incorporated into all the emulsion layers in addition to the above-described components. Further gelatin hardener H-1 and surfactants for coating and emulsification W-3 and W-4 were also incorporated into the layers.

In addition, phenol, 1,2-benzoisothiazoline-3-on, 2-phenoxyethanol and phenethyl alcohol were used as an antiseptic or antifungal agent.

The silver bromoiodide emulsions used were as follows:

| Emulsion | Grain | Average grain diameter (μm) | Coefficient of variation | AgI content (%) |
|---|---|---|---|---|
| A | Monodisperse, tetradecahedral grains | 0.25 | 16 | 3.7 |
| B | monodisperse, cubic, internal latent type grains | 0.30 | 10 | 3.3 |
| C | Monodisperse, tetradecahedral grains | 0.30 | 18 | 5.0 |
| D | Polydisperse twin grains | 0.60 | 25 | 2.0 |
| E | Monodisperse, cubic grains | 0.17 | 17 | 4.0 |
| F | Monodisperse, cubic grains | 0.20 | 16 | 4.0 |
| G | Monodisperse, cubic, internal latent type grains | 0.25 | 11 | 3.5 |
| H | Monodisperse, cubic, internal latent type grains | 0.30 | 9 | 3.5 |
| I | Polydisperse, tabular grains having average aspect ratio of 3.8 | 0.80 | 28 | 1.5 |
| J | Monodisperse, tetradecahedral grains | 0.30 | 18 | 4.0 |
| K | Monodisperse, tetradecahedral grains | 0.37 | 17 | 4.0 |
| L | Monodisperse, cubic internal latent type grains | 0.46 | 14 | 3.5 |
| M | Monodisperse, cubic grains | 0.55 | 13 | 4.0 |
| N | Polydisperse, tabular grains having average aspect ratio of 4.5 | 1.00 | 33 | 1.3 |

Spectral sensitization of emulsions A to N

| Emulsion | Sensitizing dye used | Amount per mol of silver halide (g) | Time of addition of sensitizing dye |
|---|---|---|---|
| A | S-1 | 0.025 | Immediately after chemical sensitization |
| | S-2 | 0.25 | Immediately after chemical sensitization |
| B | S-1 | 0.01 | Immediately after completion of grain formation |
| | S-2 | 0.25 | Immediately after completion of grain formation |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after completion of grain formation |
| | S-4 | 0.08 | Immediately after completion of grain formation |
| H | S-3 | 0.2 | During formation of grains |
| | S-4 | 0.06 | " |
| I | S-3 | 0.3 | Immediately before initiation of chemical sensitization |
| | S-4 | 0.07 | Immediately before initiation of chemical sensitization |
| | S-8 | 0.1 | Immediately before initiation of chemical sensitization |
| J | S-5 | 0.2 | During formation of grains |
| | S-6 | 0.05 | " |
| K | S-5 | 0.2 | " |
| | S-6 | 0.05 | " |
| L | S-5 | 0.22 | Immediately after completion of grain formation |
| | S-6 | 0.06 | Immediately after completion of grain formation |
| M | S-5 | 0.15 | Immediately after chemicala sensitization |
| | S-6 | 0.04 | Immediately after chemicala sensitization |
| N | S-5 | 0.22 | Immediately after completion of grain formation |
| | S-6 | 0.06 | Immediately after completion of grain formation |

C-1
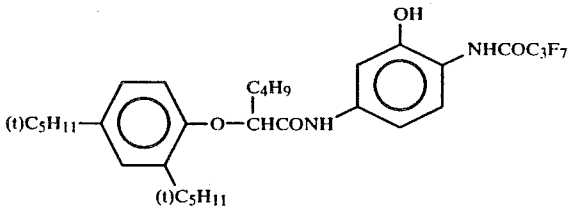
C-2
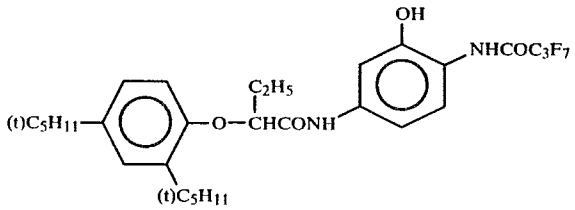
C-3
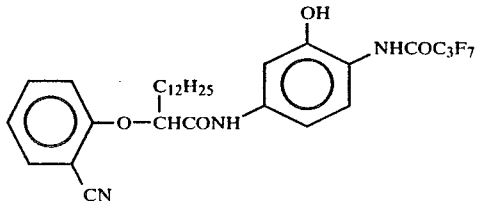
C-4
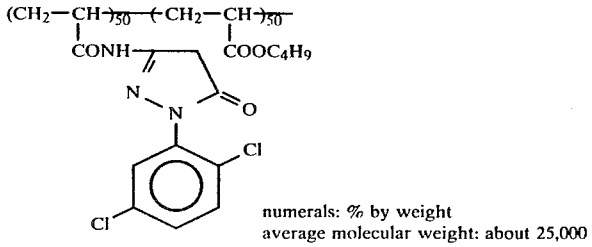
C-5
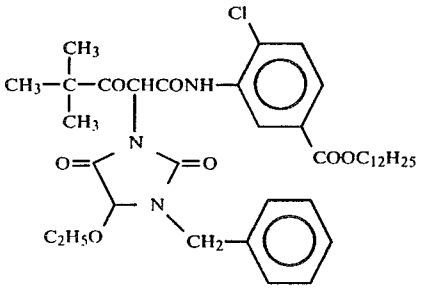
C-6
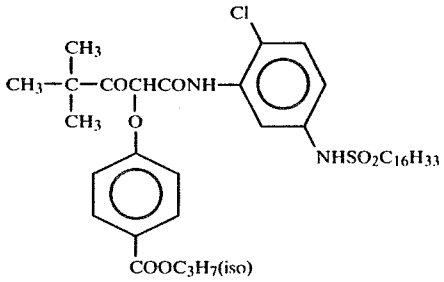

-continued
C-7
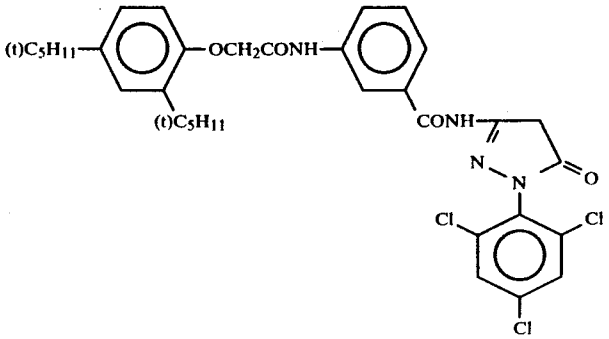
C-9
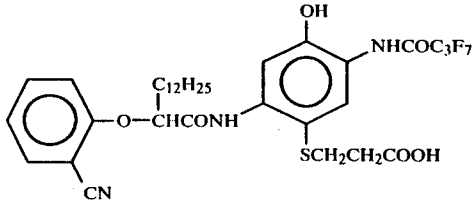
dibutyl phthalate
Oil-1
tricresyl phosphate
Oil-2
Oil-3
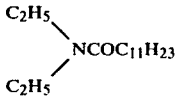
Cpd-A
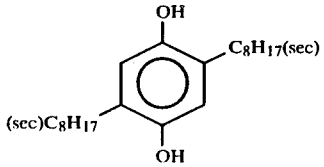
Cpd-B
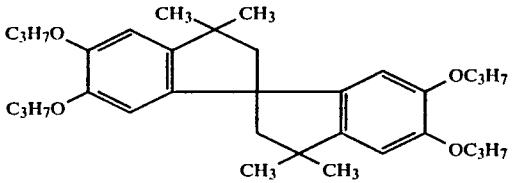
Cpd-C
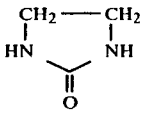
Cpd-D
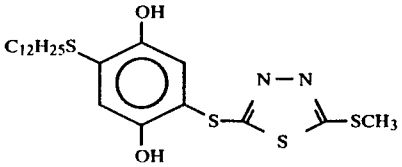
Cpd-E
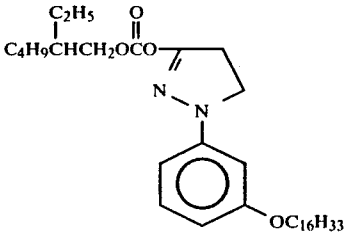

-continued
Cpd-F
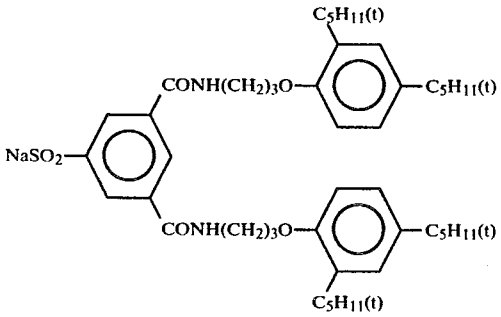
Cpd-G
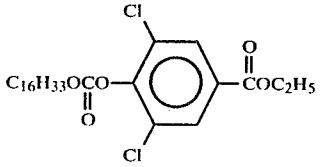
Cpd-H
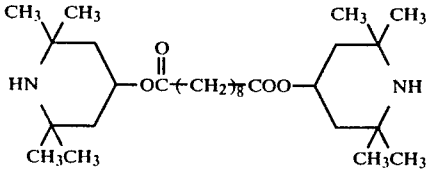
Cpd-I
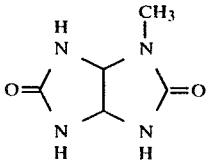
Cpd-J
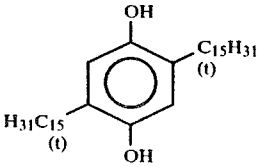
Cpd-K
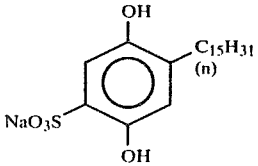
U-1
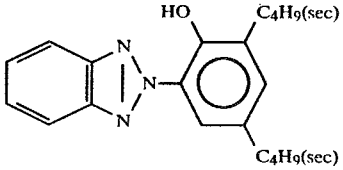
U-2
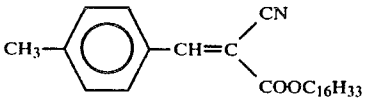
U-3
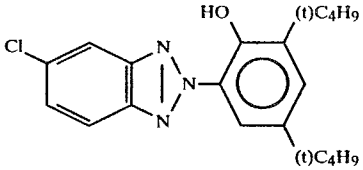

U-4
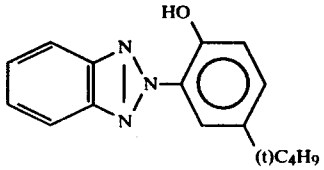
U-6
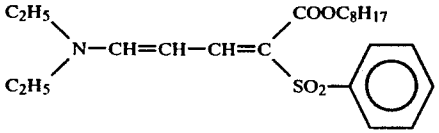
S-2
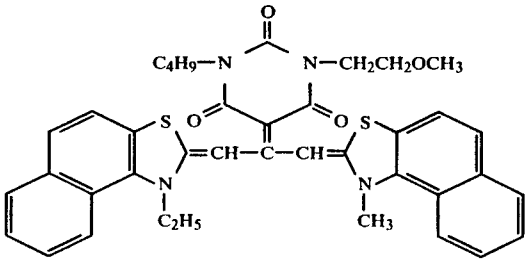
S-4
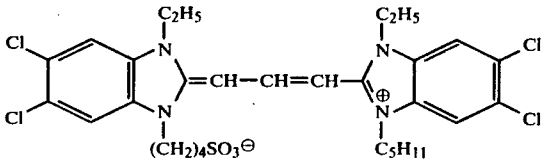
S-6
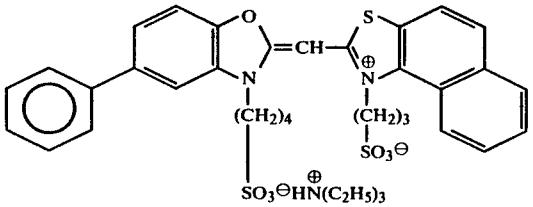
-continued
U-5
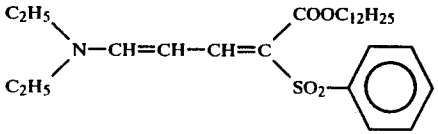
S-1
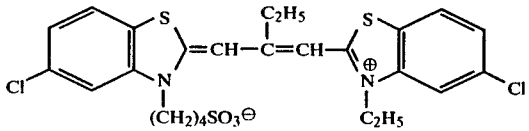
S-3
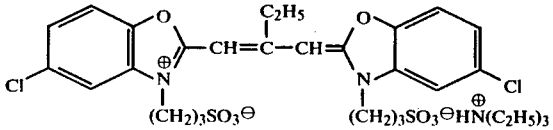
S-5
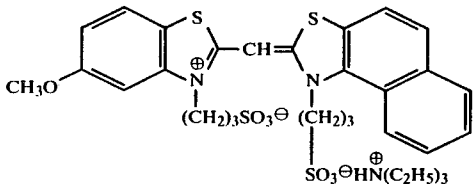
E-1
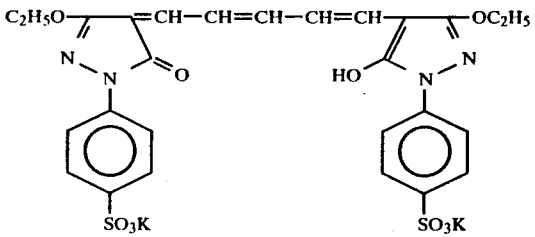

-continued
E-2
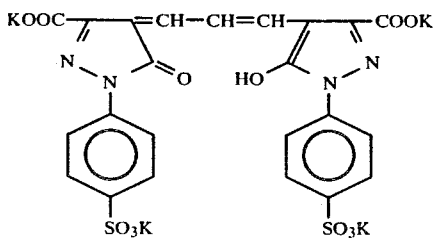
E-3
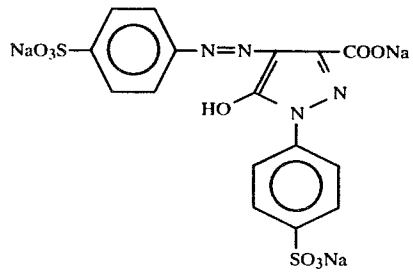
H-1
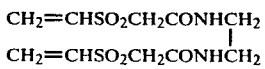
W-1
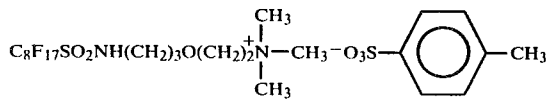
F-1
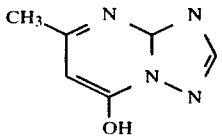
F-2
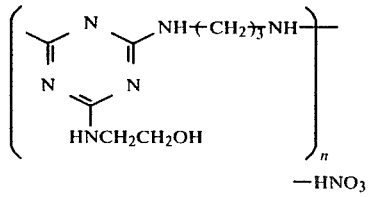
F-3
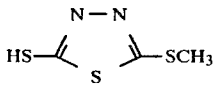
F-4
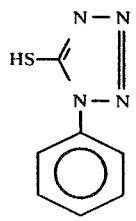
F-5
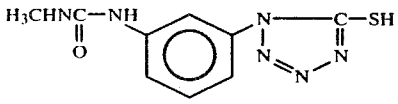
F-6
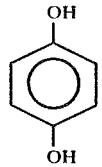

F-7
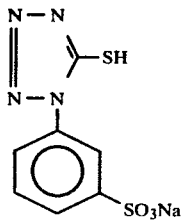
-continued
F-8
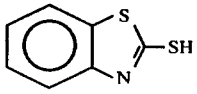

The color photographic photosensitive material exposed as described above was then processed by the following process:

| Step | Time (min) | Temp. (°C.) | Tank capacity (l) | Amount of replenisher (ml/m²) |
|---|---|---|---|---|
| The first development | 6 | 38 | 12 | 2200 |
| The first washing with water | 2 | 38 | 4 | 7500 |
| Reversal | 2 | 38 | 4 | 1100 |
| Color development | 4 | 38 | 12 | 2200 |
| Compensation | 2 | 38 | 4 | 1100 |
| Bleaching | 6 | 38 | 12 | 220 |
| Fixing | 4 | 38 | 8 | 1100 |
| The second washing with water | 4 | 38 | 8 | 7500 |
| Stabilization | 1 | 25 | 2 | 1100 |

The compositions of the processing solutions were as follows:

| | Mother liquor | Replenisher |
|---|---|---|
| The first developer: | | |
| Pentasodium nitrilo-N,N,N-trimethylene-phosphonate | 2.0 g | 2.0 g |
| Sodium sulfite | 30 g | 30 g |
| Potassium hydroquinone monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water | 1000 ml | 1000 ml |
| pH | 9.60 | 9.60 |
| The pH was adjusted with hydrochloric acid or potassium hydroxide. | | |
| Reversal solution: | | |
| Pentasodium nitrilo-N,N,N-trimethylene-phosphonate | 3.0 g | (the same as the mother liquor) |
| Stannous chloride dihydrate | 1.0 g | |
| p-Aminophenol | 0.1 g | |
| Sodium hydroxide | 8 g | |
| Glacial acetic acid | 15 ml | |
| Water | ad 1000 ml | |
| pH | 6.00 | |
| The pH was adjusted with hydrochloric acid or sodium hydroxide. | | |
| Color developer: | | |
| Pentasodium nitrilo-N,N,N-trimethylene-phosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methanesulfonamidoethyl)-3-methyl-4-aminoaniline sulfate (D-1) | 11 g | 11 g |
| 3,6-Dithiaoctane-1,8-diol | 1.0 g | 1.0 g |
| Water | ad 1000 ml | 1000 ml |
| pH | 11.80 | 12.00 |
| The pH was adjusted with hydrochloric acid or potassium hydroxide. | | |
| Compensating solution: | | |
| Disodium ethylenediaminetetraacetate dihydrate | 8.0 g | (the same as the mother liquor) |
| Sodium sulfite | 12 g | |
| 1-Thioglycerol | 0.4 ml | |
| Water | ad 1000 ml | |
| pH | 6.20 | |
| The pH was adjusted with hydrochloric acid or sodium hydroxide. | | |
| Bleaching solution: | | |
| Disodium ethylenediaminetetraacetate dihydrate | 2.0 g | 4.0 g |
| Fe(III) ammonium ethylenediamine tetraacetate dihydrate | 120 g | 240 g |
| Potassium bromide | 100 g | 200 g |
| Ammonium nitrate | 10 g | 20 g |
| Water | ad 1000 ml | 1000 ml |
| pH | 5.70 | 5.50 |
| The pH was adjusted with hydrochloric acid or sodium hydroxide. | | |
| Fixing solution: | | |
| Ammonium thiosulfate | 80 g | (the same as the mother liquor) |
| Sodium sulfite | 5.0 g | |
| Sodium hydrogensulfite | 5.0 g | |
| Water | ad 1000 ml | |
| pH | 6.60 | |
| The pH was adjusted with hydrochloric acid or aqueous ammonia. | | |
| Stabilizer: | | |
| Formalin (37%) | 5.0 ml | (the same as the mother liquor) |
| Polyoxyethylene-p-monononyl phenyl ether (average degree of polymerization: 10) | 0.5 ml | |
| Water | ad 1000 ml | |
| pH | not adjusted | |

Then color developers were prepared in the same manner as that of Example 2 except that the developing agent D-1 in the color developer was replaced with an equimolar amount of Comparative Compound D-2 or D-3 or Compound (3), (9), (16), (21) or (25) of the present invention. The same photosensitive material as that described above was processed with the color developer in the same manner as that described above. It was found that when the developing agent of the present invention was used, a higher maximum color density was obtained in a color development time (4 min) shorter than that of ordinary color development time (6 min) as in Example 2. The present invention is thus suitable for the rapid process.

It is apparent that the developing agent of the present invention is suitable for the rapid process and is capable of forming a color image having an excellent hue.

EXAMPLE 5

A cellulose triacetate film support having an undercoat formed thereon was coated with compositions which will be described below to form layers and thereby forming Sample 501 which was a multi-layer color photosensitive material:

(Compositions of photosensitive layers)

The main materials used for forming the layers were classified as follows:

| | |
|---|---|
| ExC: cyan coupler, | UV: ultraviolet light absorber |
| ExM: magenta coupler, | HBS: high-boiling organic solvent |
| ExY: yellow coupler, | H: gelatin hardener, and |
| ExS: sensitizing dye. | |

The numerals for the respective components indicate the amounts (g/m²) of the components used for coating. The amount of the silver halide is given in terms of silver used for coating. The amount of the sensitizing dye is given in terms of mol per mol of the silver halide contained in the same layer.

(Sample 501)

The first layer (antihalation layer)

-continued

| | | |
|---|---|---|
| Black colloidal silica | silver | 0.18 |
| Gelatin | | 1.40 |
| ExM-1 | | 0.18 |
| ExF-1 | | $2.0 \times 10^{-3}$ |

The second layer (intermediate layer)

| | | |
|---|---|---|
| Emulsion G | silver | 0.065 |
| 2,5-Di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |

The third layer (red-sensitive emulsion layer of low sensitivity)

| | | |
|---|---|---|
| Emulsion A | silver | 0.25 |
| Emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-4 | | 0.17 |
| ExC-7 | | 0.020 |
| UV-1 | | 0.070 |
| UV-2 | | 0.050 |
| UV-3 | | 0.070 |
| HBS-1 | | 0.060 |
| Gelatin | | 1.0 |

The fourth layer (red-sensitive emulsion layer of medium sensitivity)

| | | |
|---|---|---|
| Emulsion D | silver | 0.80 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.20 |
| ExC-2 | | 0.050 |
| ExC-4 | | 0.20 |
| ExC-5 | | 0.050 |
| ExC-7 | | 0.015 |
| UV-1 | | 0.070 |
| UV-2 | | 0.050 |
| UV-3 | | 0.070 |
| Gelatin | | 1.50 |

The fifth layer (red-sensitive emulsion layer of high sensitivity)

| | | |
|---|---|---|
| Emulsion E | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.097 |
| ExC-2 | | 0.010 |
| ExC-3 | | 0.065 |
| ExC-6 | | 0.020 |
| HBS-1 | | 0.22 |
| HBS-2 | | 0.10 |
| Gelatin | | 1.63 |

The sixth layer (intermediate layer)

| | | |
|---|---|---|
| Cpd-1 | | 0.040 |
| HBS-1 | | 0.020 |
| Gelatin | | 0.80 |

The seventh layer (green-sensitive emulsion layer of low sensitivity)

| | | |
|---|---|---|
| Emulsion C | silver | 0.30 |
| ExS-4 | | $2.6 \times 10^{-5}$ |
| ExS-5 | | $1.8 \times 10^{-4}$ |
| ExS-6 | | $6.9 \times 10^{-4}$ |
| ExM-1 | | 0.021 |
| ExM-2 | | 0.26 |
| ExM-3 | | 0.030 |

-continued

| | | |
|---|---|---|
| ExY-1 | | 0.025 |
| HBS-1 | | 0.10 |
| HBS-3 | | 0.010 |
| Gelatin | | 0.75 |

The eighth layer (green-sensitive emulsion layer of medium sensitivity)

| | | |
|---|---|---|
| Emulsion D | silver | 0.55 |
| ExS-4 | | $2.2 \times 10^{-5}$ |
| ExS-5 | | $1.5 \times 10^{-4}$ |
| ExS-6 | | $5.8 \times 10^{-4}$ |
| ExM-2 | | 0.094 |
| ExM-3 | | 0.026 |
| ExY-1 | | 0.018 |
| HBS-1 | | 0.16 |
| HBS-3 | | $8.0 \times 10^{-3}$ |
| Gelatin | | 0.55 |

The ninth layer (green-sensitive emulsion layer of high sensitivity)

| | | |
|---|---|---|
| Emulsion E | silver | 1.55 |
| ExS-4 | | $4.6 \times 10^{-5}$ |
| ExS-5 | | $1.0 \times 10^{-4}$ |
| ExS-6 | | $3.9 \times 10^{-4}$ |
| ExC-1 | | 0.015 |
| ExM-1 | | 0.013 |
| ExM-4 | | 0.065 |
| ExM-5 | | 0.019 |
| HBS-1 | | 0.25 |
| HBS-2 | | 0.10 |
| Gelatin | | 1.54 |

The tenth layer (yellow filter layer)

| | | |
|---|---|---|
| Yellow colloidal silica | silver | 0.035 |
| Cpd-1 | | 0.080 |
| EBS-1 | | 0.030 |
| Gelatin | | 0.95 |

The eleventh layer (blue-sensitive emulsion layer of low sensitivity)

| | | |
|---|---|---|
| Emulsion C | silver | 0.18 |
| ExS-7 | | $8.6 \times 10^{-4}$ |
| ExY-1 | | 0.042 |
| ExY-2 | | 0.72 |
| HBS-1 | | 0.28 |
| Gelatin | | 1.30 |

The twelfth layer (blue-sensitive emulsion layer of medium sensitivity)

| | | |
|---|---|---|
| Emulsion D | silver | 0.40 |
| ExS-7 | | $7.4 \times 10^{-4}$ |
| ExC-7 | | $7.0 \times 10^{-3}$ |
| ExY-2 | | 0.15 |
| HBS-1 | | 0.050 |
| Gelatin | | 0.85 |

The thirteenth layer (blue-sensitive emulsion layer of high sensitivity)

| | | |
|---|---|---|
| Emulsion F | silver | 0.70 |
| ExS-7 | | $2.8 \times 10^{-4}$ |
| ExY-2 | | 0.20 |
| HBS-1 | | 0.070 |
| Gelatin | | 0.69 |

The fourteenth layer (The first protective layer)

| | | |
|---|---|---|
| Emulsion G | silver | 0.20 |
| UV-4 | | 0.11 |
| UV-5 | | 0.17 |
| HBS-1 | | $5.0 \times 10^{-2}$ |
| Gelatin | | 1.00 |

The fifteenth layer (the second protective layer)

| | | |
|---|---|---|
| H-1 | | 0.40 |
| B-1 (diameter: 1.7 μm) | | $5.0 \times 10^{-2}$ |
| B-2 (diameter: 1.7 μm) | | 0.10 |

-continued

| | |
|---|---|
| B-3 | 0.10 |
| S-1 | 0.20 |
| Gelatin | 1.20 |

Each layer can suitably contain W-1 to W-3, B-4 to B-6, F-1 to F-17, iron salts, lead salts, gold salts, platinum salts, iridium salts and rhodium salts so as to improve the storability, processing properties, pressure resistance, antifungal and antimicrobial properties, antistatic properties and coating properties.

TABLE 3

| Emulsion | Average AgI content (%) | Average grain size diameter (μm) | Coefficient of variation of grain diameter (%) | Diameter/thickness ratio |
|---|---|---|---|---|
| A | 4.0 | 0.45 | 27 | 1 |
| B | 8.9 | 0.70 | 14 | 1 |
| C | 2.0 | 0.55 | 25 | 7 |
| D | 9.0 | 0.65 | 25 | 6 |
| E | 9.0 | 0.85 | 23 | 5 |
| F | 14.5 | 1.25 | 25 | 3 |
| G | 1.0 | 0.07 | 15 | 1 |

| Emulsion | Silver ratio [Core/intermediate/shell] (AgI content) | Particle structure/shape |
|---|---|---|
| A | [1/3] (13/1) | double /octahedral |
| B | [3/7] (25/2) | " |
| C | — | homogeneous/tabular |
| D | [12/59/29] (0/11/8) | triple/tabular |
| E | [8/59/33] (0/11/8) | " |
| F | [37/63] (34/3) | double/tabular |
| G | — | homogeneous/fine |

In Table 3:

(1) The emulsions A to F were reduction-sensitized with thiourea dioxide and thiosulfonic acid in the step of producing the grains according to an Example given in J. P. KOKAI No. Hei 2-191938.

(2) The emulsions A to F were sensitized with gold, sulfur or selenium in the presence of a spectral sensitizing dye described with reference to each photosensitive layer and sodium thiocyanate according to J. P. KOKAI No. Hei 3-237450.

(3) In the preparation of tabular grains, a gelatin having a low-molecular weight was used according to an Example given in J. P. KOKAI No. Hei 1-158426.

(4) Transformation lines as described in J. P. KOKAI No. Hei 3-237450 were observed on the tabular grains and regular crystal grains having the grain structure with a high-pressure electron microscope.

ExC-1

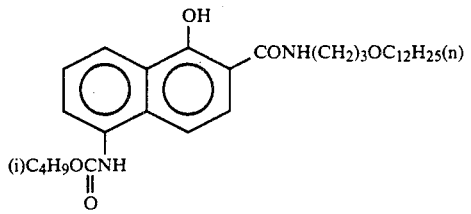

ExC-2

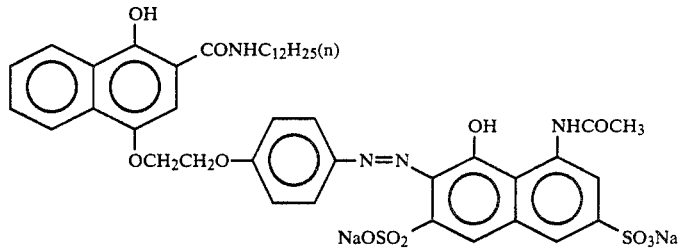

ExC-3

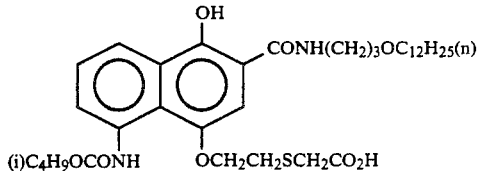

ExC-4

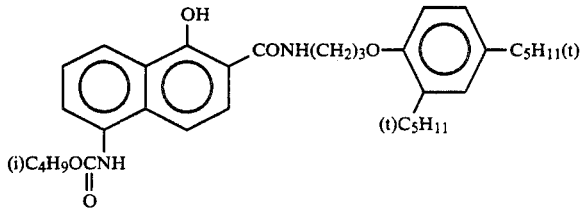

-continued
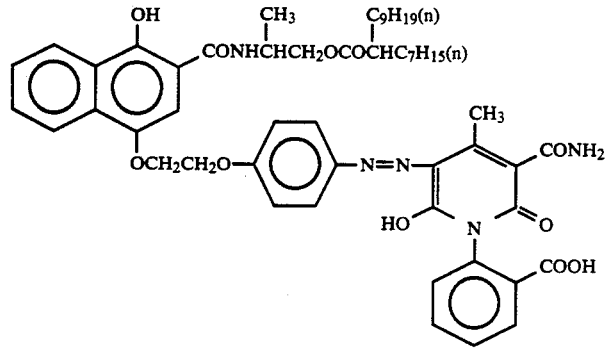
ExC-5
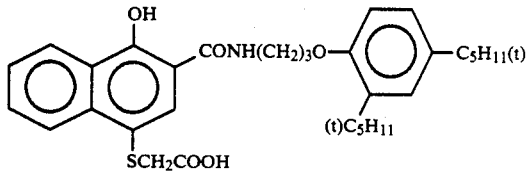
ExC-6
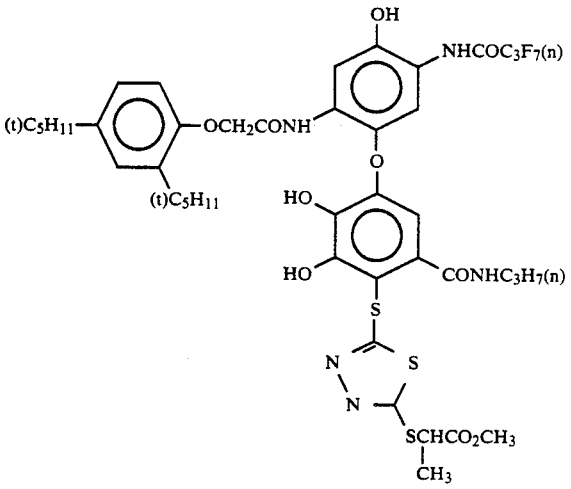
ExC-7
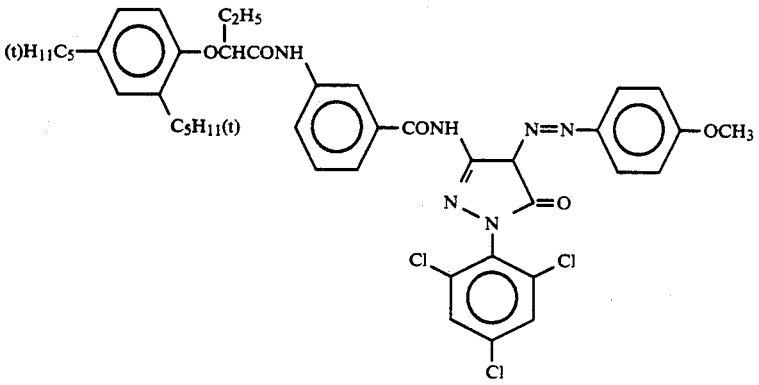
ExM-1

-continued
ExM-2
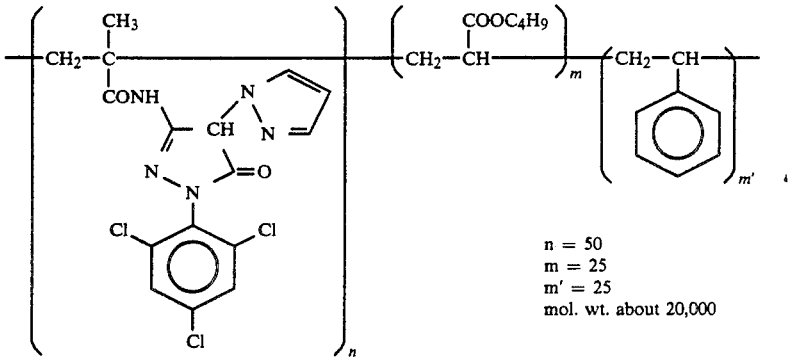
ExM-3
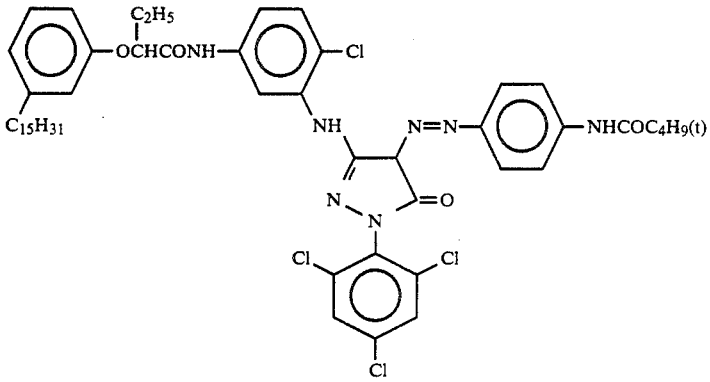
ExM-4
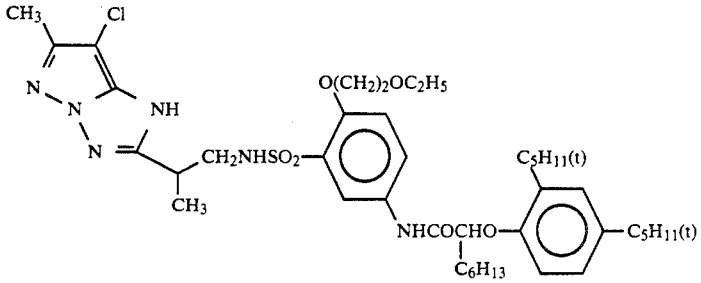
ExM-5
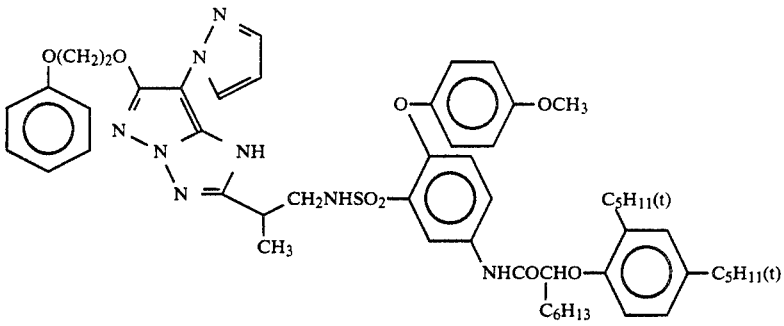
ExY-1
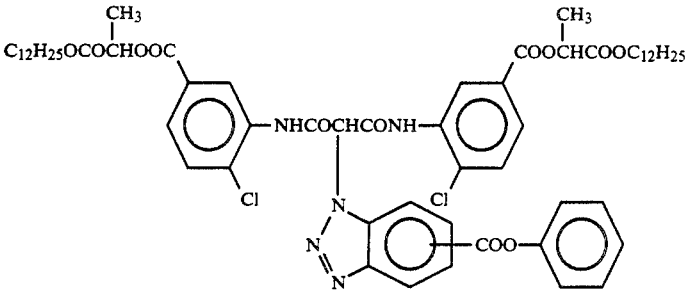

-continued
ExY-2
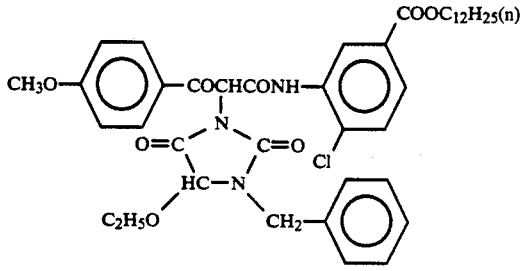
ExF-1
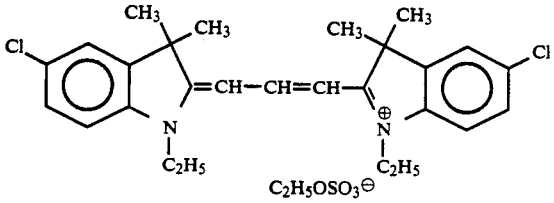
Cpd-1
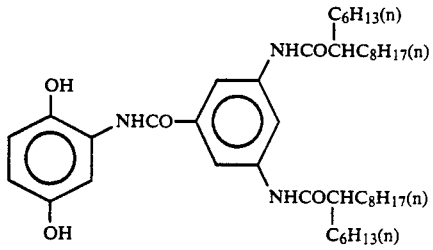
UV-1
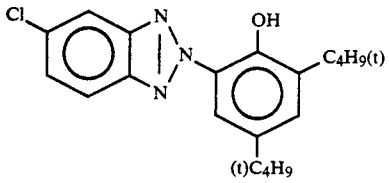
UV-2
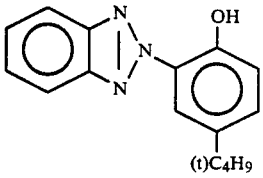
UV-3
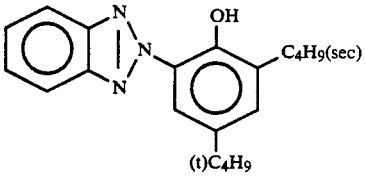
UV-4
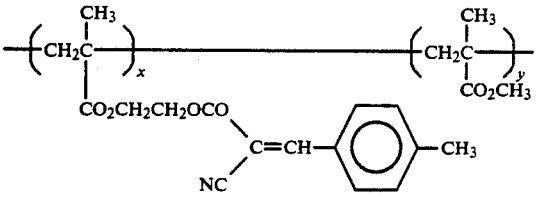
x:y = 70:30 (wt %)

-continued
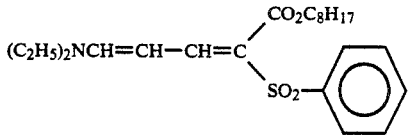
UV-5
Tricresyl phosphate — HBS-1
Di-n-butyl phthalate — HBS-2
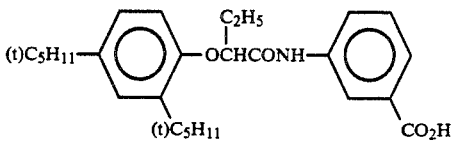
HBS-3
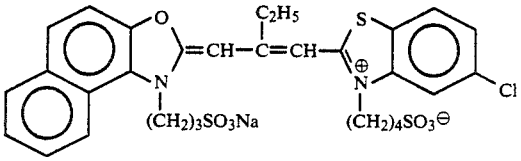
ExS-1
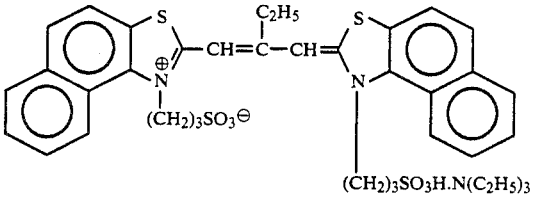
ExS-2
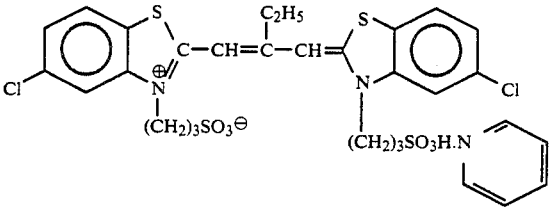
ExS-3
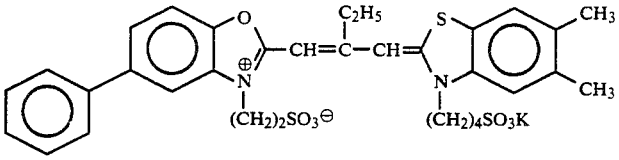
ExS-4
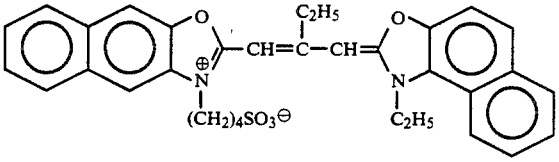
ExS-5
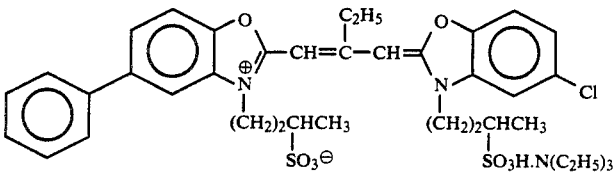
ExS-6

-continued
ExS-7
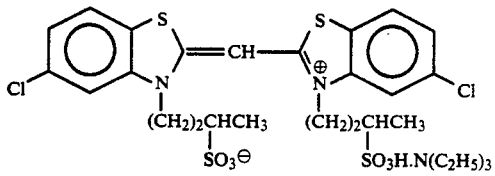
S-1
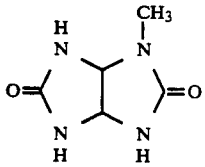
H-1
$CH_2{=}CH{-}SO_2{-}CH_2{-}CONH{-}CH_2$
$CH_2{=}CH{-}SO_2{-}CH_2{-}CONH{-}CH_2$
B-1
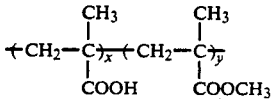
x/y = 10/90
B-2
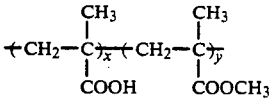
x/y = 40/60
B-3
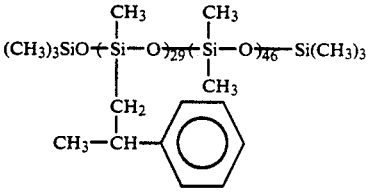
B-4
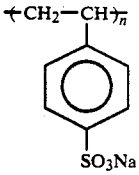
average molecular weight 750,000
B-5
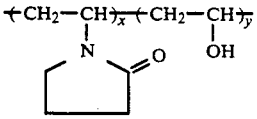
x/y = 70/30
B-6
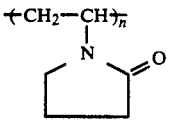
(mol. wt. about 10,000)
W-1
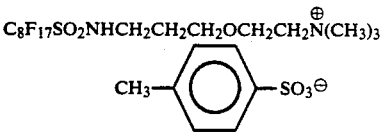
W-2
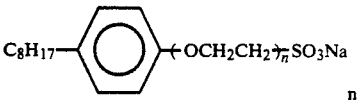
n = 2~4

-continued
W-3
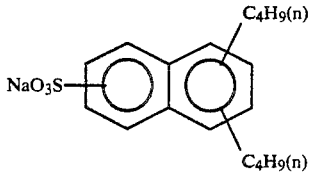
F-1
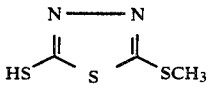
F-2
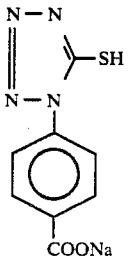
F-3
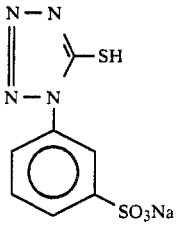
F-4
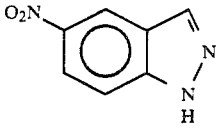
F-5
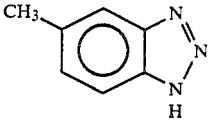
F-6
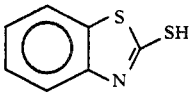
F-7
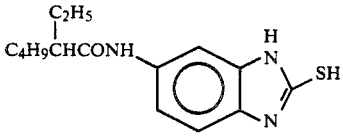
F-8
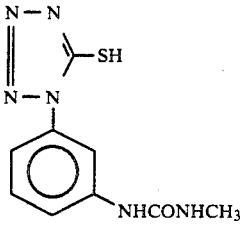
F-9
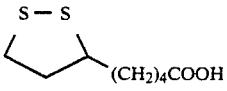

-continued

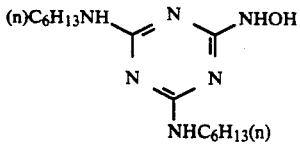

F-10

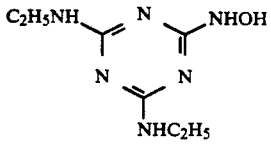

F-11

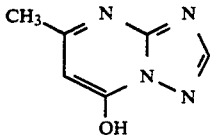

F-12

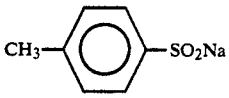

F-13

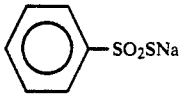

F-14

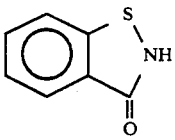

F-15

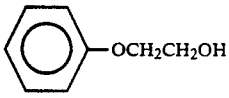

F-16

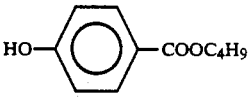

F-17

After completion of the exposure of the color photographic material as described above, it was processed with an automatic developing machine until the total amount of the color developer replenished had reached three times as much as the capacity of the tank.

(Processing method)

| Step | Time | Temp. | Amount of replenisher | Capacity of tank |
|---|---|---|---|---|
| Color development | 3 min 15 sec | 38° C. | 22 ml | 20 l |
| Bleaching | 3 min 00 sec | 38° C. | 25 ml | 40 l |
| Washing with water | 30 sec | 24° C. | 1200 ml | 20 l |
| Fixing | 3 min 00 sec | 38° C. | 25 ml | 30 l |
| Washing with water (1) | 30 sec | 24° C. | counter-current from (2) to (1) | 10 l |
| Washing with water (2) | 30 sec | 24° C. | 1200 ml | 10 l |
| Stabilization | 30 sec | 38° C. | 25 ml | 10 l |

-continued (Processing method)

| Step | Time | Temp. | Amount of replenisher | Capacity of tank |
|---|---|---|---|---|
| Drying | 4 min 20 sec | 55° C. | | |

In the above table, the amount of the replenisher is given per m of the photosensitive material having a width of 35 mm.

The composition of the processing solution used were as follows:

| | Mother liquor (g) | Replenisher (g) |
|---|---|---|
| (Color developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |

-continued

| | | |
|---|---|---|
| Potassium bromide | 1.4 | 0.3 |
| Potassium iodide | 1.5 mg | — |
| Hydroxylamine sulfate | 2.4 | 2.8 |
| 4-[N-ethyl-N-β-hydroxyethylamino]-2-methylaniline sulfate (P-5) | 4.5 | 6.2 |
| Water | ad 1.0 l | 1.0 l |
| pH | 10.05 | 10.15 |
| (Bleaching solution) | | |
| Ferric sodium ethylenediaminetetraacetate trihydrate | 100.0 | 120.0 |
| Disodium ethylenediaminetetraacetate | 10.0 | 11.0 |
| 3-Mercapto-1,2,4-triazole | 0.08 | 0.09 |
| Ammonium bromide | 140.0 | 160.0 |
| Ammonium nitrate | 30.0 | 35.0 |
| Aqueous ammonia (27% | 6.5 ml | 4.0 ml |
| Water | ad 1.0 l | 1.0 l |
| pH | 6.0 | 5.7 |
| (Fixing solution) | | |
| Disodium ethylenediaminetetraacetate | 0.5 | 0.7 |
| Ammonium sulfite | 20.0 | 22.0 |
| Aqueous ammonium thiosulfate solution (700 g/l) | 290 mol/l | 320 mol/l |
| Water | ad 1.0 l | 1.0 l |
| pH | 6.7 | 7.0 |
| | | Both mother liquor and replenisher (g) |

| | |
|---|---|
| (Stabilizer) | |
| Sodium p-toluenesulfinate | 0.03 |
| Polyoxyethylene p-monononylphenyl ether (average degree of polymerization:10) | 0.2 |
| Disodium ethylenediaminetetraacetate | 0.05 |
| 1,2,4-Triazole | 1.3 |
| 1,4-Bis(1,2,4-triazol-1-ylmethyl)piperazine | 0.75 |
| Water | ad 1.0 l |
| pH | 8.5 |

The process wherein the running processing solution thus prepared was used will be referred to as "process 151". The color developers were prepared in the same manner as that described above except that the color developing agent P-5 in the color developer was replaced with an equimolar amount of a comparative color developing agent or a color developing agent of the present invention listed in Table 101, and then the continuous process was conducted in the same manner as that described above to obtain a running processing solution (processes 152 to 159).

The processing velocity was evaluated as follows: The sample 501 was subjected to the wedge exposure and then the process was conducted with each running processing solution (process 152 to 159) while the color development time was varied from 1 min to 3 min 30 sec at a rate of 15 sec point and the optical density of the cyan image of each sample was determined. Separately, the sample 501 was subjected to the same wedge exposure as that described above and then to the process 151 (color development time: 3 min 15 sec) and the cyan temperature was determined as described above. The density curve of the cyan image was compared with that of the sample obtained by the above-described process (color development time being varied at a rate of 15 sec point) and the time necessitated for obtaining the equal or higher cyan density was determined to obtain the results given in Table 101.

In order to examine a reduction of the cyan image density during the storage, the sample was kept at 100° C. for 12 days and the remaining density in the region of the cyan initial density of 1.2 was determined. The results are given in Table 101.

Comparative color developing agent P-51

[Chemical formula 24]

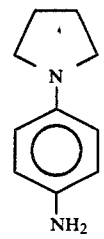

(Compound No. 46 described on page 3,100 of Journal of the American Chemical Society, Vol. 73)

TABLE 101

| Process | Color developing agent | Process time | Remaining density | Remarks |
|---|---|---|---|---|
| 151 | P-5 | 3 min 15 sec | 1.09 | Comp. Ex. |
| 152 | P-51 | inferior to process 151 even after 3 min 30 sec | 0.56 | " |
| 153 | I-3 | 2 min 30 sec | 1.12 | Present invention |
| 154 | I-5 | 2 min 15 sec | 1.15 | Present invention |
| 155 | I-6 | 2 min | 1.14 | Present invention |
| 156 | I-10 | 1 min 45 sec | 1.13 | Present invention |
| 157 | I-14 | 1 min 45 sec | 1.15 | Present invention |
| 158 | I-17 | 2 min 30 sec | 1.14 | Present invention |
| 159 | I-20 | 1 min 45 sec | 1.11 | Present invention |

It is apparent from Table 101 that when the color developing agent of the present invention was used, the density in the red-sensitive layer (bottom layer) of the photosensitive material was obtained in a far shorter development time than that of P-5, that the process could be accelerated on such a high level and that the cyan image having a high fastness to darkness and heat could be obtained. Such a high fastness of the cyan image cannot be obtained unless both $R_2$ and $R_3$ in the general formula [II] are alkyl groups. It is impossible to infer this fact from the color developing agent P-51 used in the Comparative Example.

EXAMPLE 6

A sample 601 was prepared in the same manner as that of sample 501 in Example 5 except that ExY-1 was replaced with an equimolar amount of ExY-3, ExY-2 was replaced with an equimolar amount of ExY-4 and 0.01 g/m$^2$ of Exm-6 was incorporated into the seventh layer (green-sensitive emulsion layer of a low sensitivity). The same experiment as that of Example 1 was conducted by using the sample 601 to obtain substantially the same results as those of Example 5.

[Chemical formula 25]

-continued

ExY-3

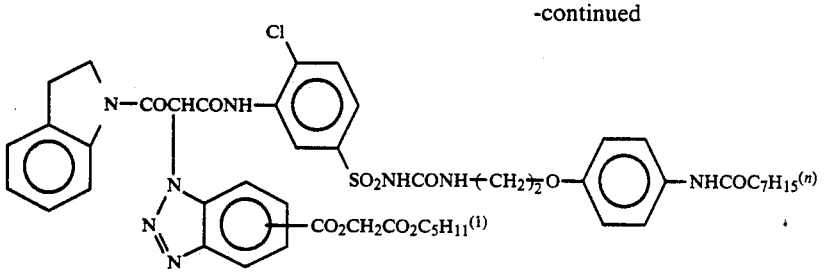

ExY-4

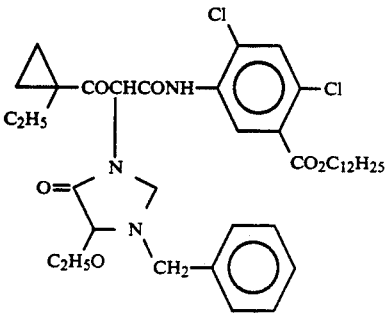

ExM-6

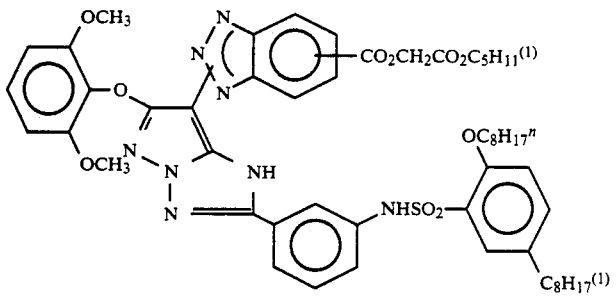

EXAMPLE 7

A paper support having the both surfaces laminated with polyethylene was subjected to a corona discharge process. An undercoating gelatin layer containing sodium dodecylbenzenesulfonate was formed thereon and then photographic layers were formed thereon to prepare a multi-layer color printing paper (sample 701) having a layer structure shown below. The coating solutions were prepared as described below.

Preparation of the first layer-forming coating solution:

153.0 g of a yellow coupler (ExY), 15.0 g of a color image stabilizer (Cpd-1), 7.5 g of another color image stabilizer (Cpd-2) and 16.0 g of still another color image stabilizer (Cpd-3) were dissolved in a mixture of 25 g of a solvent (Solv-1), 25 g of another solvent (Solv-2) and 180 ml of ethyl acetate. The resulting solution was emulsion-dispersed in 1,000 g of 10% aqueous gelatin solution containing 60 ml of 10% sodium dodecylbenzenesulfonate and 10 g of citric acid to prepare an emulsified dispersion A. On the other hand, a silver chlorobromide emulsion A [mixture of a large size emulsion A having an average cubic grain size of 0.88 μm and a small size emulsion A having an average cubic grain size of 0.70 μm in a ratio of 3:7 (in terms of molar ratio of silver)](coefficient of variation of the grain size distribution of them being 0.08 and 0.10, respectively, and both emulsions containing 0.3 molar % of silver bromide in a part of the grain surface) was prepared. The large size emulsion A contained $2.0\times10^{-4}$ mol, per mol of silver, of each of the blue-sensitive sensitizing dyes A and B and the small size emulsion A contained $2.5\times10^{-4}$ mol, per mol of silver, of each of them. The chemical ripening of the emulsion was conducted with a sulfur sensitizer and a gold sensitizer. The above-described emulsified dispersion A was mixed with this silver chlorobromide emulsion A to obtain the first layer-forming coating solution having a composition which will be described below.

The coating solutions for forming the second layer to the seventh layer were prepared in the same manner as that of the coating solution for forming the first layer. Sodium salt of 1-hydroxy-3,5-dichloro-s-triazine was used as a gelatin hardener in the respective layers.

Cpd-14 and Cpd-15 were added to the respective layers in such a manner that the total amount of each of them would be 25.0 mg/m² and 50 mg/m², respectively.

The following spectral sensitizing dyes were incorporated into the silver chlorobromide emulsions for forming the respective sensitive emulsion layers.

Blue-sensitive emulsion layer:

Sensitizing dye A

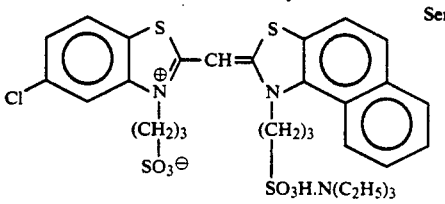

and

-continued

Sensitizing dye B

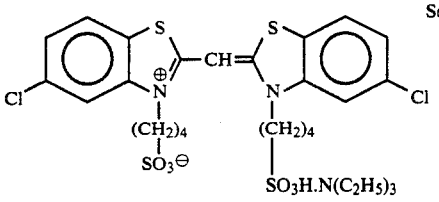

(each in an amount of $2.0\times10^{-4}$ mol per mol of the silver halide for the large size emulsion and $2.5\times10^{-4}$ mol for the small size emulsion)

Green-sensitive emulsion layer:

Sensitizing dye C

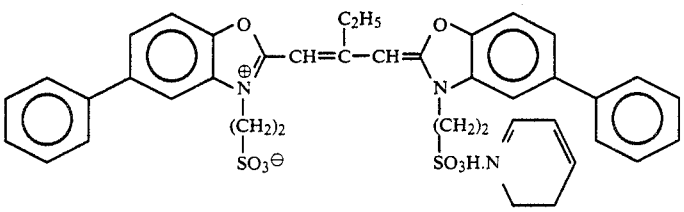

in an amount of $4.0\times10^{-4}$ mol per mol of the silver halide for the large size emulsion and $5.6\times10^{-4}$ mole for the small size emulsion)

Sensitizing dye D

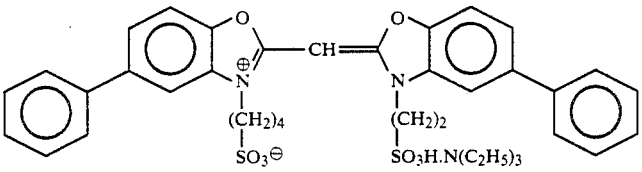

(in an amount of $7.0\times10^{-5}$ mol per mol of the silver halide for the large size emulsion and $1.0\times10^{-5}$ mol for the small size emulsion)

Red-sensitive emulsion layer:

Sensitizing dye E

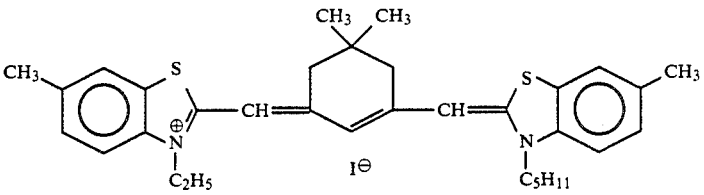

(in an amount of $0.9\times10^{-4}$ mol per mol of the silver halide for the large size emulsion and $1.1\times10^{314}$ mol for the small size emulsion)

Further the following compound was added in an amount of $2.6\times10^{-3}$ mol per mol of the silver halide:

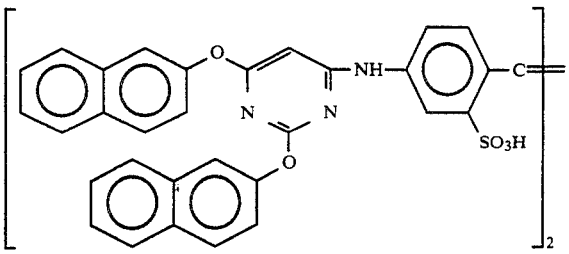

$8.5\times10^{-5}$ mol, $7.7\times10^{-4}$ mol and $2.5\times10^{-4}$ mol, per mol of the silver halide, of 1-(5-methylureidohenyl)-5-mercaptotetrazole were added to the blue-sensitive emulsion layer, green-sensitive emulsion layer and red-sensitive emulsion layer, respectively.

$1\times10^{-4}$ mol and $2\times10^{-4}$ mol, per mol of the silver halide, of 4-hydroxy-6-methyl-1,3,3a,7-tetrazaindene was added to the blue-sensitive emulsion layer and green-sensitive emulsion layer, respectively.

In addition, the following dyes were added to the emulsion layers so as to prevent the irradiation (the numerals in the parentheses to indicate the amount used for the coating).

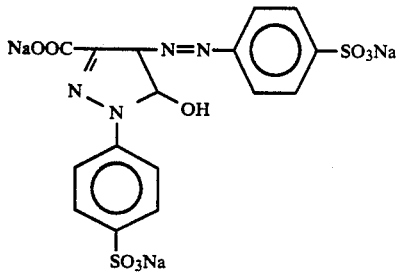

(10 mg/m²)

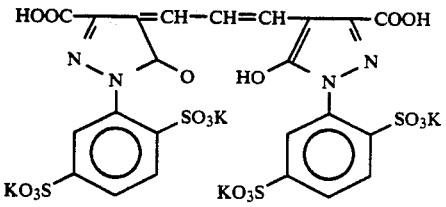

(10 mg/m²)

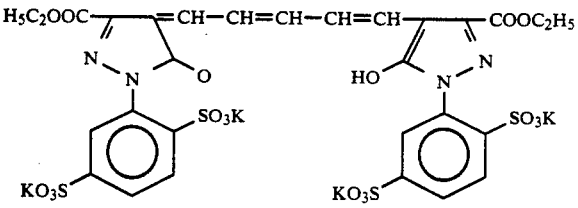

(40 mg/m²)

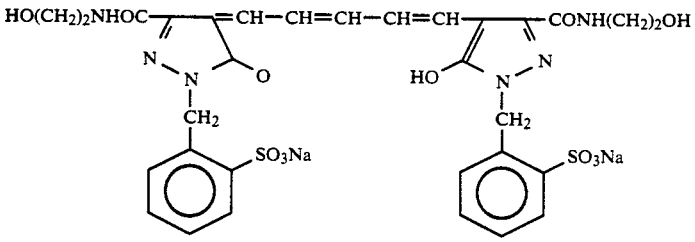

(20 mg/m²)

Support:

Polyethylene-laminated paper
[containing a white dye ($TiO_2$) and a blue dye (ultramarine) in the polyethylene layer on the first layer side]

| | |
|---|---|
| The first layer (blue-sensitive layer): | |
| Above-described silver chlorobromide emulsion A | 0.27 |
| Gelatin | 1.36 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| The second layer (color mixing-inhibition layer) | |
| Gelatin | 0.90 |
| Color mixing inhibitor (Cpd-4) | 0.05 |
| Solvent (Solv-7) | 0.03 |
| Solvent (Solv-2) | 0.25 |
| Solvent (Solv-3) | 0.01 |
| The third layer (green-sensitive layer) | |
| Silver chlorobromide emulsion [mixture of large size emulsion B having average cubic grain size of 0.55 μm and small size emulsion B having that of 0.39 μm in a molar ratio of 1:3 (in terms of Ag); Coefficient of variation of grain size distribution being 0.10 and 0.08, respectively; 0.8 molar % of AgBr being contained in a part of the the surface layer of the grains in each emulsion] | 0.13 |
| Gelatin | 1.45 |
| Magenta coupler (ExM) | 0.16 |
| Color image stabilizer (Cpd-5) | 0.15 |
| Color image stabilizer (Cpd-2) | 0.03 |
| Color image stabilizer (Cpd-6) | 0.01 |

-continued

| | |
|---|---|
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| The fourth layer (color mixing-inhibition layer) | |
| Gelatin | 0.60 |
| Color mxing inhibitor (Cpd-4) | 0.03 |
| Solvent (Solv-7) | 0.02 |
| Solvent (solv-2) | 0.18 |
| Solvent (Solv-3) | 0.10 |
| The fifth layer (red-sensitive emulsion layer) | |
| Silver chlorobromide emulsion [mixture of large size emulsion C having average cubic grain size of 0.50 μm and small size emulsion C having that of 0.41 μm in a molar ratio of 1:4 (in terms of Ag); Coefficient of variation of grain size distribution being 0.09 and 0.11, respectively; 0.8 molar % of AgBr being contained in a part of the surface layer of the grains in each emulsion] | 0.20 |
| Gelatin | 0.85 |
| Cyan coupler (ExC) | 0.33 |
| Ultraviolet ray-absorbing agent (UV-2) | 0.18 |
| Color image stabilizer (Cpd-9) | 0.15 |
| Color image stabilizer (Cpd-10) | 0.15 |
| Color image stabilizer (Cpd-11) | 0.01 |
| Solvent (Solv-6) | 0.22 |
| Color image stabilizer (Cpd-8) | 0.01 |
| Color image stabilizer (Cpd-6) | 0.01 |
| Solvent (Solv-1) | 0.01 |
| The sixth layer (ultraviolet ray-absorbing layer) | |
| Gelatin | 0.55 |
| Ultraviolet ray-absorbing agent (UV-1) | 0.38 |
| Color image stabilizer (Cpd-12) | 0.15 |
| Color image stabilizer (Cpd-5) | 0.02 |
| The seventh layer (protecting layer) | |
| Gelatin | 1.13 |
| Acryl-modified copolymer of polyvinyl alcohol (degree of modification; 17%) | 0.05 |
| Liquid paraffin | 0.02 |
| Color image stabilizer (Cpd-13) | 0.01 |

(ExY) Yellow coupler

[1:1 (molar ratio) mixture of the following two compounds]

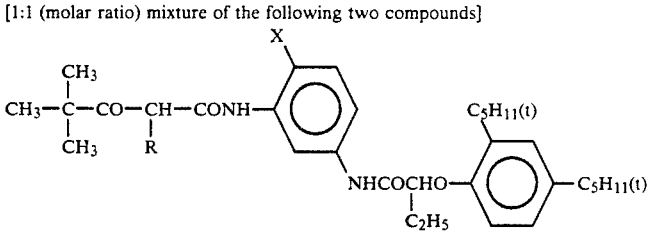

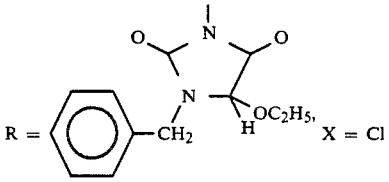

and

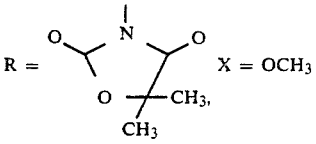

(ExM) Magenta coupler

-continued
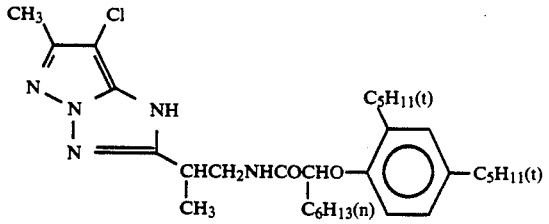
(ExC) Cyan coupler
[3:7 (molar ratio) mixture of the following two compounds]
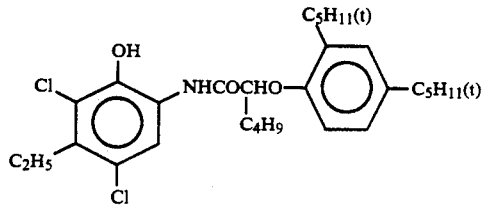
and
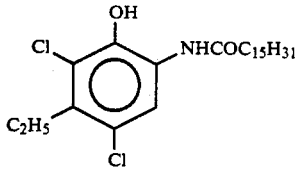
(Cpd-1) Color image stabilizer
$-(CH_2-\underset{\underset{CONHC_4H_9(t)}{|}}{CH})_n-$
average molecular weight: 60,000
(Cpd-2) Color image stabilizer
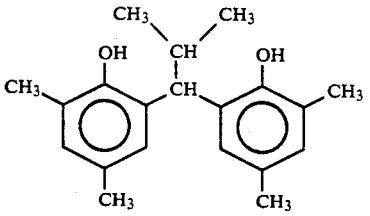
(Cpd-3) Color image stabilizer
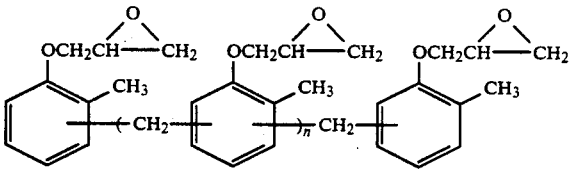
n = 7 to 8 on average
(Cpd-4) Color mixing inhibitor:
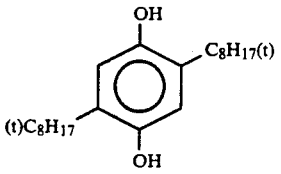
(Cpd-5) Color image stabilizer:

-continued
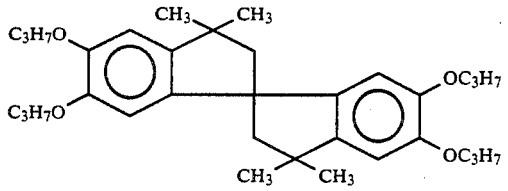
(Cpd-6)
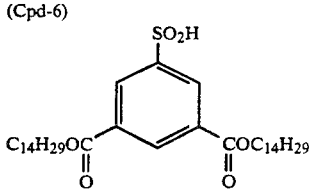
(Cpd-7)
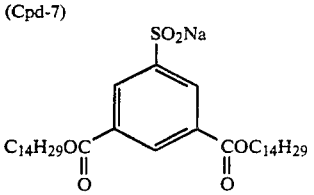
(Cpd-8) Color image stabilizer
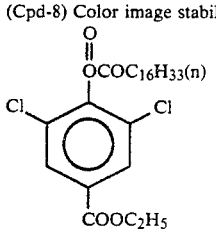
(Cpd-9) Color image stabilizer
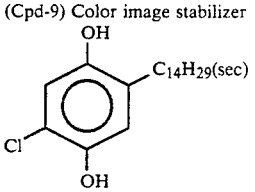
(Cpd-10) Color image stabilizer
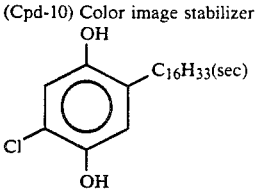
(Cpd-11)
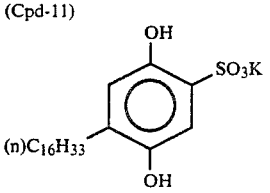
(Cpd-12)
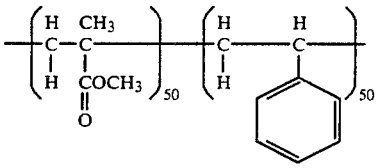
average molecular weight: 60,000

-continued
(Cpd-13)
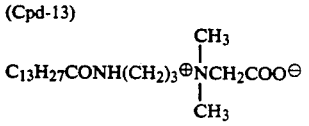
(Cpd-14) Antiseptic
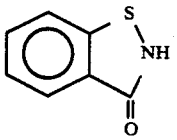
(Cpd-15) Antiseptic
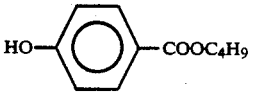
(UV-1) Ultraviolet ray absorber:
mixture of the following compounds in a weight ratio of 10:5:1:5
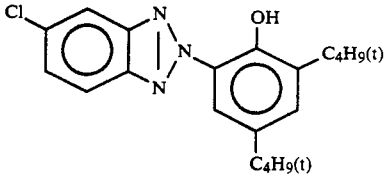
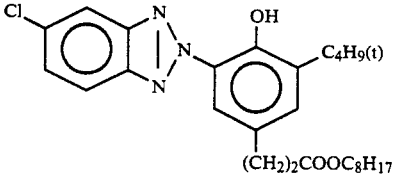
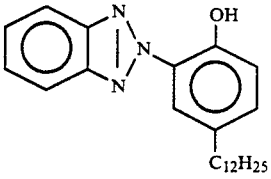
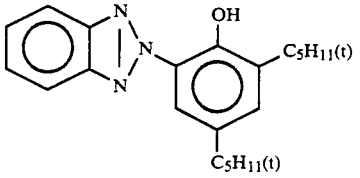
(UV-2) Ultraviolet ray absorber:
mixture of the following compounds in a weight ratio of 1:2:2
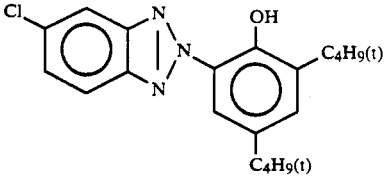
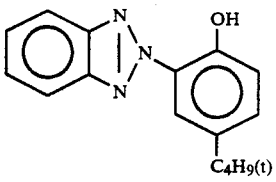
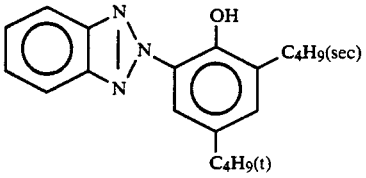
(Solv-1) Solvent:
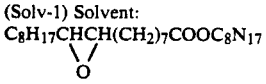
(Solv-2) Solvent:

-continued

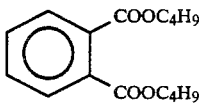

(Solv-3) Solvent:

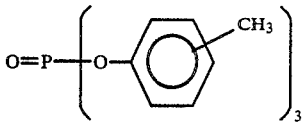

(Solv-4) Solvent:

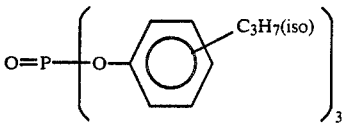

(Solv-5) Solvent:

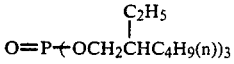

(Solv-6) Solvent:

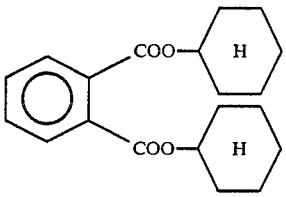

(Solv-7) Solvent:

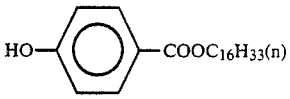

Each sample was subjected to the gradient exposure through a sensitometric trichromatic separation filter with a sensitometer (FWH of Fuji Photo Film Co., Ltd.; color temperature Of the light source: 3200° K.). The exposure conditions comprised 250 CMS and 0.1 sec.

The samples thus exposed were subjected to the running test of the color development with a paper-processing machine and processing solutions which will be described below according to the following processing steps until a color developer had been replenished in an amount of twice as much as the tank capacity:

| Step | Temp. | Time | Amount of replenisher* | Capacity of tank |
|---|---|---|---|---|
| Color development | 35° C. | 45 sec | 161 ml | 17 l |
| Bleaching | 30 to 35° C. | 45 sec | 215 ml | 17 l |
| Rinse 1 | 30 to 35° C. | 20 sec | — | 10 l |
| Rinse 2 | 30 to 35° C. | 20 sec | — | 10 l |
| Rinse 3 | 30 to 35° C. | 20 sec | 350 ml | 10 l |
| Drying | 70 to 80° C. | 60 sec | | |

*In the above table, the amount of the replenisher is given per $m^2$ of the photosensitive material. (3-tank countercurrent system from rinse 3 to rinse 1)

The compositions of the processing solutions were as described below:

| (Color developer) | (Mother liquor) | (Replenisher) |
|---|---|---|
| Water | 800 ml | 800 ml |
| Ethylenediamine-N,N,N,N-tetramethylenephosphonic acid | 1.5 g | 2.0 g |

The process wherein the running processing solution thus Prepared was used will be referred to as "process 351". The color developers were prepared in the same manner as that described above except that the color developing agent P-6 in the color developer was replaced with an equimolar amount of a comparative color developing agent or a color developing agent of the present invention listed in Table 301, and then the continuous process was conducted in the same manner as that described above to obtain a running processing solution (processes 352 to 358).

The following experiment was conducted with the running processing solutions thus prepared: each sample was subjected to the gradient exposure through a sensitometric trichromatic separation filter with a sensitometer (FWH of Fuji Photo Film Co., Ltd.; color temperature of the light source: 3200° K. The exposure conditions comprised 250 CMS and 0.1 sec. The samples thus exposed were subjected to the running test with the running processing solution (processes 351 to 358). Another sample was prepared in the same manner as that described above except that the processing time in the color developing bath was altered from 45 sec to 15 sec. The rapidness of the process was determined by determining the maximum density ($D_{max}$) of the yellow image in each processing time (12 sec or 45 sec).

In order to examine a reduction of the cyan image density during the storage, the sample was kept at 100° C. for 9 days and the remaining density in the region of the cyan initial density of 1.2 was determined. The results are given in Table 301.

TABLE 301

| Process | Color developing agent | B, $D_{max}$ 12 sec | 45 sec | Remaining density | Remarks |
|---|---|---|---|---|---|
| 351 | P-6 | 0.92 | 2.1 | 1.02 | Comp. Ex. |
| 352 | P-51 | 0.75 | 1.9 | 0.56 | " |
| 353 | I-8 | 1.4 | 2.1 | 1.04 | Present invention |
| 354 | I-11 | 1.8 | 2.1 | 1.05 | Present invention |
| 355 | I-12 | 1.8 | 2.2 | 1.04 | Present invention |
| 356 | I-13 | 1.7 | 2.1 | 1.05 | Present invention |
| 357 | I-16 | 1.6 | 2.1 | 1.07 | Present invention |
| 358 | I-19 | 1.5 | 2.1 | 1.03 | Present invention |

The processing velocities of the color developing agents can be compared with each other by determining the developing progress in the blue-sensitive emulsion layer (the bottom layer) of each photosensitive material. The details are described in J.P. KOKAI No. Hei 3-246543.

It is apparent from Table 301 that when the color developing agent of the present invention was used, the yellow image was colored after a development time of 12 sec which was far shorter than the usual development time (45 sec). It is also apparent that the fastness of the cyan image was improved by using the developing agent of the present invention.

EXAMPLE 8

The same color developer as the photosensitive material 9 in Example 3 of J.P. KOKAI No. Hei 2-93641 was prepared except that the color developing agent in the color developer was replaced with an equimolar amount of the color developing agent (I-4), (I-7), (I-11) or (I-19) of the present invention, and then it was exposed and developed. The development time was reduced and the obtained cyan image was excellent and had a high fastness to darkness and heat.

EXAMPLE 9

The same color developer as the sample 101 in Example 1 of J.P. KOKAI No. Hei 2-854 was prepared except that the color developing agent in the color developer was replaced with an equimolar amount of the color developing agent (I-1), (I-6), (I-9) or (I-14) of the present invention, and then it was exposed and developed. The color development time was reduced and the obtained cyan image was excellent and had a high fastness to darkness and heat.

EXAMPLE 10

The same color developer as the color photographic material described in Example 2 of J.P. KOKAI No. Hei 1-158431 was prepared except that the color developing agent was replaced with an equimolar amount of the color developing agent (I-3), (I-9), (I-10) or (I-15) of the present invention, and then it was exposed and developed. The color development time was reduced and the obtained cyan image was excellent and had a high fastness to darkness and heat.

EXAMPLE 11

The same color developer as that in Example 2 of J.P. KOKAINo. Hei 2-90145 was prepared except that the color developing agent in the color developer was replaced with an equimolar amount of the color developing agent (I-8), (I-10), (I-14) or (I-16) of the present invention, and then it was exposed and developed. The color development time was reduced and the obtained cyan image was excellent and had a high fastness to darkness and heat.

It is apparent from the Examples that the color developing agent of the formula [II]has rapid processing properties and capable of forming a cyan dye image of a high fastness to darkness and heat.

What is claimed is:

1. A process for forming a color image which comprises developing an image-wise exposed silver halide color photographic material with an alkali solution comprising a color developing agent represented by the following general formula [I] and water.

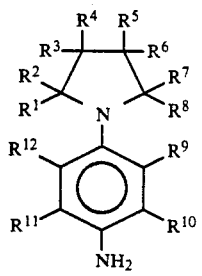

where $R^1$ to $R^8$ may be the same or different from one another and each represent a hydrogen atom, halogen atom, amino group, hydroxyl group, cyano group, alkyl group, alkoxyl group, amido group, sulfonamido group, carbamoyl group, alkoxycarbonylamino group, ureido group, sulfamoylamino group, sulfonyl group, carboxyl group or sulfo group, $R^9$ to $R^{12}$ may be the same or different and each represent a hydrogen atom, halogen atom, amino group, hydroxyl group, alkyl group, alkoxyl group, amido group, sulfonamido group, alkoxycarbonylamino group, ureido group or sulfamoylamino group, with the proviso that at least one of $R^1$ to $R^{12}$ is not hydrogen atom.

2. A process of claim 1 wherein the alkali solution comprises the color developing agent in an amount of $2\times10^{-4}$ to $1\times10^{-1}$ mol per liter of the solution.

3. A process of claim 1 wherein the alkali solution comprises a pH buffering agent and has the pH of 9 to 12.

4. A process of claim 1 wherein the color developing agent is represented by the following general formula [I-a]:

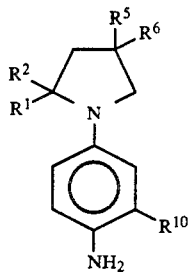

wherein $R^1$, $R^2$, $R^5$, $R^6$ and $R^{10}$ are as defined in the general formula [I].

5. A process of claim 4 wherein $R^1$, $R^2$, $R^5$, $R^6$ and $R^{10}$ in the formula (I-a) are each a hydrogen atom, amino group, hydroxyl group, alkyl group, alkoxyl group, amido group, sulfonamido group, carbamoyl group, or ureido group, and at least one of them is not a hydrogen atom, and $R^{10}$ is a hydrogen atom, alkyl group, alkoxyl group, amido group, sulfonamido group, alkoxycarbonylamino group or ureido group.

6. A process of claim 5 wherein, the formula [I-a], $R^1$ and $R^2$ are each a hydrogen atom, at least one of $R^5$ and $R^6$ is not hydrogen atom and $R^{10}$ is a hydrogen atom or alkyl group.

7. A process of claim 1 wherein the development is conducted at a temperature of 35° to 50° C. for 10 sec to 2 min.

8. A process of claim 1 wherein silver halide contained in the silver halide color photographic material is a silver chlorobromide or silver chloride containing at least 60 molar % of silver chloride.

9. A process of claim 1 wherein silver halide contained in the silver halide color photographic material is a silver bromoiodide or silver chlorobromiodide containing 3 to 15 molar % of silver iodide.

10. A process for forming a color image comprising the step of developing a color exposed silver halide color photographic material with a processing solution containing a developing agent represented by formula (II):

general formula (II):

-continued

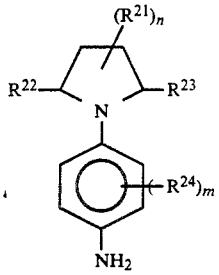

wherein $R^{21}$ represents a substituent; $R^{22}$ and $R^{23}$ each represent a substituted or unsubstituted alkyl group; $R^{24}$ represents a substituent; n represents an integer of 0 to 6 and when n is an integer of 2 or greater, the $R^{21}$'s may be the same or different from each other; m represents an integer of 0 to 4 and when m is an integer of 2 or greater, the $R^{24}$'s may be the same or different from each other and may form a ring.

11. A process of claim 10 wherein the solution comprises the color developing agent in an amount of 0.1 to 20 g per liter of the solution.

12. A process of claim 10 wherein the solution comprises a pH buffering agent and has pH of 9 to 12.5.

13. A process of claim 10 wherein the developing agent is represented by the following general formula [II-a]:

general formula [II-a]

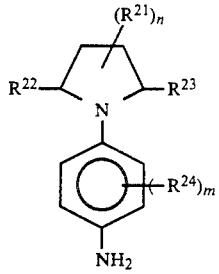

$R^{21}$, $R^{22}$, $R^{23}$, $R^{24}$ and n are as defined in formula [II] and m represents 0 or 1.

14. A process of claim 13 wherein $R^{21}$ is an alkyl group, cyano group, hydroxyl group, carboxyl group, alkoxy group, amino group, acylamino group, alkylamino group, ureido group, sulfamoylamino group, alkylthio group, alkoxycarbonylamino group, sulfonamido group, carbamoyl group, sulfamoyl group, sulfonyl group or carbamoyloxy group, $R^{22}$ and $R^{23}$ are unsubstituted alkyl groups, hydroxyalkyl groups, alkoxyalkyl groups, sulfonamidoalkyl groups, sulfamoylalkyl groups and sulfamoylaminoalkyl groups, and $R^{24}$ is an alkyl group, alkoxy group, alkoxycarbonylamino group or ureido group.

15. A process of claim 14 wherein $R^{21}$ is an alkyl group, hydroxyl group, alkoxy group, sulfamoylamino group, sulfonamido group or sulfamoyl group, $R^{22}$ and $R^{23}$ are unsubstituted alkyl groups, hydroxyalkyl groups, alkoxyalkyl groups and sulfonamidoalkyl groups, and $R^{24}$ is an alkyl group or alkoxy group.

16. A process of claim 10 wherein the development is conducted at a temperature of 20° to 50° C. for 10 sec to 2 min.

* * * * *